US007523969B2

(12) United States Patent
Thornton et al.

(10) Patent No.: US 7,523,969 B2
(45) Date of Patent: Apr. 28, 2009

(54) DOOR ENTRY LATCH

(75) Inventors: Andrew Thornton, Kingswinford (GB); Jack O'Byrne, Fareham (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/678,411

(22) Filed: Feb. 23, 2007

(65) Prior Publication Data

US 2007/0200356 A1 Aug. 30, 2007

Related U.S. Application Data

(60) Provisional application No. 60/777,192, filed on Feb. 26, 2006.

(51) Int. Cl.
*E05C 1/12* (2006.01)

(52) U.S. Cl. ..... 292/172; 292/169.14

(58) Field of Classification Search ..... 292/142, 292/144, 172, 169.17, 169.18, 169.14–169.16
See application file for complete search history.

(56) References Cited

U.S. PATENT DOCUMENTS

| | | | | |
|---|---|---|---|---|
| 0,113,097 | A | 3/1871 | Kitter | |
| 0,248,551 | A | 10/1881 | Baumgartner | |
| 0,311,575 | A | 2/1885 | Fitzgerald | |
| 0,907,389 | A | 12/1908 | Myhre | |
| 3,321,227 | A | 5/1967 | Wyrick | |
| 3,831,988 | A | 8/1974 | Stelma | |
| 3,934,925 | A | 1/1976 | Fetsch | |
| 4,136,540 | A | 1/1979 | Coralli et al. | |
| 4,243,256 | A | 1/1981 | Frydrych | |
| 4,480,862 | A | 11/1984 | Fleming | |
| 4,603,894 | A | 8/1986 | Osenkowski | |
| 5,085,474 | A | 2/1992 | Toledo et al. | |
| 5,419,167 | A | 5/1995 | Yamada et al. | |
| 5,460,100 | A | 10/1995 | Gowda et al. | |
| 5,707,090 | A * | 1/1998 | Sedley | 292/172 |
| 5,816,086 | A * | 10/1998 | Russell, IV | 70/422 |
| 6,338,508 | B1 | 1/2002 | Kleefeldt | |
| 6,585,302 | B2 * | 7/2003 | Lin | 292/142 |
| 6,729,675 | B2 | 5/2004 | Lumpe et al. | |
| 7,096,697 | B2 * | 8/2006 | Keightly | 70/279.1 |
| 2002/0121784 | A1 | 9/2002 | Chevalier | |

FOREIGN PATENT DOCUMENTS

| | | |
|---|---|---|
| DE | 4421036 | 12/1995 |
| DE | 20015292 | 1/2001 |
| DE | 10130268 | 4/2005 |
| FR | 2745322 | 8/1997 |

* cited by examiner

*Primary Examiner*—Gary Estremsky
(74) *Attorney, Agent, or Firm*—Paul & Paul

(57) ABSTRACT

A latch has a latch bolt mounted on a rack and a top gear which engages the rack. The top gear can be driven by an idle gear which is disengageable from a drop gear which in turn is engaged with a lockable drive gear upon rotation of a cam disc. Initial rotation of the cam disc disengages the drop gear. Further rotation of the cam disc moves the top gear so as to permit the rack to move the bolt to the unlatched position. The latch can be operated from one side by the rotation of a lock plug in the drive. The other side of the latch has a turnhandle on the cam disc which unlatches the latch even when the drive gear is locked from the outside.

11 Claims, 46 Drawing Sheets

DOOR ENTRY LATCH

CROSS REFERENCE TO RELATED APPLICATIONS

This application claims priority to U.S. Provisional Patent Application Ser. No. 60/777,192 entitled DOOR ENTRY LATCH filed Feb. 26, 2006, the contents of which are incorporated herein by reference.

BACKGROUND OF THE INVENTION

1. Field of Invention

The present invention relates to the field of vehicle entry latches.

2. Brief Description of the Related Art

Vehicle entry latches can be used to secure doors when a vehicle such as a bus is left unattended. During normal operation vehicle doors are opened and secured using systems such as electric or pneumatic door operating systems. It is desired that the latch securely lock the bus door when the vehicle is not in use and therefore provide vandal resistance. In addition, different latches can be provided for doors hung on the left or on the right. There may be circumstances in which the latch must be opened from inside of the vehicle if perhaps a passenger has remained inside and now needs to exit the vehicle. It will then be desired to reset the latch to its original condition by use of a key or a hand tool for normal use again. It also can be necessary to make the latch useable again without the latch being rebuilt or require the use of a specialized tool after the latch has been opened from the inside in an emergency.

Although many latches are known in the prior art, none are seen to teach or suggest the unique features of the present invention or to achieve the advantages of the present invention.

SUMMARY OF THE INVENTION

The present invention is directed to a latch for securing two members together. The latch can be attached to one of the members. The present invention includes a housing, a latching means for engaging a surface of a keeper on the second member, a rotating means for moving the latching means between the latched position and the unlatched position. The latch has a driving means for moving the rotating means between a first position in which the rotating means can move the latching means from the latched position to the unlatched position. The latch also has a disengaging means for disengaging the driving means from the rotating means such that the rotating means can move the latching means between the latched and unlatched position when the driving means is disengaged from the rotating means. The disengaging means is also moveable to an engaged position in which movement of the driving means moves the rotating means such that said latching means can move between the latched and unlatched position.

The latch also has a cam means for moving the disengaging means between the engaged and disengaged position. The cam means also moves the rotating means such that said rotating means moves the latching means between the latched position and the unlatched position. Movement or rotation of the cam means which moves the latching means can occur after the cam means has acted on the disengaging means so as to disengage the driving means from the rotating means.

The latch also can have a blocking means for engaging the latching means in a blocking position such that the latching means is not capable of movement from the latched position to the unlatched position until further movement or rotation of the cam means occurs. The latch can have a releasing means for disengaging the blocking means from said latching means when said cam means is moved. The blocking means can be a notch in the housing of the latch. The releasing means can be a pin which rides on a sloped or angled surface on the latching means such that the pin is permitted to move out of the notch by movement of a rack on the latching means which moves relative to a bolt of the latching means. However, forces acting on the bolt of the latching means do not permit the latching means to move from the latched position to unlatched position because the pin remains in the notch. When the rack moves relative to the bolt the pin can move on the sloped or inclined surface of the rack and move out of the notch.

The cam means can be provided with a turnhandle which allows a user to open the latch from the inside of a vehicle and still allow the latch to be locked from the outside of the vehicle by a variety of 90 or 180 degree lockplugs. The driving means can be equipped with an adaptor which can accommodate tool driven rather than keyed lock plugs.

BRIEF DESCRIPTION OF THE DRAWINGS

The present invention will be now described with reference to the accompanying drawings in which:

FIG. 111 is a perspective view of the exterior facing side of the third type of adaptor for the latch of the present invention;

FIG. 112 is a perspective view of the interior facing side of the third type of adaptor for the latch of the present invention;

FIG. 113 is a perspective view of the exterior facing side of the fourth type of adaptor for the latch of the present invention;

FIG. 114 is a top view of the fourth type of adaptor for the latch of the present invention;

FIG. 115 is a bottom view of the fourth type of adaptor for the latch of the present invention;

FIG. 116 is a left side view of the fourth type of adaptor for the latch of the present invention;

FIG. 117 is a right side view of the fourth type of adaptor for the latch of the present invention;

FIG. 118 is a perspective view of the exterior facing side of the fifth type of adaptor for the latch of the present invention;

FIG. 119 is a perspective view of the interior facing side of the fifth type of adaptor for the latch of the present invention;

FIG. 120 is a view of the interior facing side of the cam means of the first embodiment of the latch of the present invention;

FIG. 121 is a right side view of the cam means of the first embodiment of the latch of the present invention;

FIG. 122 is a sectional view along line G-G of FIG. 121;

Figure 123:
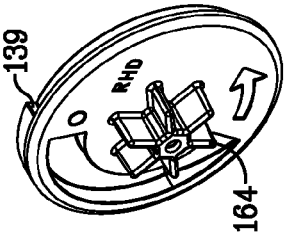
Figure 122:
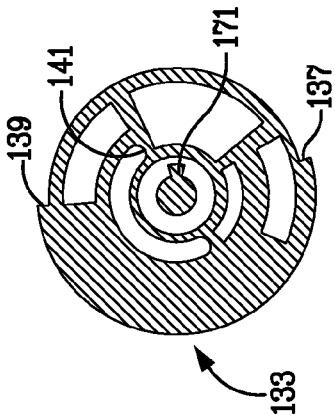
Figure 121:
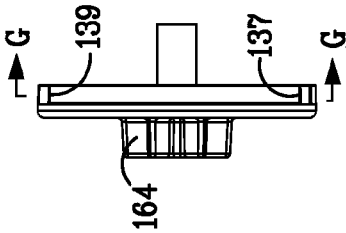
Figure 120:
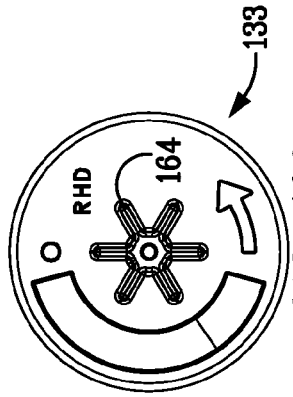
Figure 126:
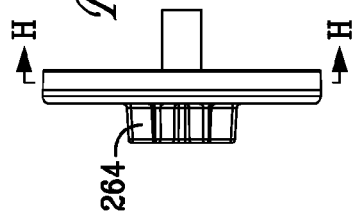
Figure 125:
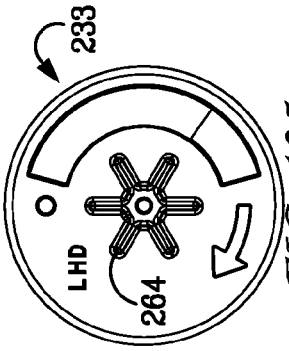
Figure 124:
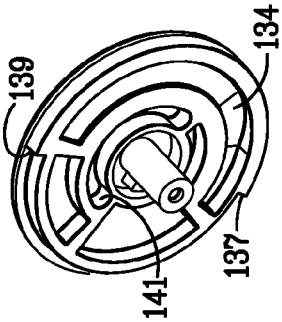
Figure 128:
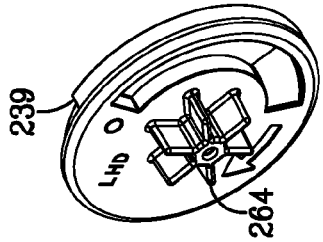
Figure 127:
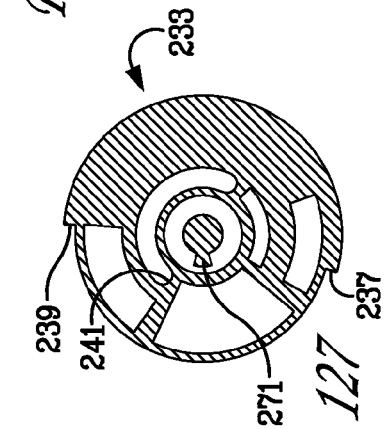
Figure 129:
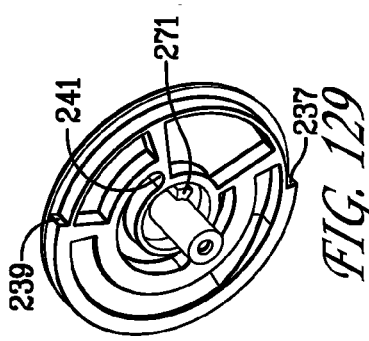

FIG. 123 is a perspective view of the interior facing side of the cam means of the first embodiment of the latch of the present invention;

FIG. 124 is a perspective view of the exterior facing side of the cam means of the first embodiment of the latch of the present invention;

FIG. 125 is a view of the interior facing side of the cam means of the second embodiment of the latch of the present invention;

FIG. 126 is a right side view of the cam means of the second embodiment of the latch of the present invention;

FIG. 127 is a sectional view along line H-H of FIG. 126;

FIG. 128 is a perspective view of the interior facing side of the cam means of the second embodiment of the latch of the present invention;

FIG. 129 is a perspective view of the exterior facing side of the cam means of the second embodiment of the latch of the present invention;

DETAILED DESCRIPTION OF THE INVENTION

Referring to FIGS. 1-46, a latch 100 in accordance with a first embodiment of the present invention can be seen. The latch 100 includes a housing 102, a latching means 104, a locking member or bolt 106, and means for selectively moving the bolt in and out of engagement with a striker surface.

The latch 100 is generally applicable wherever one or more closure members need to be secured in a certain position such as for a vehicle entry door. In addition, the latch 100 may be mounted in any orientation depending upon the particular application.

Figure 1:
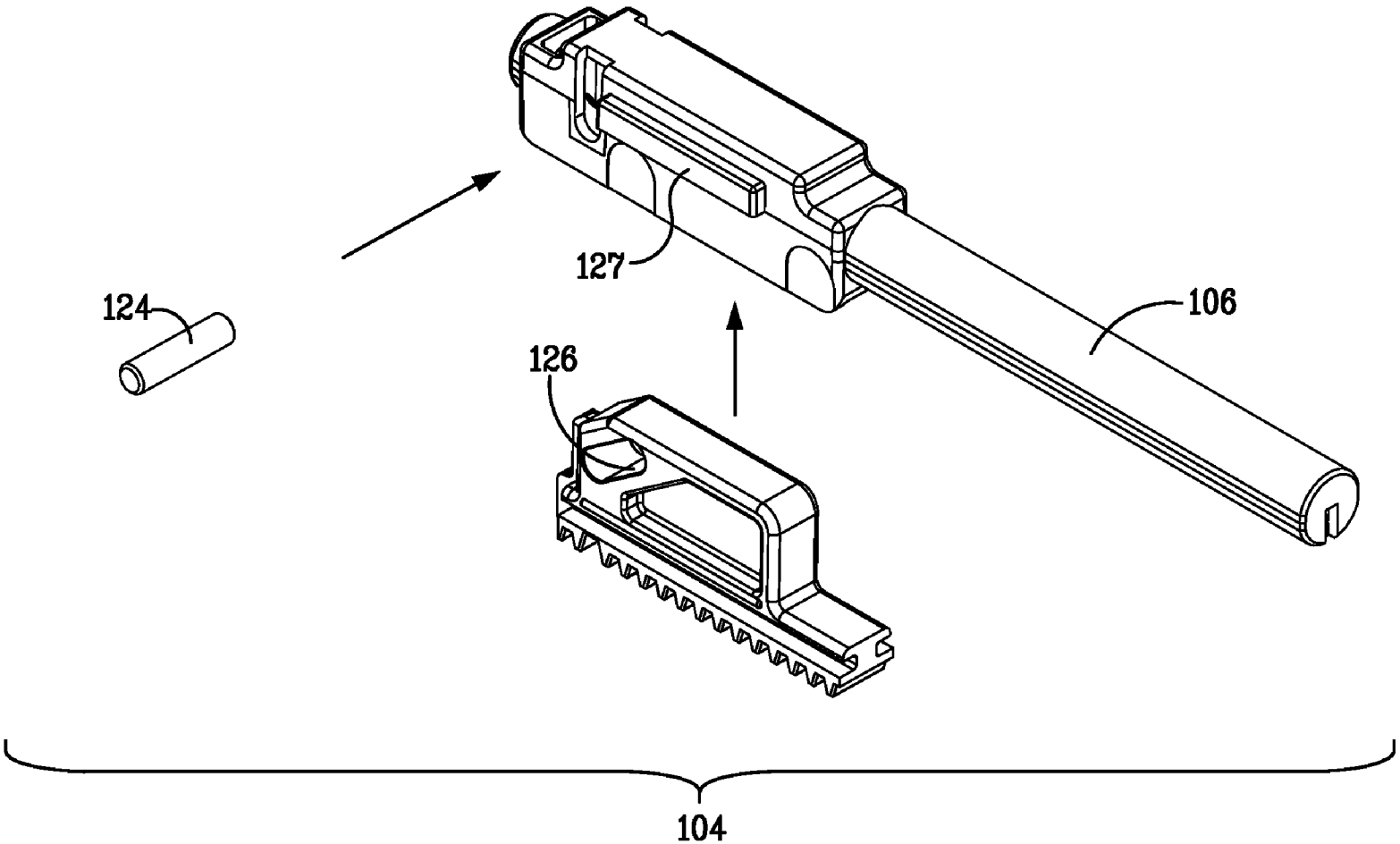
FIG. 1 shows an exploded view of a latching means according to the present invention.
Figure 3:
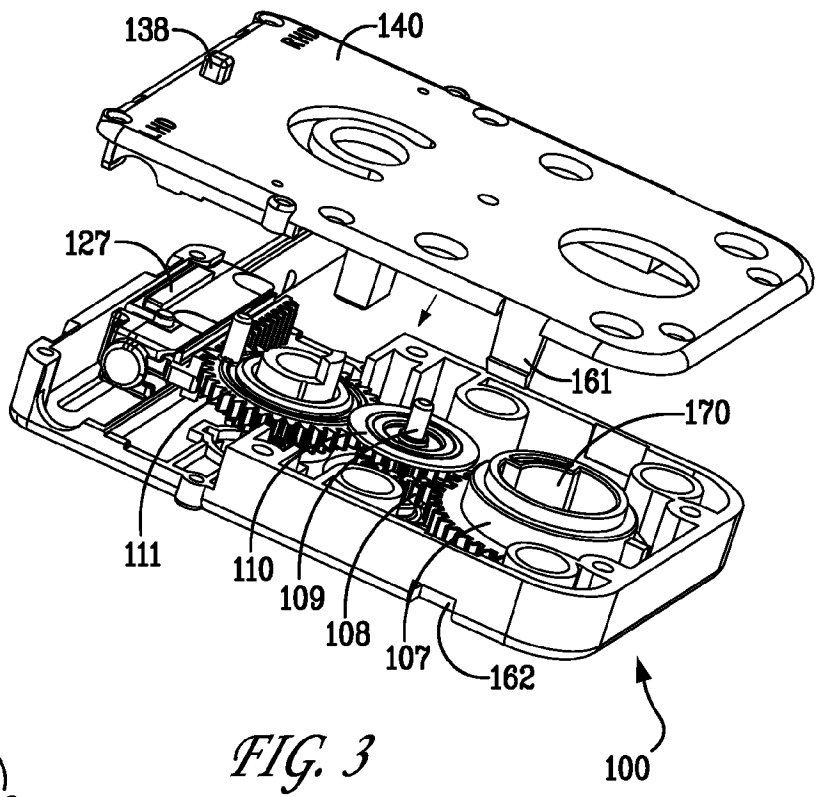
FIG. 3 shows the first embodiment of the latch according to the present invention without a cam means with the cover being placed on the housing.
Figure 2:
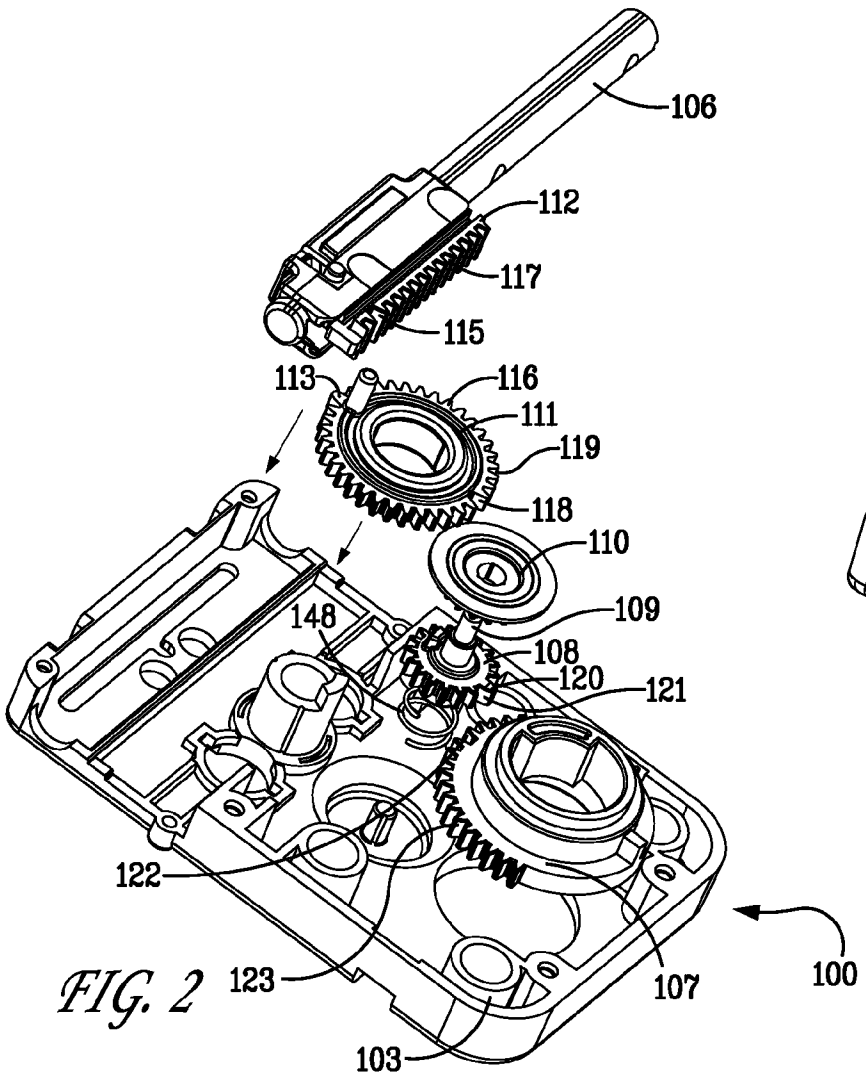
FIG. 2 shows an exploded view of a first embodiment of the latch according to the present invention without a cover and without a cam means.
Figure 4:
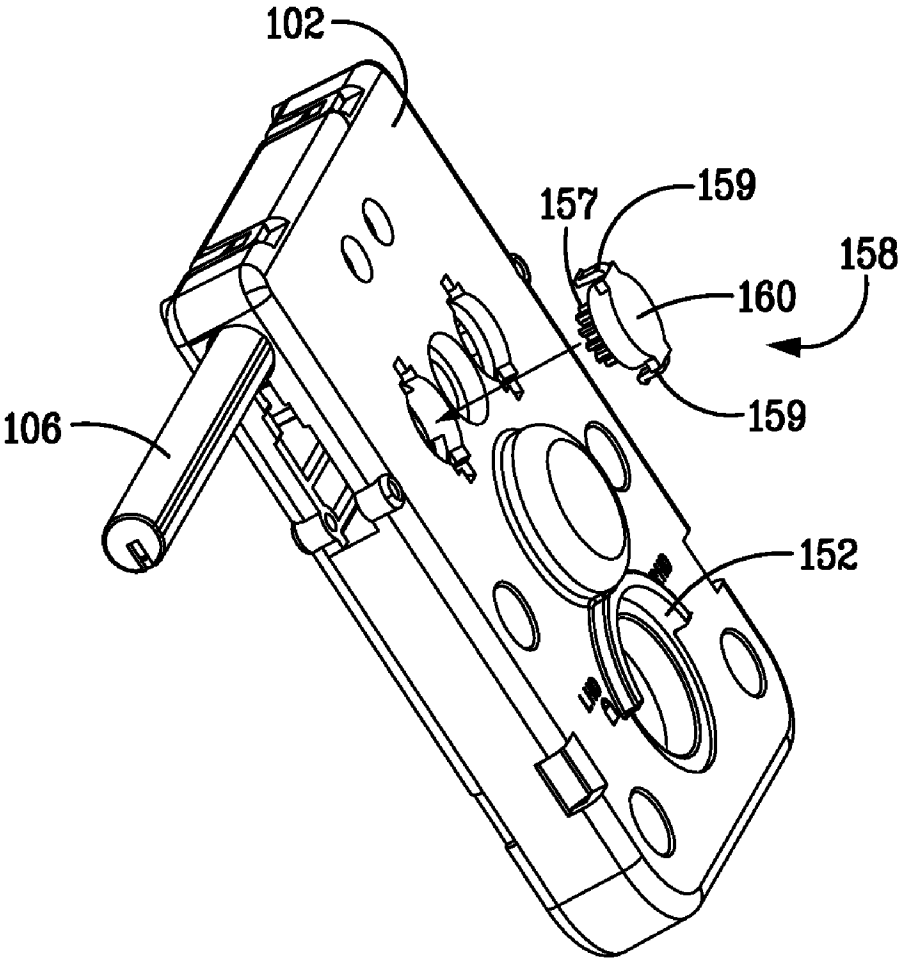
FIG. 4 shows an exploded view of the first embodiment of the latch according to the present invention without a cam means having an oil damper.

In the latched position as seen in FIGS. 2 and 3, a drive gear 107 which is configured and dimensioned to receive a lock-plug engages with drop gear 108. Drop gear 108 has a drop gear axis 109 around which idler gear 110 rotates. Also shown is top gear 111 which engages rack 112 of latching means 104 such that the latching means 104 can selectively be moved from the latched position shown in FIGS. 6, 7 and 8 at which the latched means or bolt 106 is prevented from moving any farther due to contact of the latching means 104 with the housing 102 to the unlatched position shown in FIGS. 9 and 10 by rotation of drive gear 107.

As seen in FIG. 2, top gear 111 has an enlarged top gear tooth 113 which is larger than the other top gear teeth 116 on top gear 111 and is configured and dimensioned to engage an enlarged rack aperture 115 on rack 112. Enlarged rack aperture 115 is larger than standard rack apertures 117 on rack 112. Top gear 111 has an enlarged top gear aperture 118 which is larger than standard top gear apertures 119. Drop gear 108 has an enlarged drop gear tooth 120 which is larger than standard drop gear teeth 121 which is dimensioned and configured to engage enlarged drive gear aperture 122 which is larger than standard drive gear apertures 123.

Figure 35:
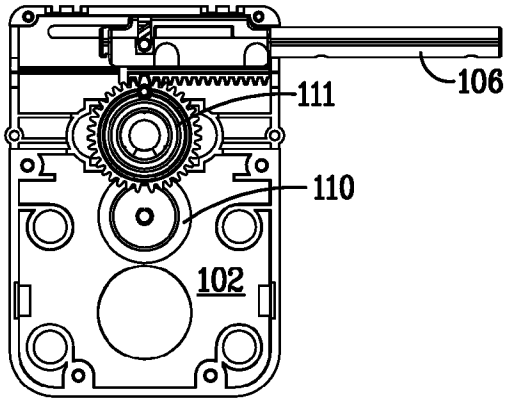
FIG. 35 shows the interior facing side of the first embodiment of the latch according to the present invention wherein a pin of the latching means is in a slot in the rack when the latch is in the latched position.
Figure 36:
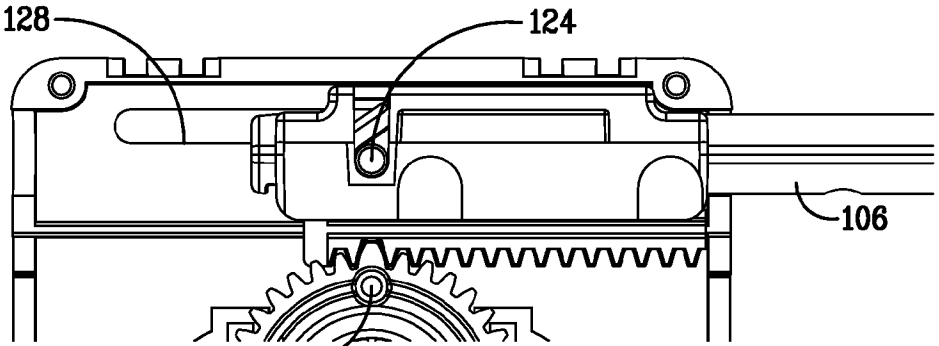
FIG. 36 shows a partial view of the latch of FIG. 35 showing the pin in the slot of the rack.
Figure 37:
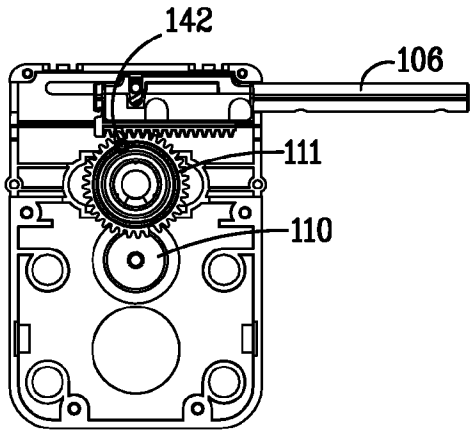
FIG. 37 shows the interior facing side of the first embodiment of the latch according to the present invention wherein a pin of the latching means is moved in a slot in the rack and a channel in the housing when the latch is in the latched position.
Figure 38:
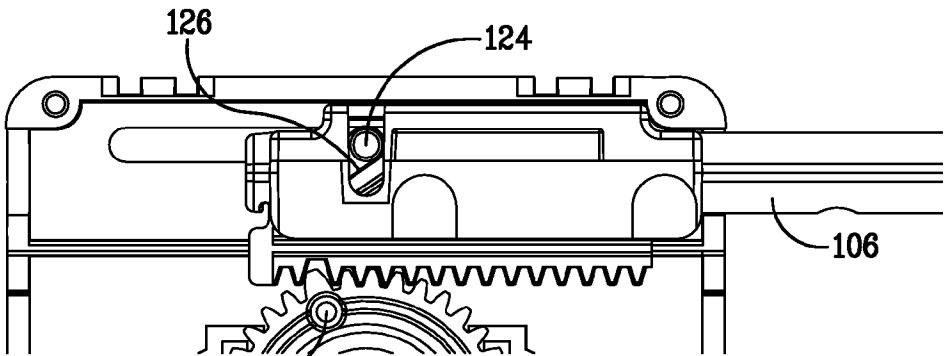
FIG. 38 shows a partial view of the latch of FIG. 37 showing the pin in the slot of the rack.
Figure 75:
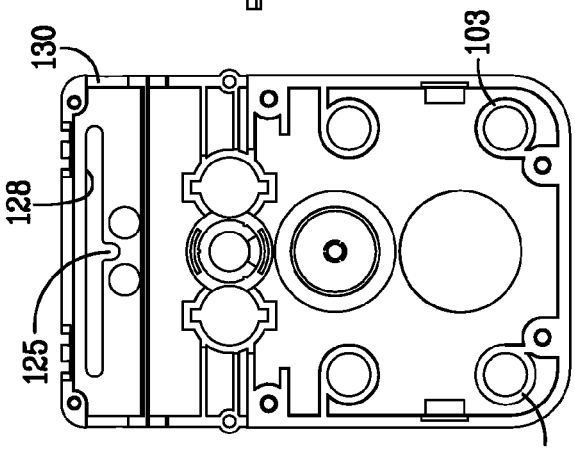
FIG. 75 is a view of the interior facing side of the housing of the latch of the present invention.
Figure 77:
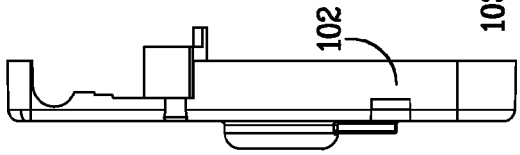
FIG. 77 is a left side view of the housing of the latch of the present invention.
Figure 79:
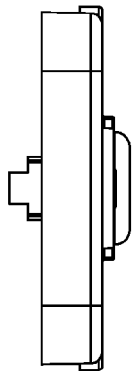
FIG. 79 is a bottom view of the housing of the latch of the present invention.
Figure 82:
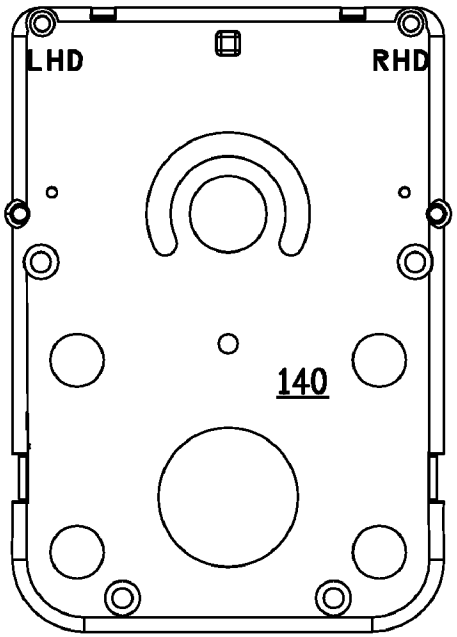
FIG. 82 is a view of the exterior facing side of the cover of the latch of the present invention.
Figure 81:
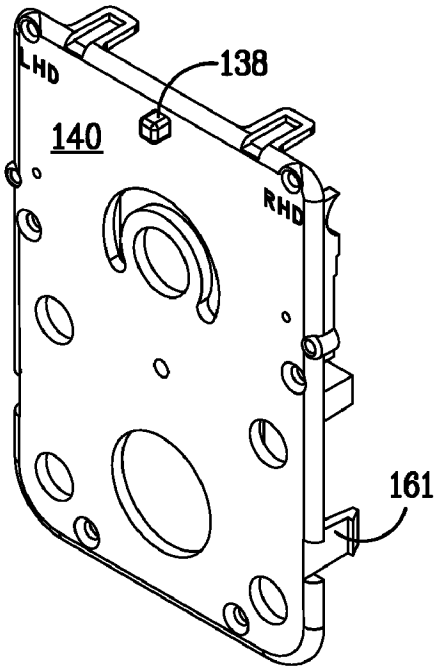
FIG. 81 is a perspective view of the exterior facing side of the cover of the latch of the present invention.
Figure 80:
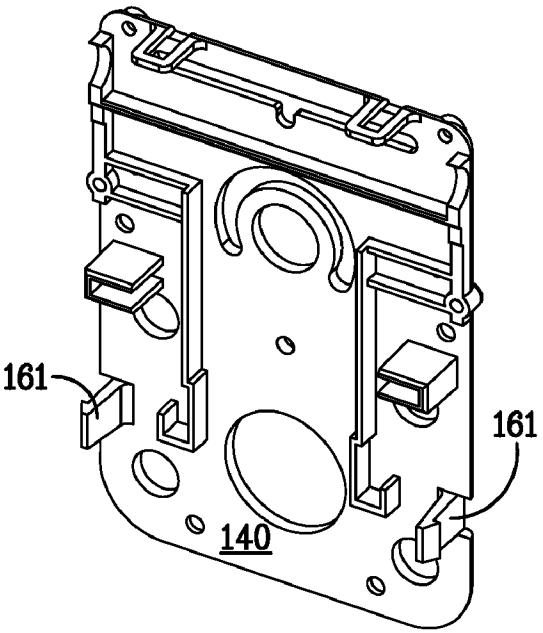
FIG. 80 is a perspective view of the interior facing side of the cover of the latch of the present invention.
Figure 85:
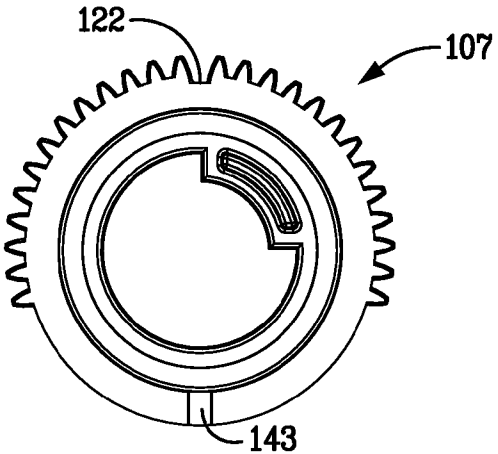
FIG. 85 is a view of the exterior facing side of the drive gear of the latch of the present invention.
Figure 88:
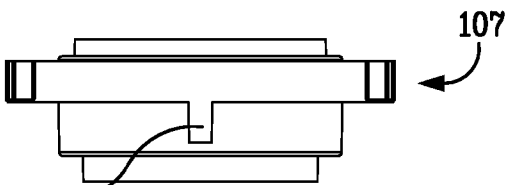
FIG. 88 is a bottom view of the drive gear of the latch of the present invention.
Figure 84:
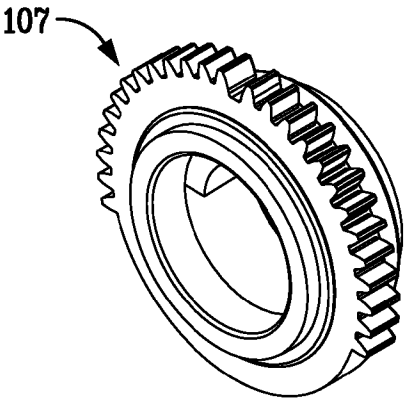
FIG. 84 is a perspective view of the interior facing side of the drive gear of the latch of the present invention.
Figure 87:
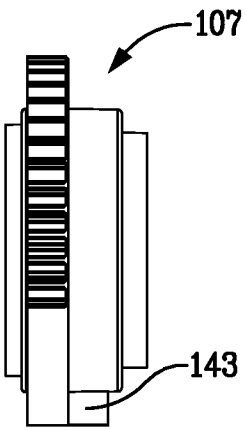
FIG. 87 is a side view of the drive gear of the latch of the present invention.
Figure 83:
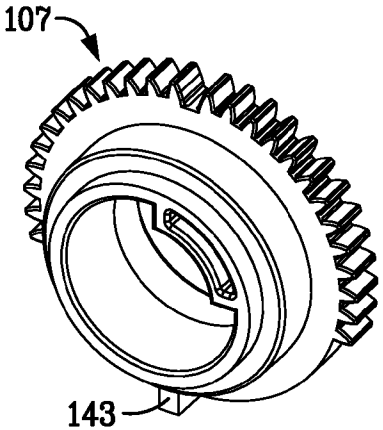
FIG. 83 is a perspective view of the exterior facing side of drive gear of the latch of the present invention.
Figure 86:
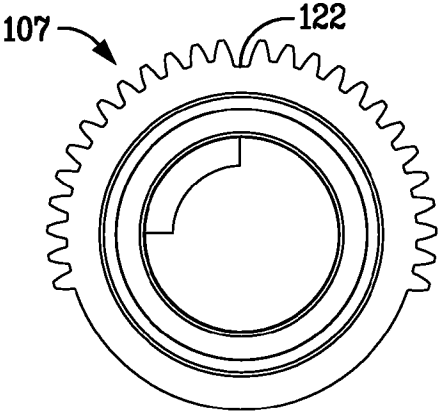
FIG. 86 is a view of the interior facing side of the drive gear of the latch of the present invention.
Figure 91:
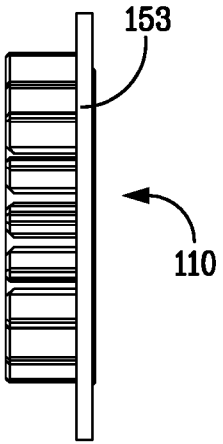
FIG. 91 is a side view of the idler gear of the latch of the present invention.
Figure 90:
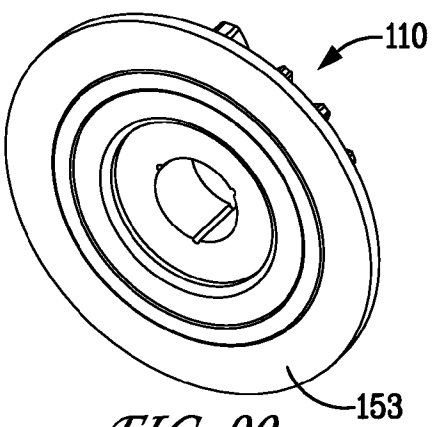
FIG. 90 is a perspective view of the interior facing side of the idler gear of the latch of the present invention.
Figure 89:
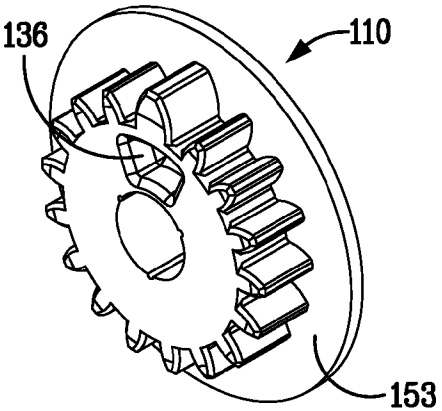
FIG. 89 is a perspective view of the exterior facing side of idler gear of the latch of the present invention.
Figure 94:
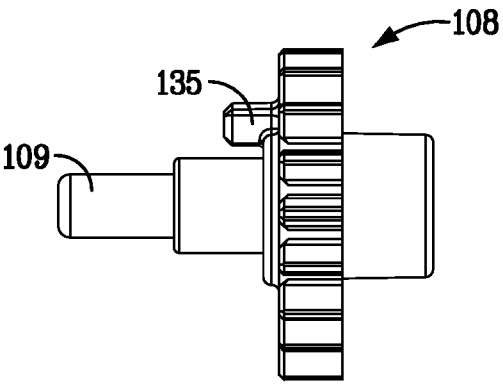
FIG. 94 is a side view of the drop gear of the latch of the present invention.
Figure 93:
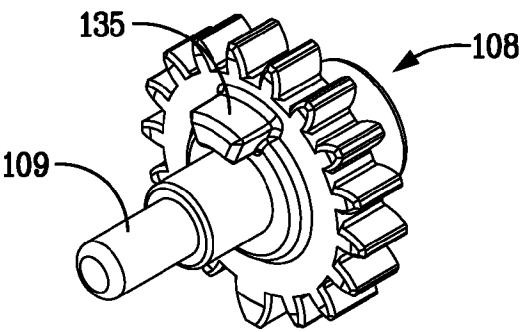
FIG. 93 is a perspective view of the interior facing side of the drop gear of the latch of the present invention.
Figure 92:
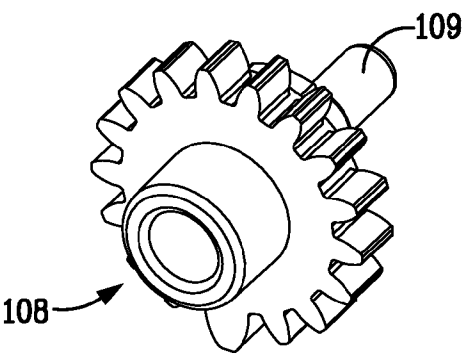
FIG. 92 is a perspective view of the exterior facing side of the drop gear of the latch of the present invention.
Figure 97:
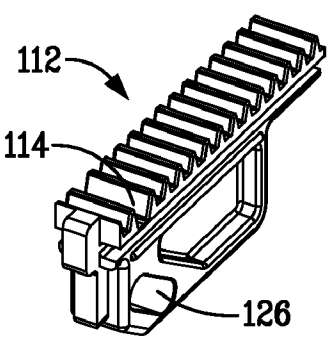
FIG. 97 is a perspective view of the bottom side of the rack of the latch of the present invention.
Figure 96:
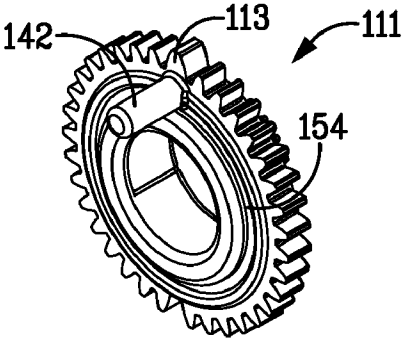
FIG. 96 is a perspective view of the interior facing side of the top gear of the latch of the present invention.
Figure 95:
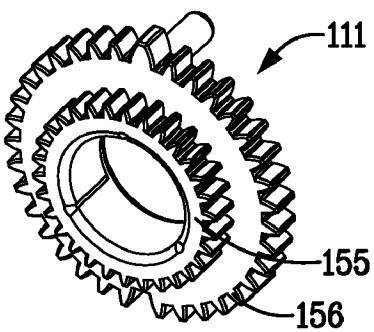
FIG. 95 is a perspective view of the exterior facing side of the top gear of the latch of the present invention.
Figure 101:
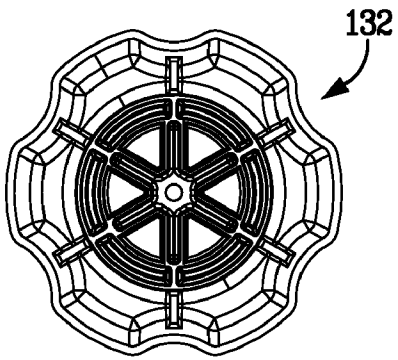
FIG. 101 is a side view of the turnhandle of the latch of the present invention.

In the latched position as seen in FIGS. 35 and 36, rack pin 124 sets in blocking means here notch 125 as seen in FIG. 75. The latching means 104 is not capable of moving to the unlatched position until a releasing means, here a rack surface 126 which is inclined on the rack 112 moves rack pin 124 out of engagement with notch 125 as seen in FIGS. 37 and 38 when top gear 111 moves the rack 112 relative to the bolt 106. Rack 112 and bolt 106 can then move to the unlatched position. This feature prevents the undesired movement of the bolt 106 from latched position to unlatched position by perhaps a vandal outside of the vehicle in the latch 100 is installed such that only an authorized user having a tool or key to operate the lockplug can unlatch the latch 100.

Figure 7:
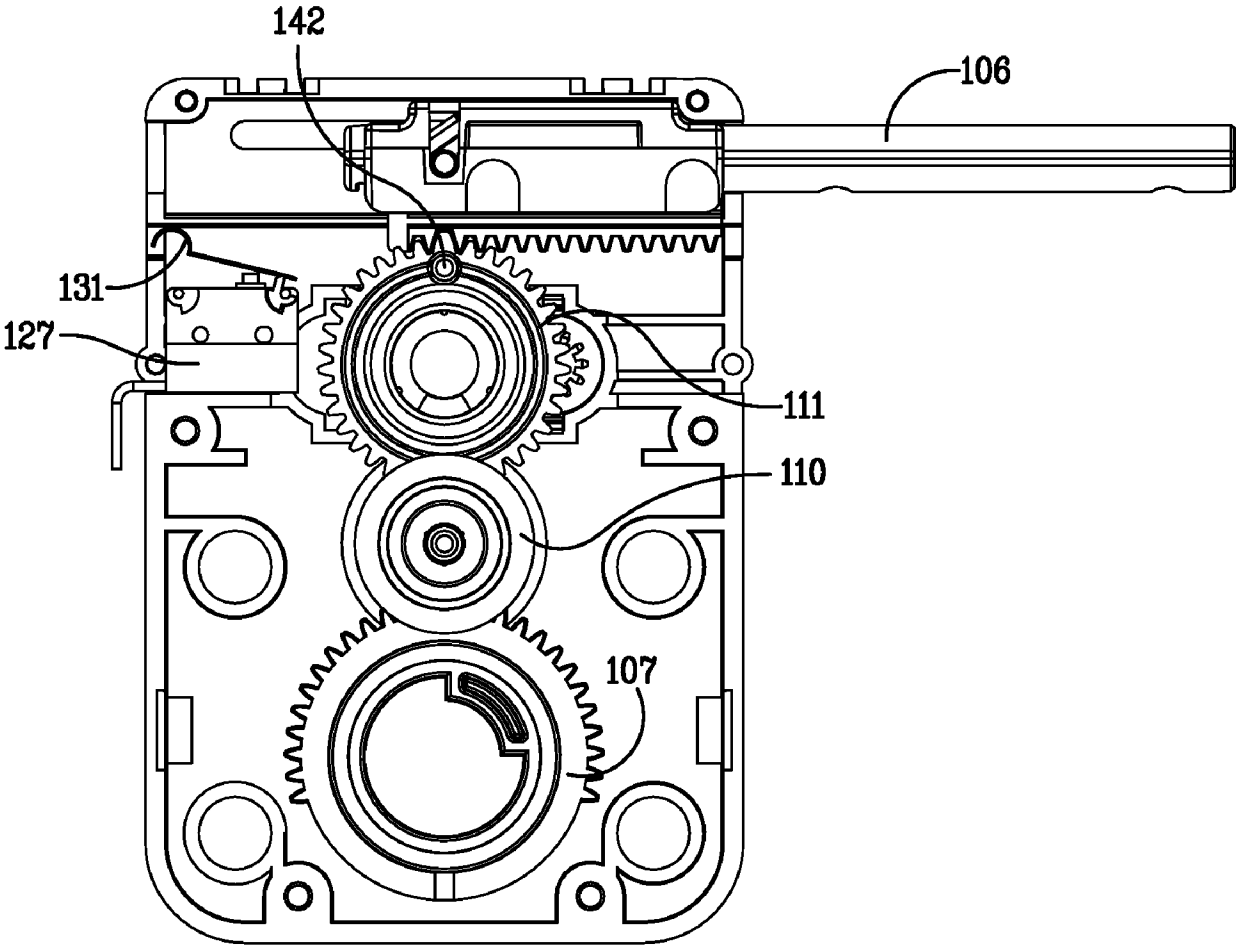
FIG. 7 shows the interior facing side of the first embodiment of the latch according to the present invention with the cover removed and the latching means in the latched position.
Figure 10:
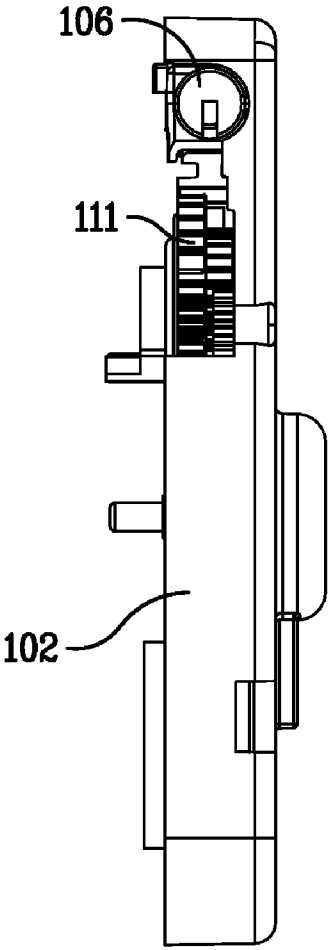
FIG. 10 shows a right side view of the first embodiment of the latch according to the present invention with the cover removed.

When the bolt 106 moves relative to the housing 102 guide means here a bolt rib 127 on the bolt 106 moves in groove 128 to the end of groove 128 in the housing as seen in FIG. 36. If microswitch 129 is provided on the latch as seen in FIG. 7 then the microswitch 129 is in the open position when the latch 100 is latched thus alerting the driver of the vehicle in which the latch 100 is installed that bolt 106 has not been unlatched and the door or member in which the latch 100 is installed is still locked.

Figure 9:
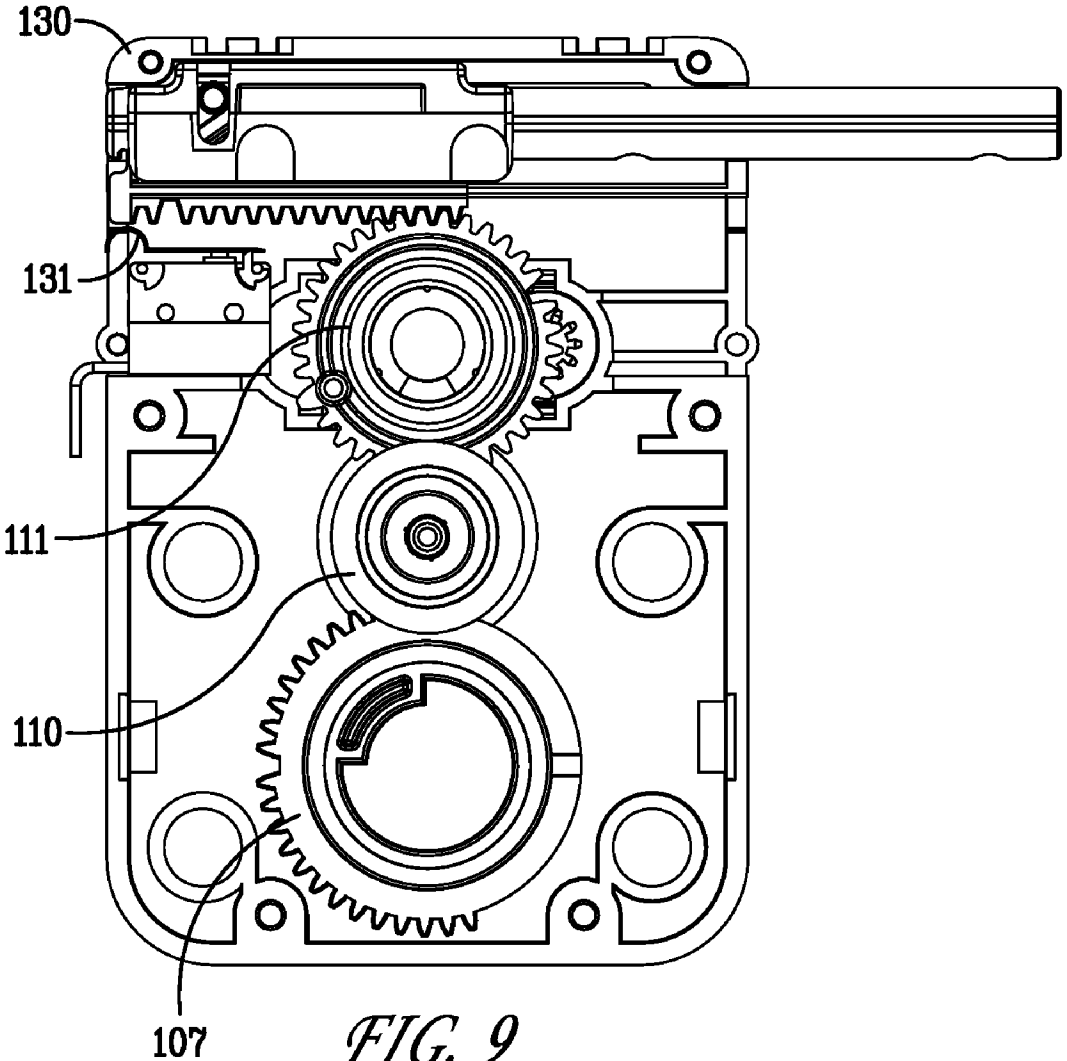
FIG. 9 shows the interior facing side of the first embodiment of the latch according to the present invention with the cover removed and the latching means in the unlatched position.
Figure 13:
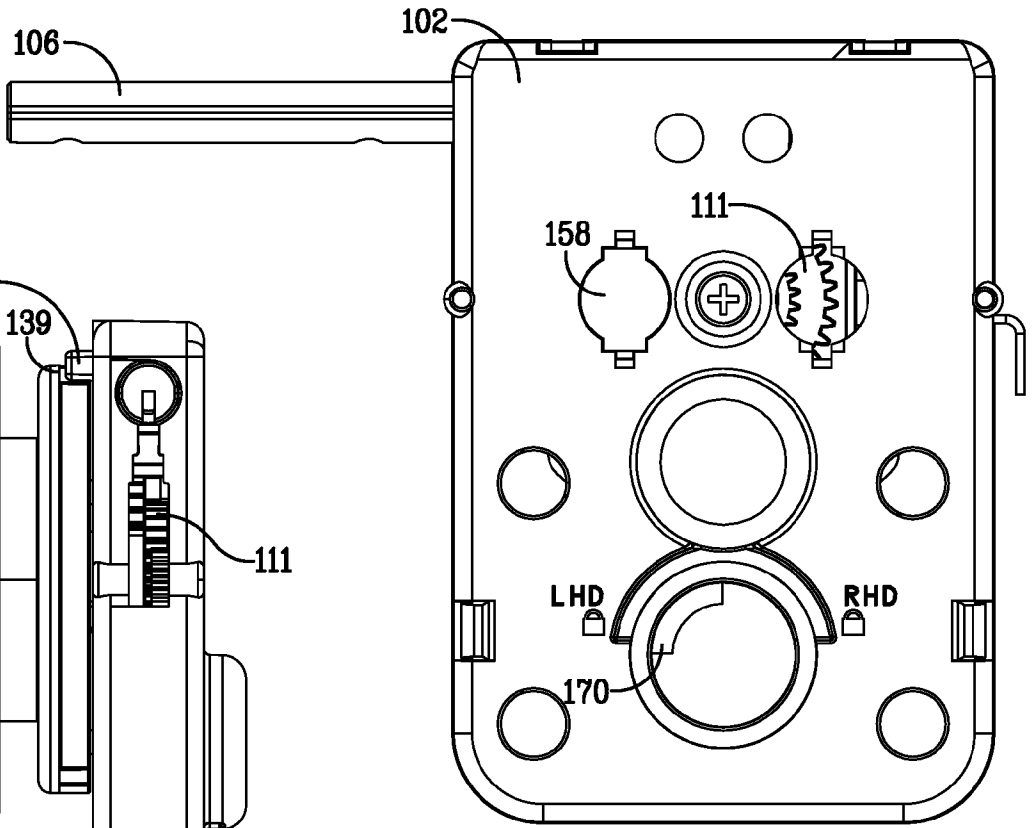
FIG. 13 shows the exterior facing side of the first embodiment of the latch according to the present invention and the latching means in the latched position.
Figure 12:
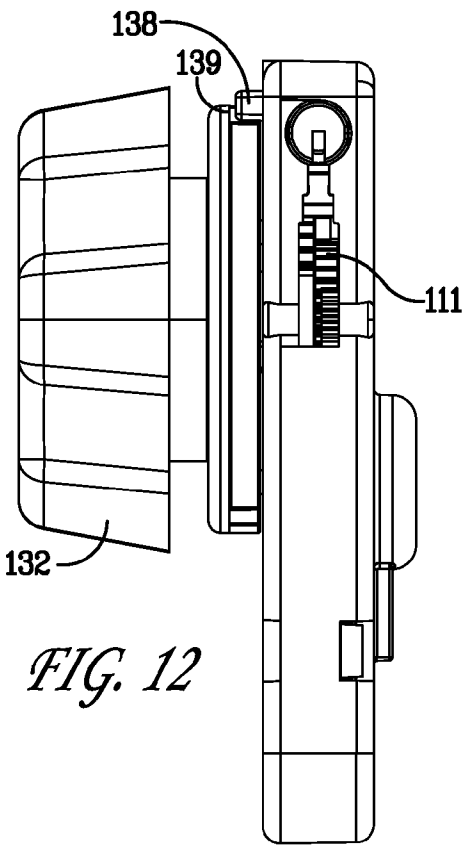
FIG. 12 shows a right side view of the first embodiment of the latch according to the present invention having a turnhandle.
Figure 11:
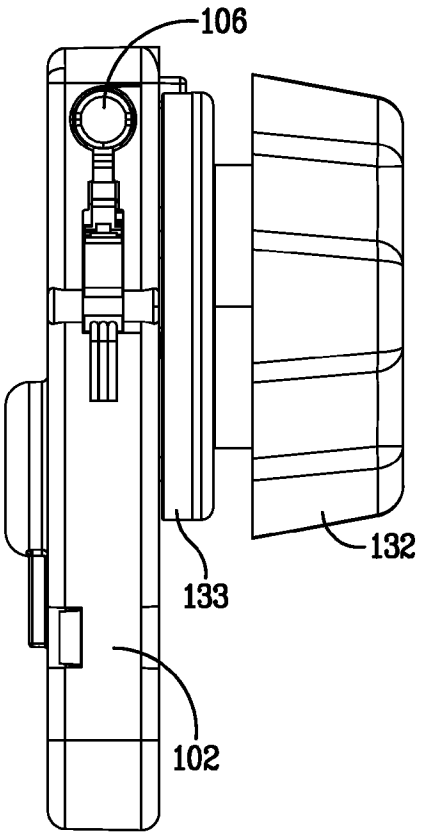
FIG. 11 shows a left side view of the first embodiment of the latch according to the present invention having a turnhandle.
Figure 15:
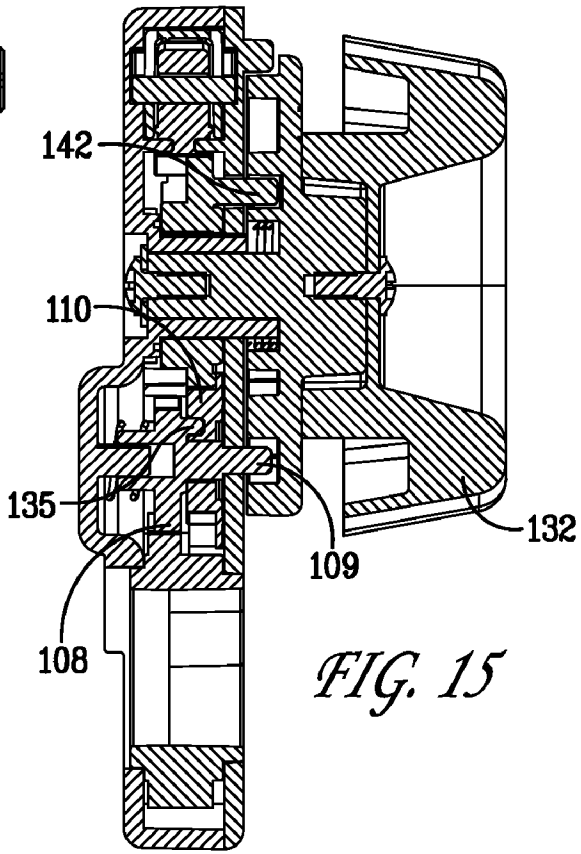
FIG. 15 shows a sectional view along line A-A of FIG. 14.
Figure 14:
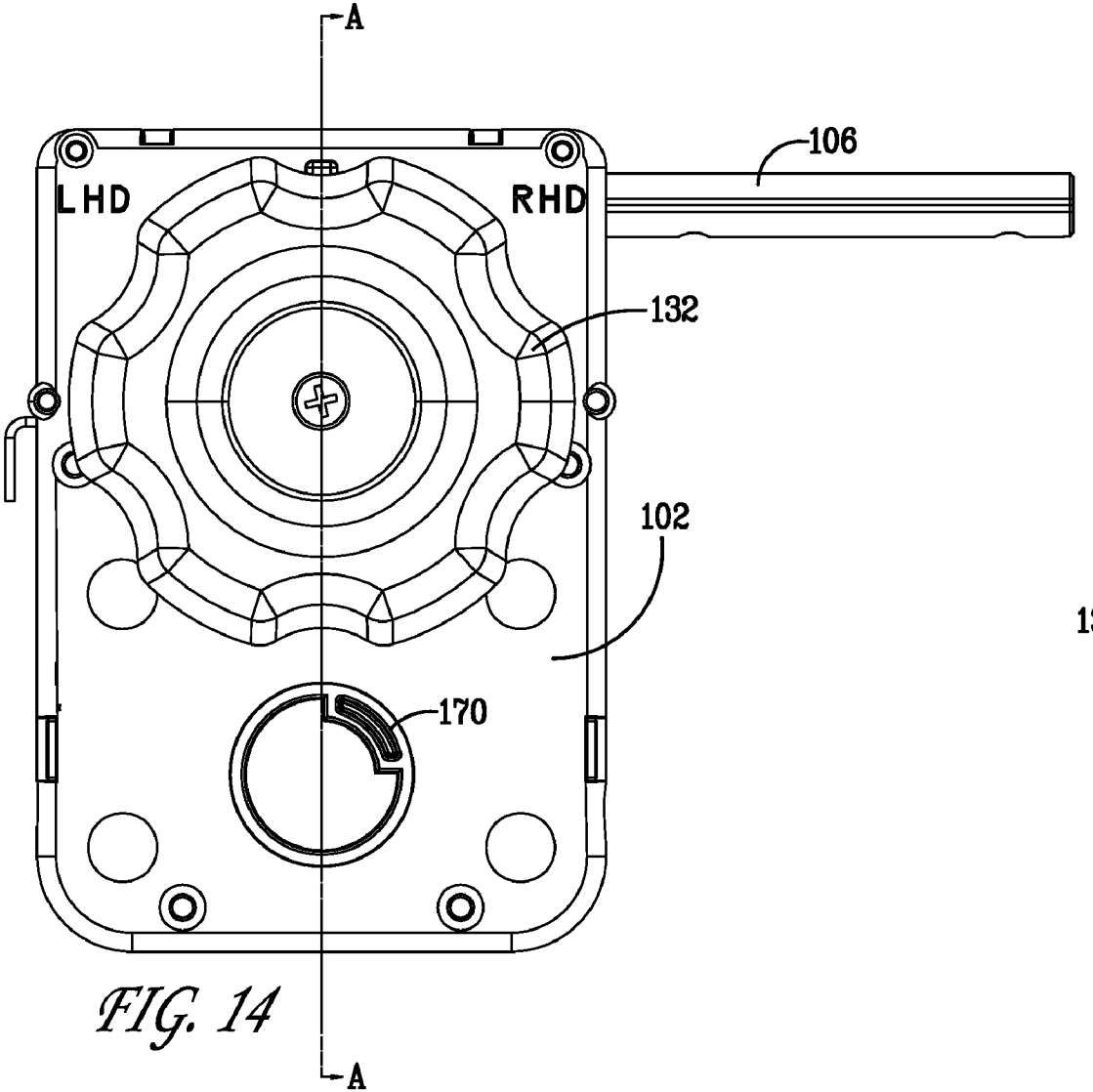
FIG. 14 shows the interior facing side of the first embodiment of the latch according to the present invention and the latching means in the latched position.
Figure 17:
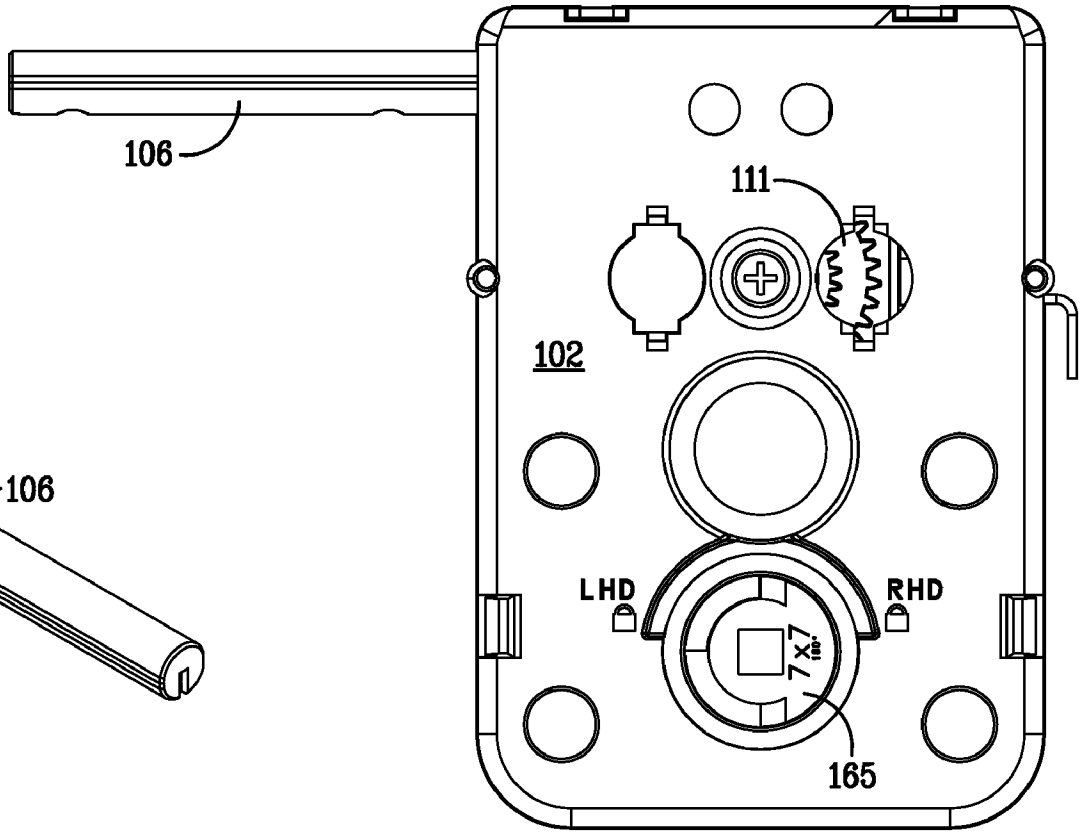
FIG. 17 shows the exterior facing side of the first embodiment of the latch according to the present invention and a first type of adaptor for a lock plug and the latching means in the latched position.
Figure 16:
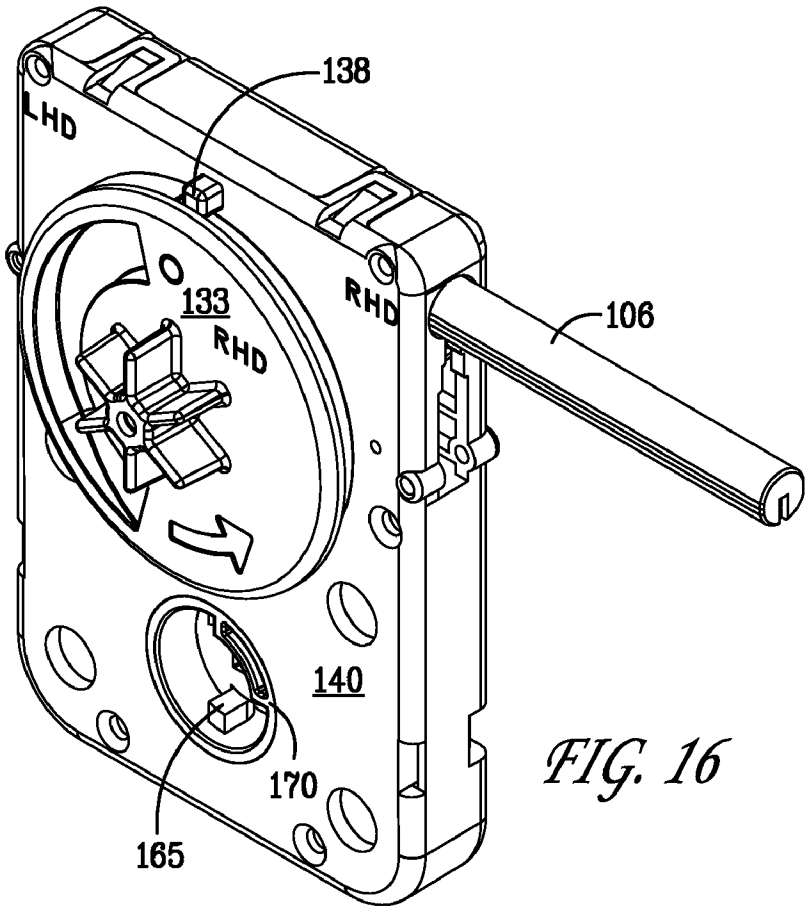
FIG. 16 shows a perspective view of the interior facing side of the first embodiment of the latch according to the present invention and a first type of adaptor for a lock plug and the latching means in the latched position.
Figure 19:
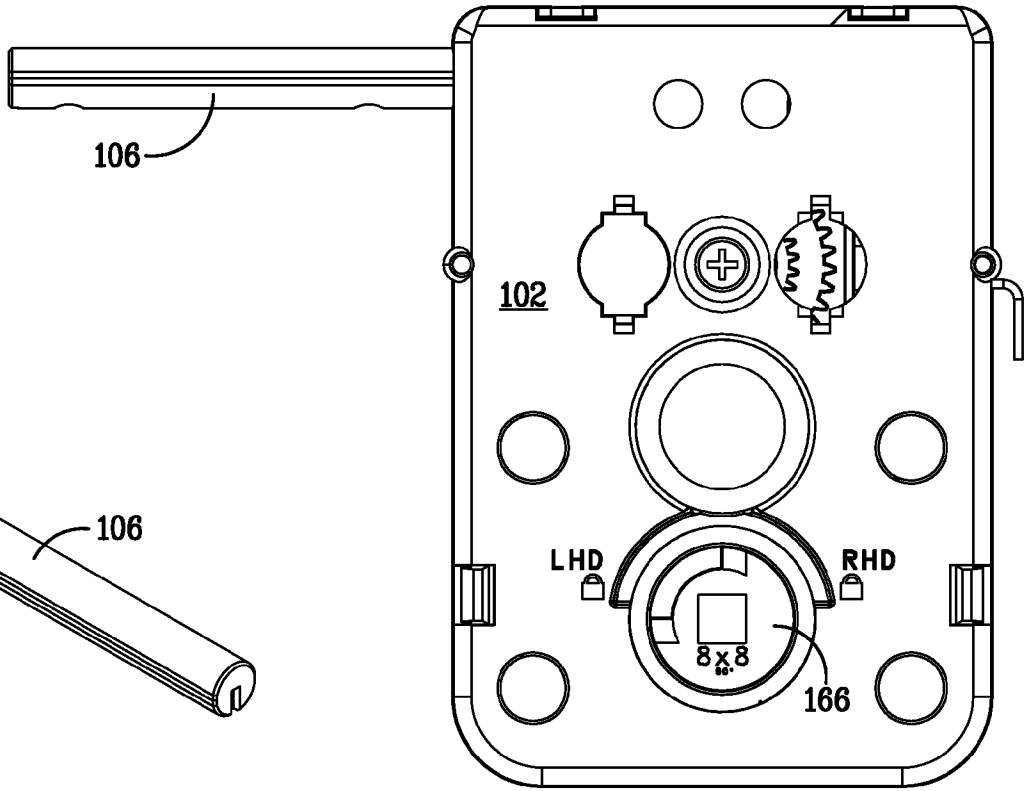
FIG. 19 shows the exterior facing side of the first embodiment of the latch according to the present invention and a second type of adaptor for a lock plug and the latching means in the latched position.
Figure 18:
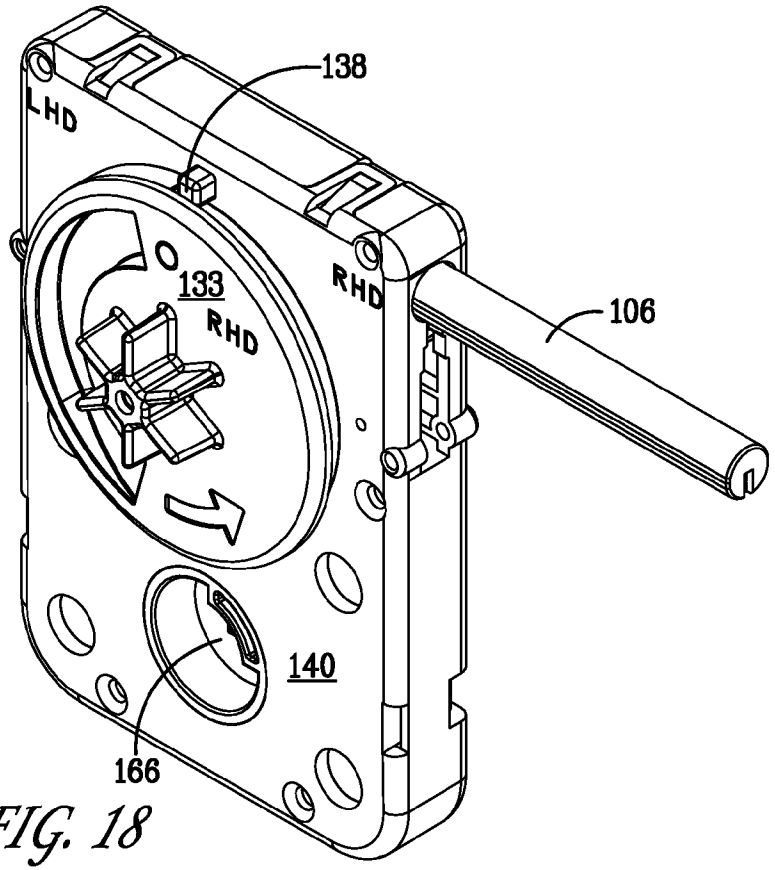
FIG. 18 shows a perspective view of the interior facing side of the first embodiment of the latch according to the present invention and a second type of adaptor for a lock plug and the latching means in the latched position.
Figure 21:
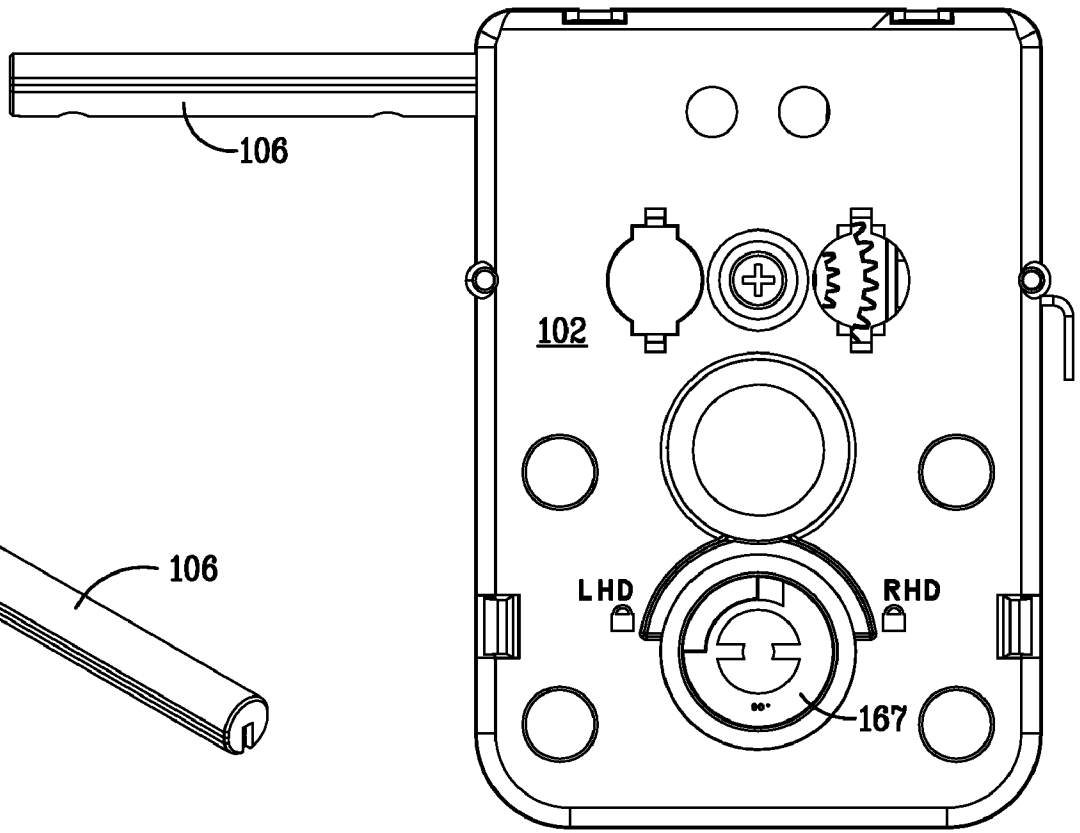
FIG. 21 shows the exterior facing side of the first embodiment of the latch according to the present invention and a third type of adaptor for a lock plug and the latching means in the latched position.
Figure 20:
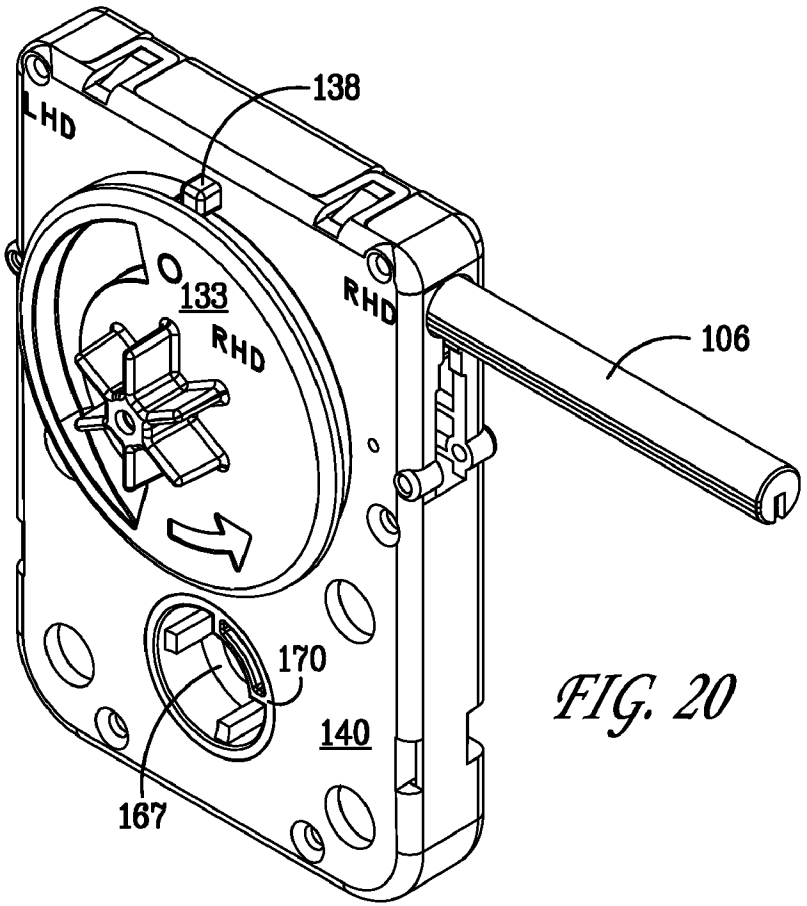
FIG. 20 shows a perspective view of the interior facing side of the first embodiment of the latch according to the present invention and a third type of adaptor for a lock plug and the latching means in the latched position.
Figure 34:
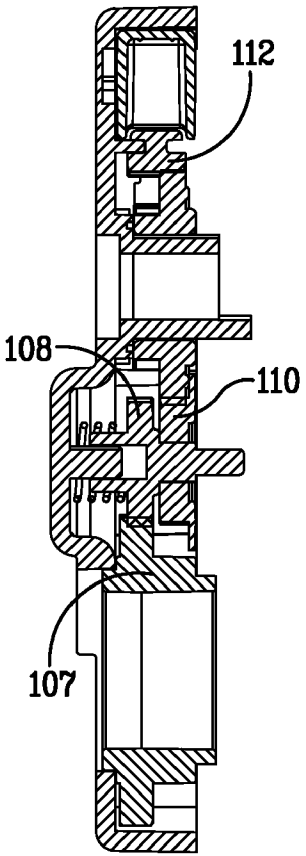
FIG. 34 shows a sectional view along line D-D of FIG. 34.
Figure 33:
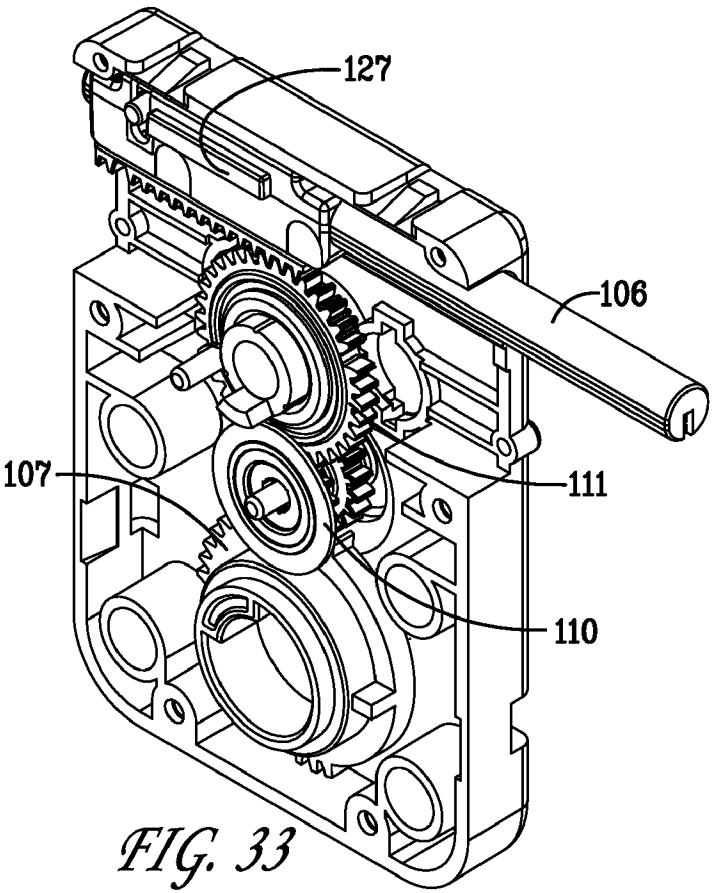
FIG. 33 shows a perspective view of the interior facing side of the first embodiment of the latch according to the present invention wherein the idler gear and drop gear are engaged.
Figure 32:
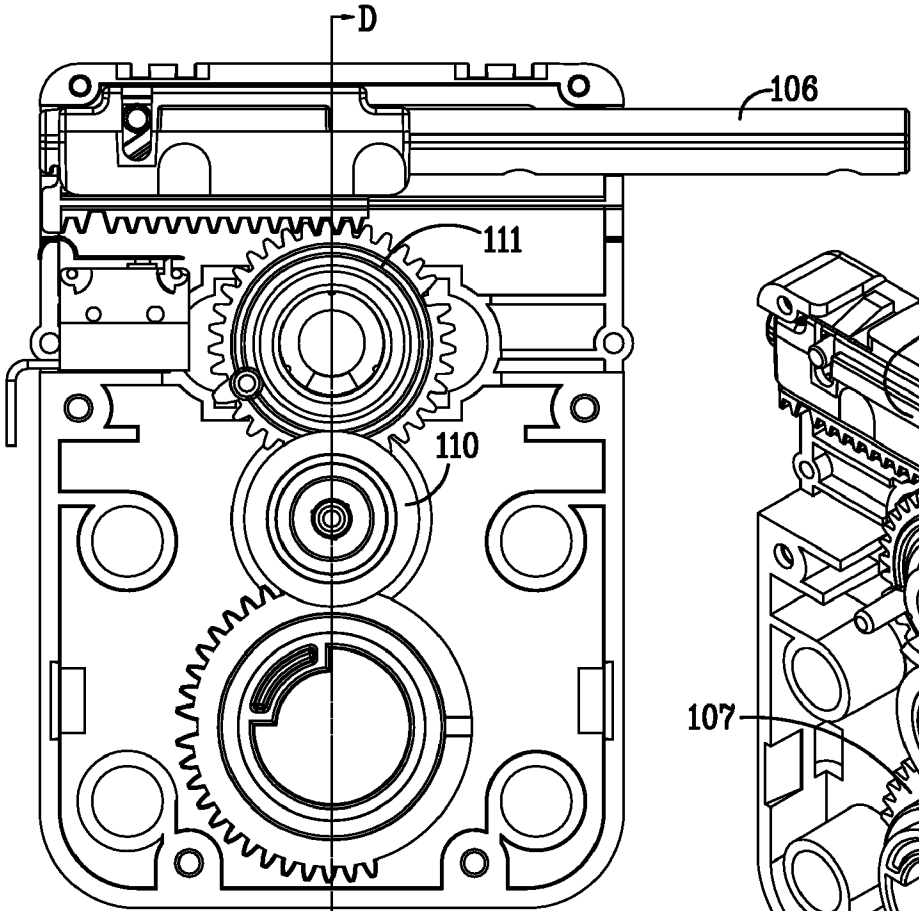
FIG. 32 shows the interior facing side of the first embodiment of the latch according to the present invention wherein the drive gear has rotated the drop gear which in turn has rotated the top gear to move the latching means to the unlatched position.

In the open or unlatched position as seen in FIG. 9 drive gear 107 has been rotated about 90 degrees by a user or a mechanical means in a counterclockwise direction from the latched position as seen from the interior of the vehicle in which the latch is installed. Also as seen in FIGS. 32-34, idler gear 110 and drop gear 108 are engaged and have rotate together about 230 degrees. Top gear 111 has rotated about 115 degrees counterclockwise as seen from the interior of the vehicle. When the rack 112 is latched as seen in FIGS. 35 and 36 and then rack 112 is retracted relative to bolt 106 to permit pin 124 to ride up rack surface 126, rack 112 can move about 6 mm as seen in FIGS. 37 and 38. Thereafter, when pin 124 is no longer engaged in notch 125 shown in FIG. 75, rack 112 can move 30 mm further together with the bolt 106 until bolt 106 contacts housing wall 130. If the microswitch 129 is present then lever arm 131 on microswitch 129 is depressed by retracted rack 112 which in turn actuates microswitch 129 which can alert the driver of the vehicle that the door or member in which latch 100 is installed is unlatched.

Figure 5:
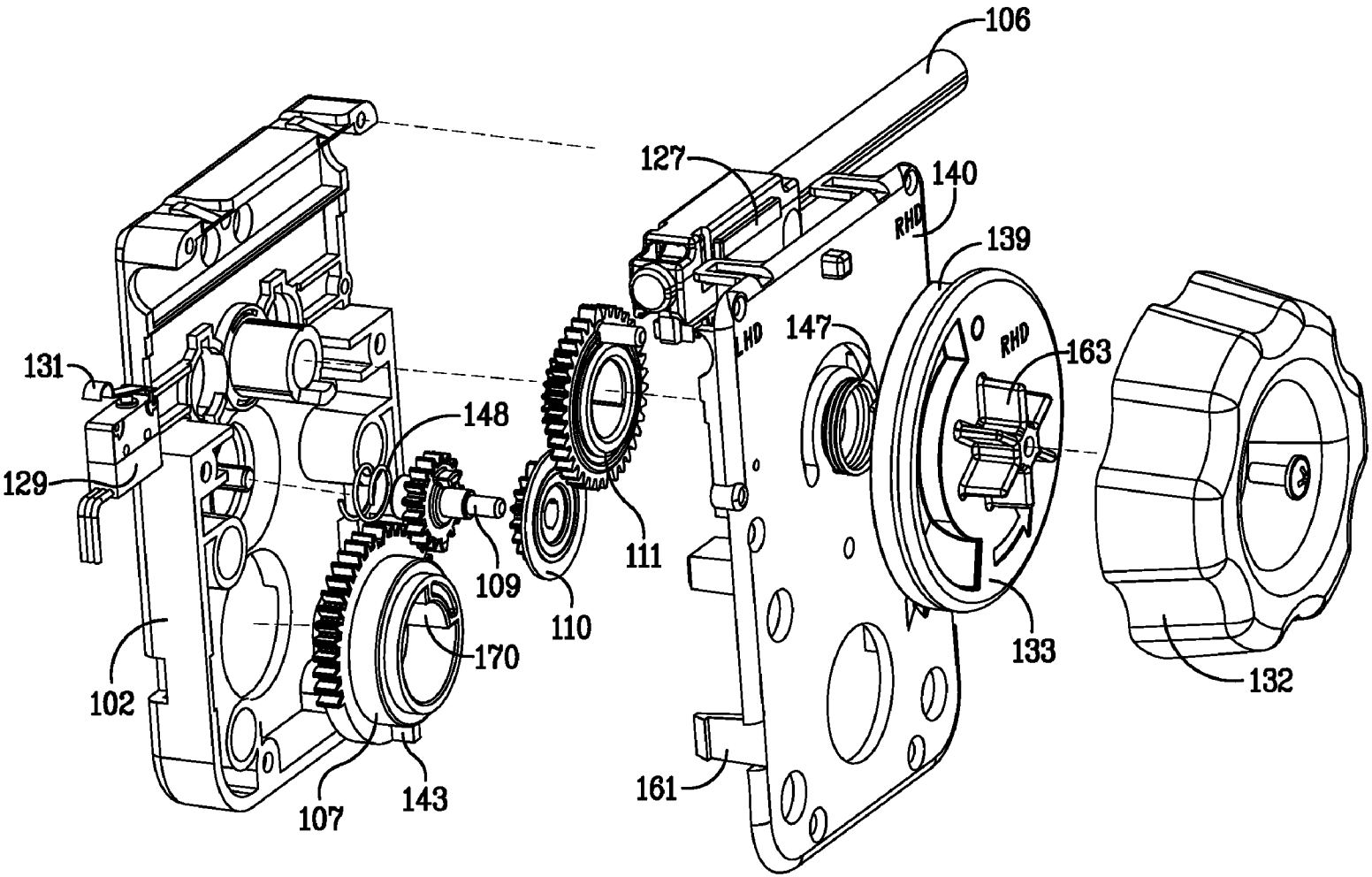
FIG. 5 shows an exploded view of the first embodiment of the latch according to the present invention having a turnhandle and a microswitch.
Figure 6:
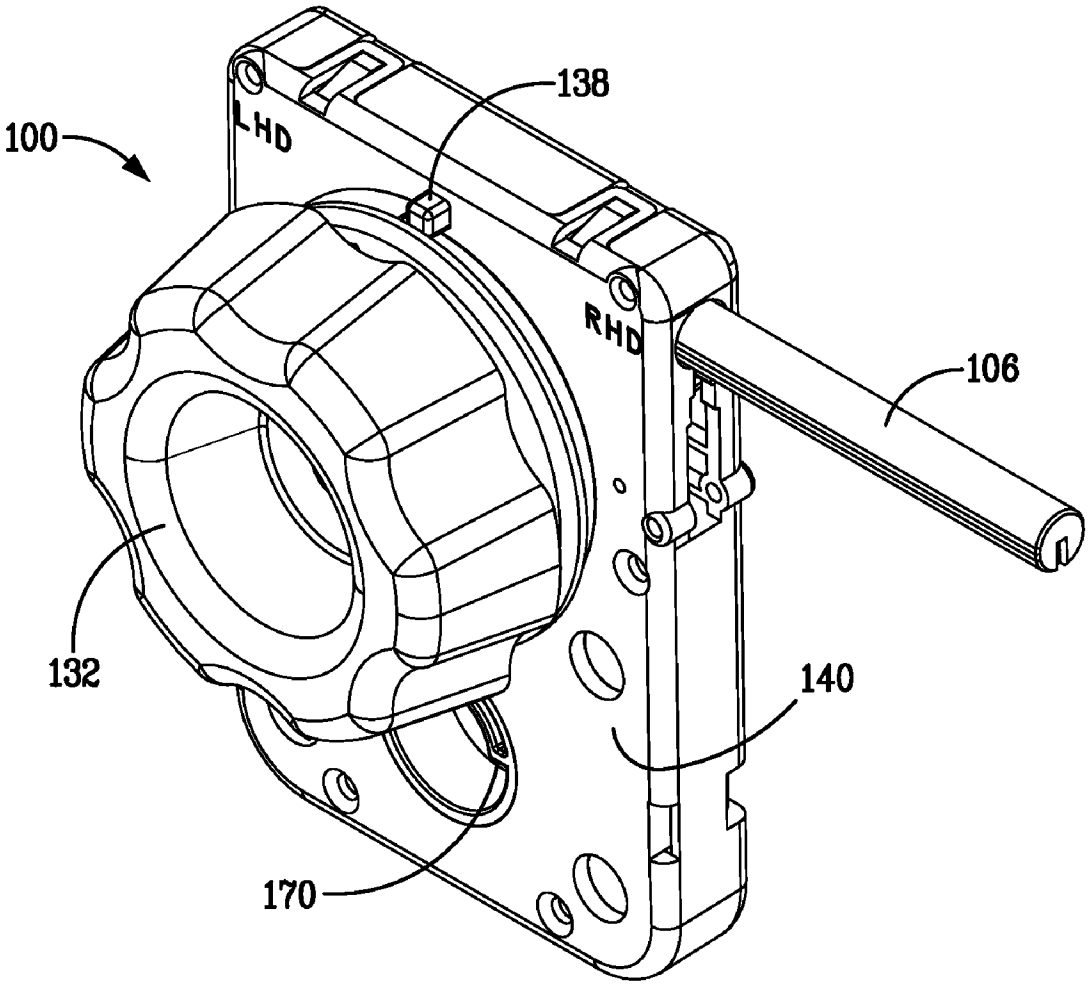
FIG. 6 shows a perspective view of the interior side of the first embodiment of the latch according to the present invention.
Figure 8:
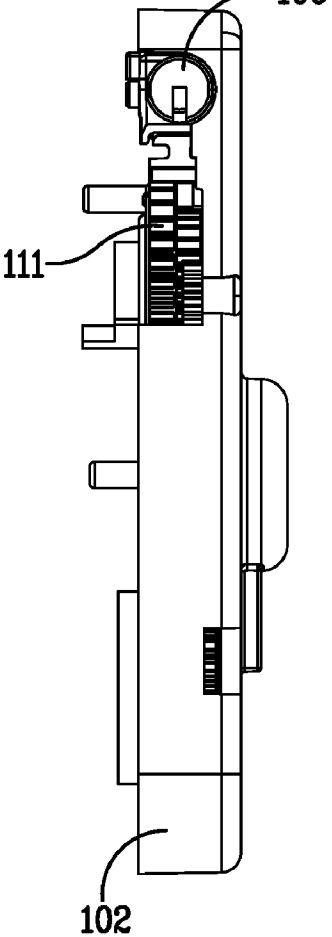
FIG. 8 shows a right side view of the first embodiment of the latch according to the present invention with the cover removed.
Figure 27:
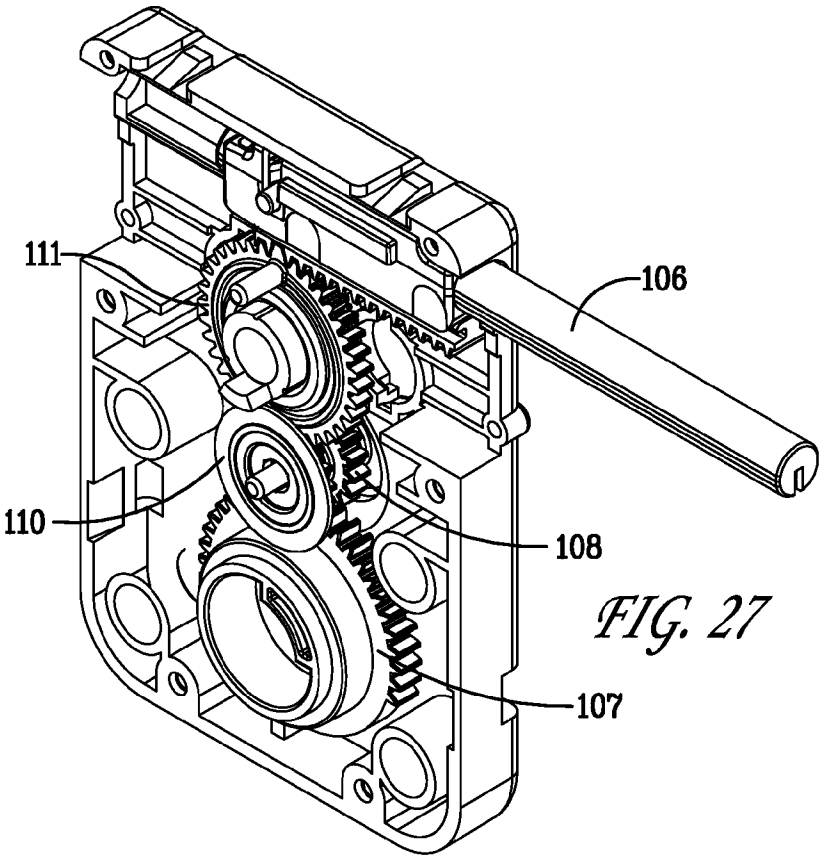
FIG. 27 shows a perspective view of the first embodiment of the latch according to the present invention without an adaptor and the latching means in the latched position and the drop gear and the idler gear disengaged.
Figure 26:
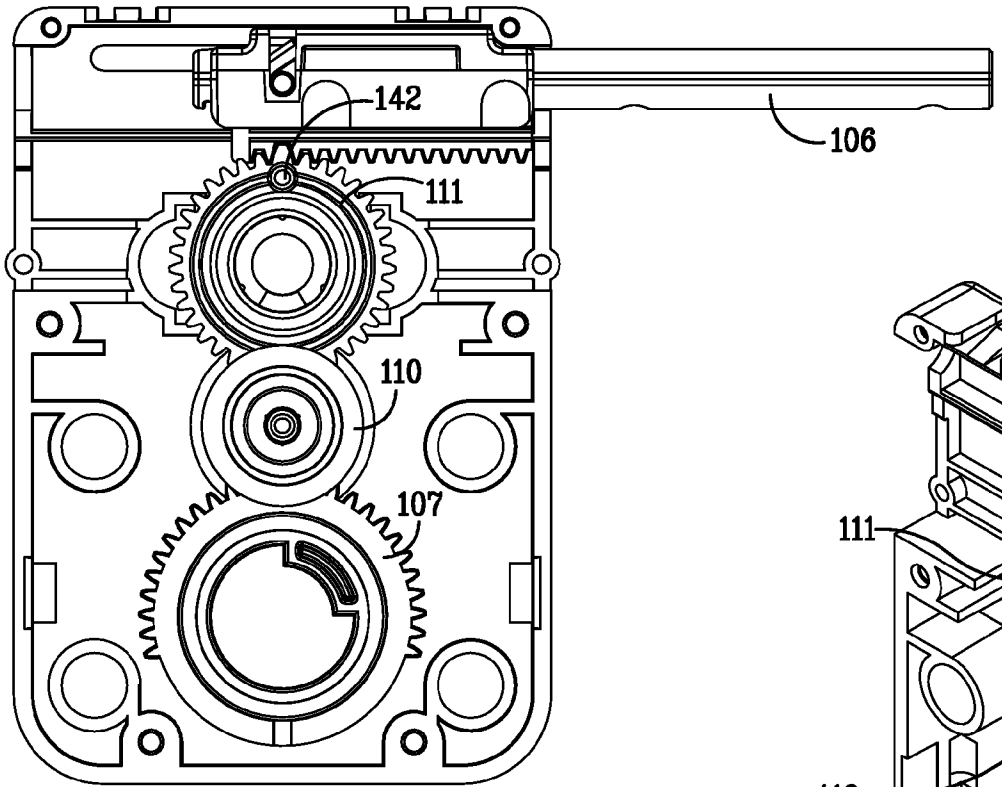
FIG. 26 shows the interior facing side of the first embodiment of the latch according to the present invention without an adaptor and cam means and the latching means in the latched position.
Figure 29:
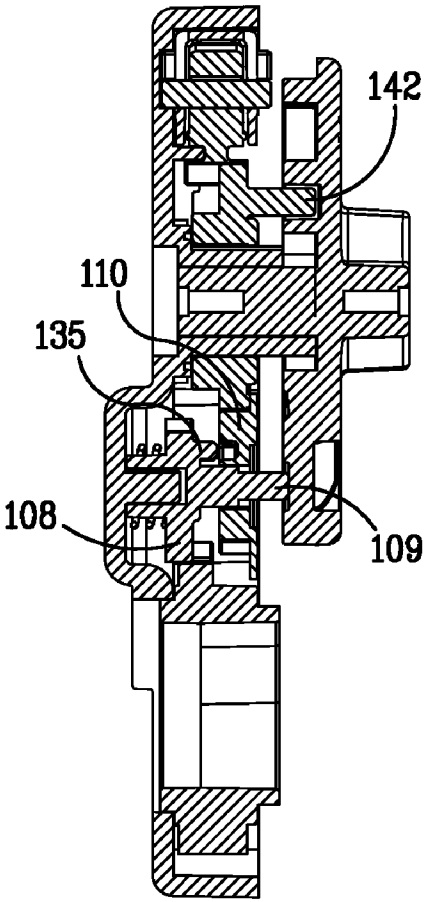
FIG. 29 shows a sectional view along line B-B of FIG. 28.
Figure 28:
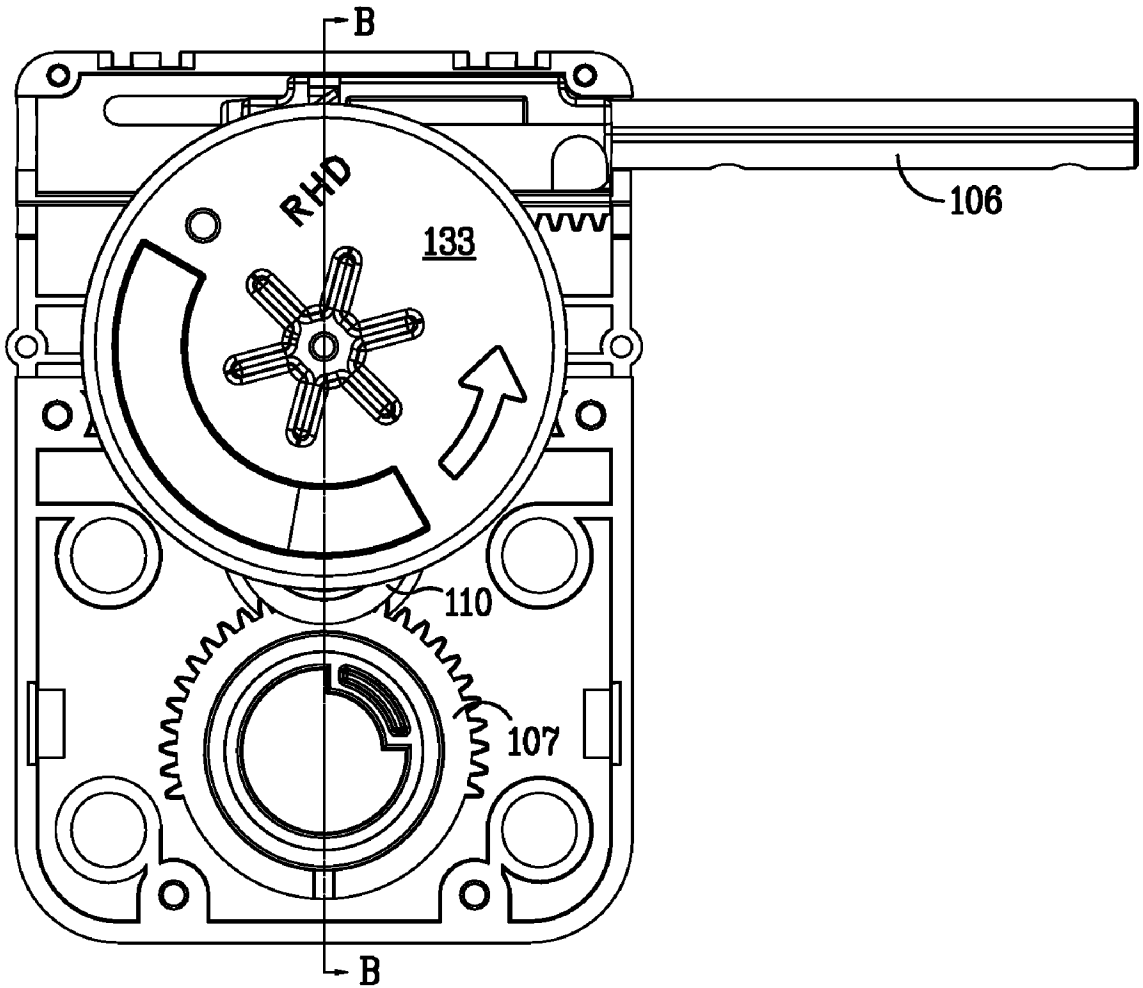
FIG. 28 shows the interior facing side of the first embodiment of the latch according to the present invention having a cam means which has disengaged the idler gear from the drop gear and the latching means in the latched position.
Figure 31:
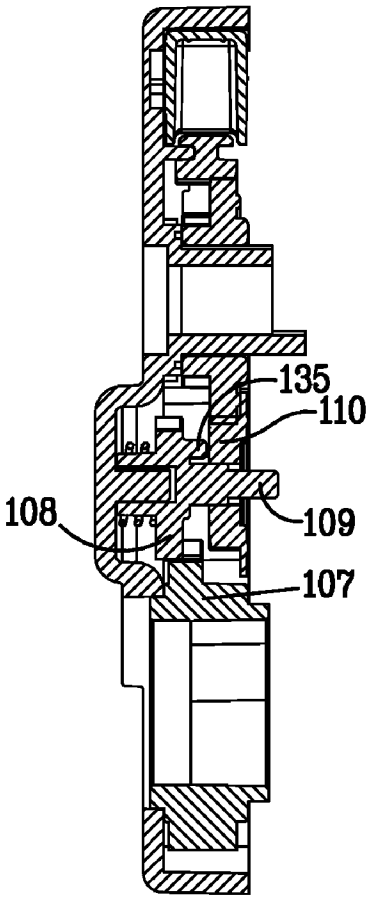
FIG. 31 shows a sectional view along line C-C of FIG. 30.
Figure 30:
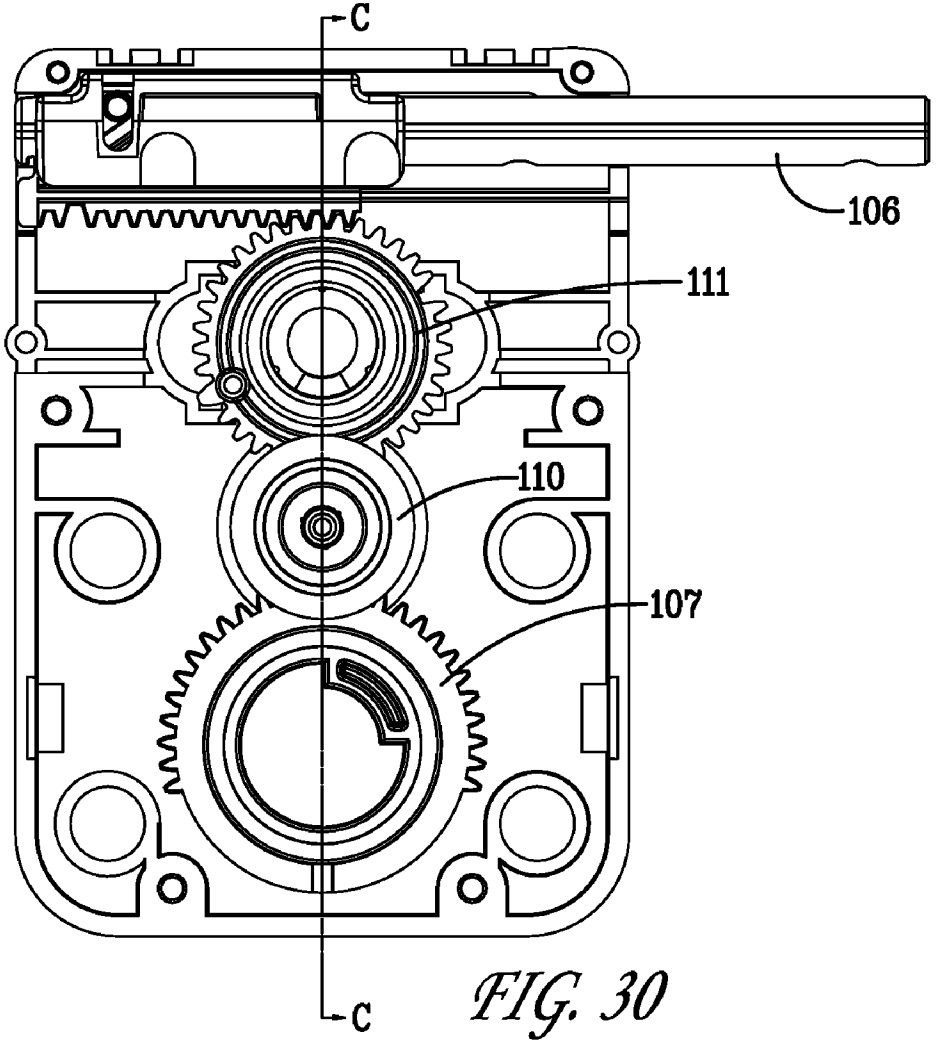
FIG. 30 shows the interior facing side of the first embodiment of the latch according to the present invention having a cam means which has disengaged the idler gear from the drop gear and moved the latching means to the unlatched position.
Figure 41:
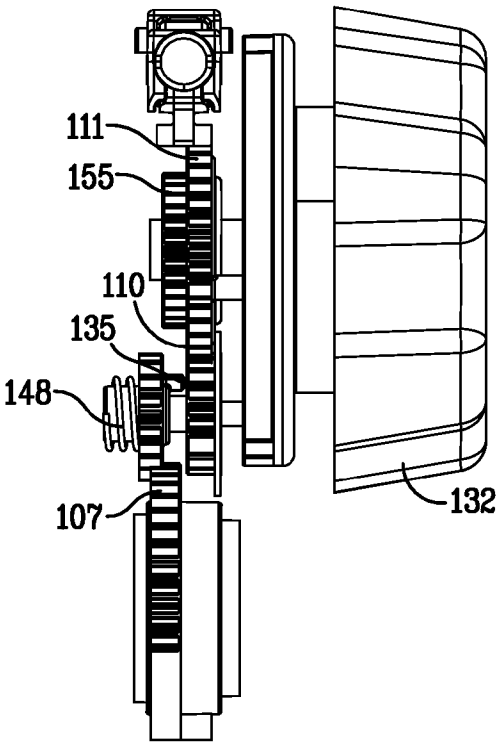
FIG. 41 shows a left view of the first embodiment of the latch without the housing according to the present invention after the turnhandle and cam means have been rotated such that the idler gear is disengaged from the drop gear and the latching means has been moved to the unlatched position upon further rotation of the cam means.
Figure 40:
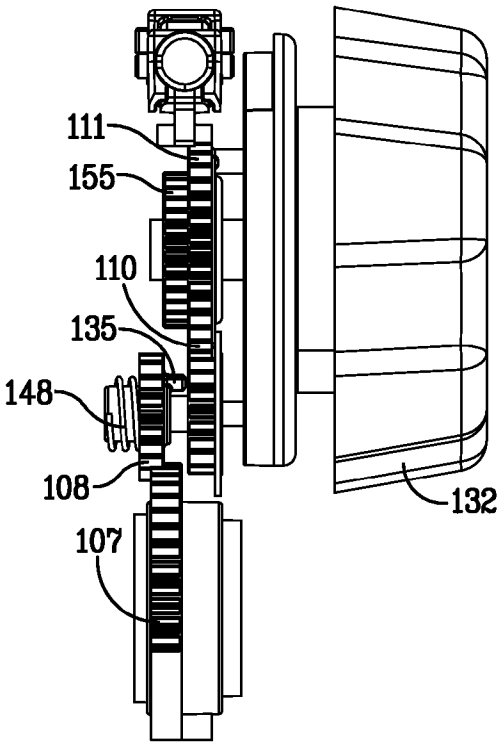
FIG. 40 shows a left side view of the first embodiment of the latch without the housing according to the present invention after the turnhandle and cam means have been rotated such that the cam means disengages the idler gear from the drop gear when the latch is in the latched position.
Figure 39:
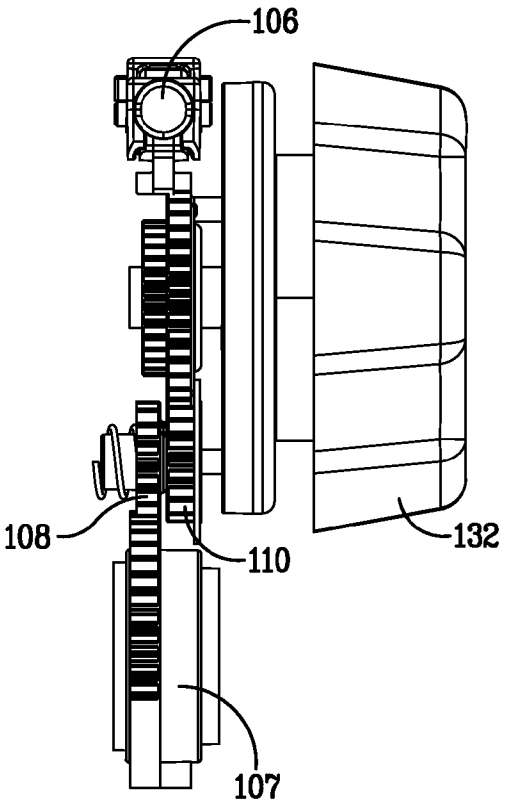
FIG. 39 shows a left side view of the first embodiment of the latch without the housing according to the present invention with a turnhandle and cam means in a rest position when the latch is in the latched position.
Figure 42:
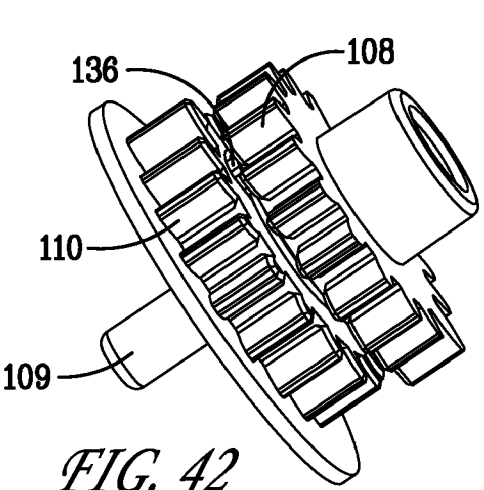
FIG. 42 shows the idler gear and drop gear of the present invention engaged by a protuberance on the drop gear.
Figure 43:
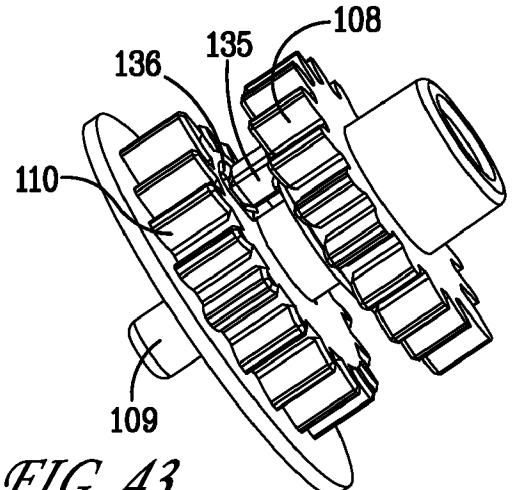
FIG. 43 shows the idler gear and drop gear aligned to be engaged by a protuberance on the drop gear.

Latch 100 can be provided with turnhandle 132 which fits on cam means 133 as seen in FIG. 5. In an emergency, passengers or a user on the interior side of the vehicle in which the latch is installed can use the turnhandle 132 to unlatch the latch 100 even if the drive gear 107 is locked in position by a keyed lockplug. When the cam means is in the rest position first cam means abutment 139 engages cover stop 138 on cover 140 to prevent further rotation of cam means 133. When the latch 100 is in the latched position, turnhandle 132 together with cam means 133 can first rotate about 45 degrees counterclockwise when viewed from the interior of the vehicle in order to have cam surface 134 of cam means 133 engage drop gear axis 109. As seen in FIGS. 29 and 40 after the cam surface 134 is rotated about 45 degrees against drop gear axis 109 drop gear engaging means 135, here a protuberance, is no longer engaged with idler gear detent 136. By engagement of cam means driving abutment 141 seen in FIG. 124 against top gear peg 142, further rotation of the cam means 133 rotates top gear 111 approximately 115 degrees as seen in FIG. 41 until second cam means abutment 137 engages housing stop 138 as shown in FIG. 6. In a manner similar to the above described operation of the drive gear 107, rotation of the cam means 133 in turn retracts or moves rack 112 such that rack pin 124 moves out of notch 125 in housing 102. During rotation of cam means 133, idler gear 110 remains enmeshed with top gear 111. After the initial approximate 45 degree rotation of cam means 133, idler gear 110 and drop gear 108 are disengaged, however, drop gear 108 remains engaged with drive gear 107 as seen in FIG. 27.

Figure 44:
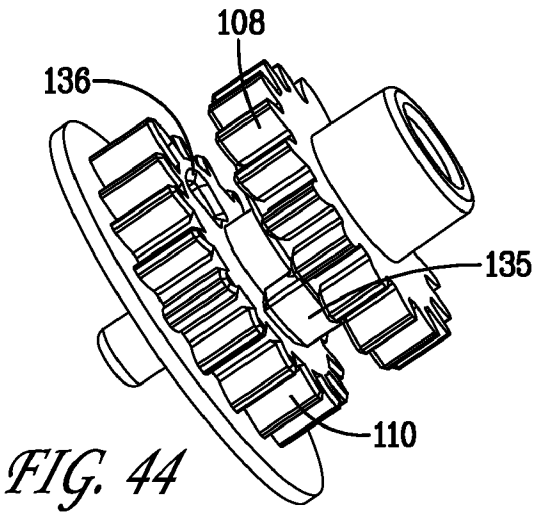
FIG. 44 shows the idler gear and drop gear rotated with respect to each other such that the idler gear and drop gear cannot engage.
Figure 45:
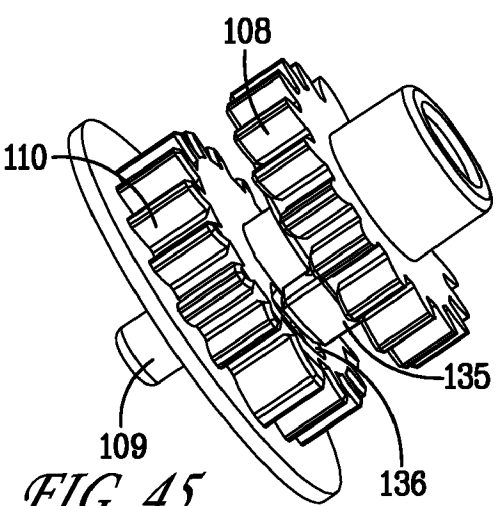
FIG. 45 shows the shows the idler gear and drop gear aligned to be reengaged by a protuberance on the drop gear.
Figure 46:
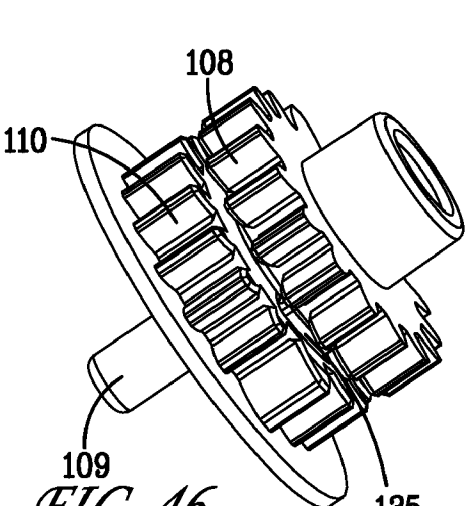
FIG. 46 shows the shows the idler gear and drop gear reengaged by a protuberance on the drop gear.
Figure 49:
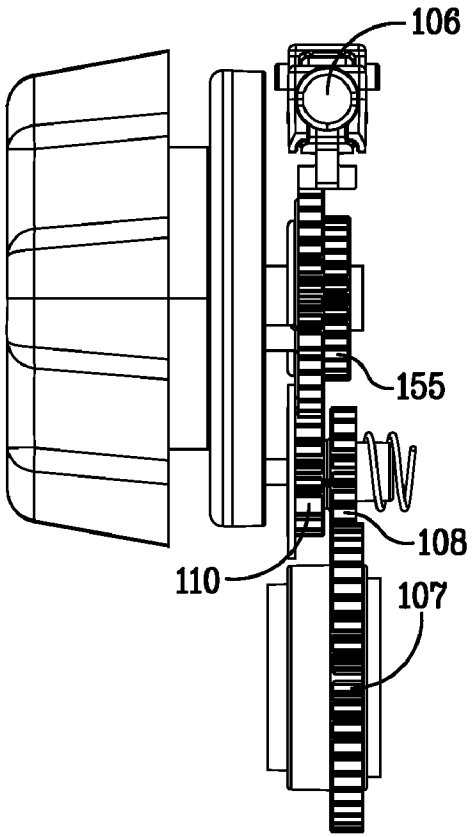
FIG. 49 shows a right side view of the second embodiment of the latch without the housing according to the present invention with a turnhandle and cam means in a rest position when the latch is in the latched position.
Figure 48:
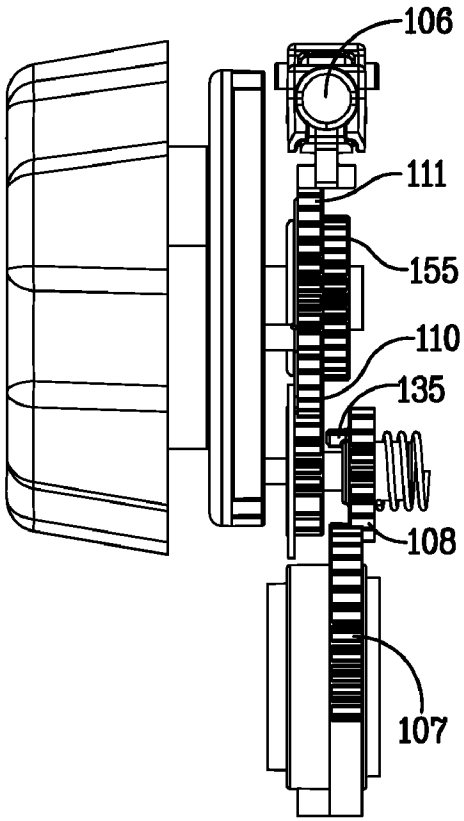
FIG. 48 shows a right side view of the second embodiment of the latch without the housing according to the present invention after the turnhandle and cam means have been rotated such that the idler gear is disengaged from the drop gear and the latching means has been moved to the unlatched position upon further rotation of the cam means.
Figure 47:
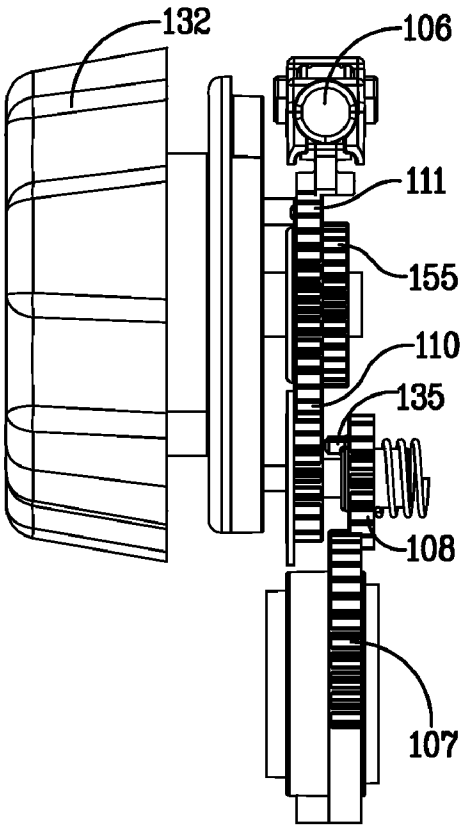
FIG. 47 shows a right side view of the second embodiment of the latch without the housing according to the present invention after the turnhandle and cam means have been rotated such that the cam means disengages the idler gear from the drop gear when the latch is in the latched position.
Figure 106:
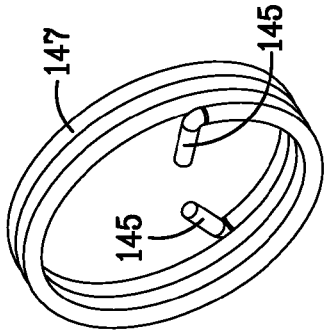
FIG. 106 is a perspective view of the torsion spring of the latch of the present invention.
Figure 107:
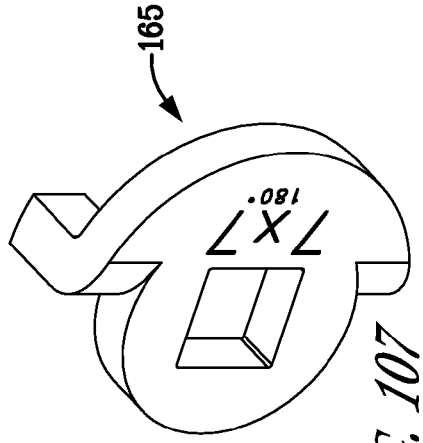
FIG. 107 is a perspective view of the exterior facing side of the first type of adaptor for the latch of the present invention.
Figure 102:
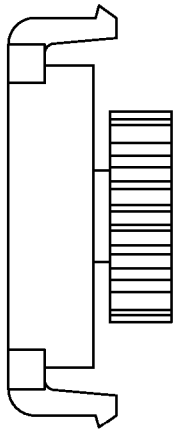
FIG. 102 is a top view of the oil damper of the latch of the present invention.
Figure 105:
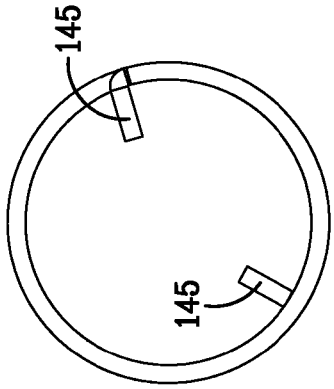
FIG. 105 is a side view of the torsion spring of the latch of the present invention.
Figure 118:
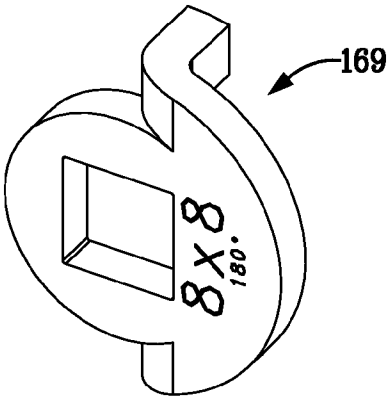
Figure 119:
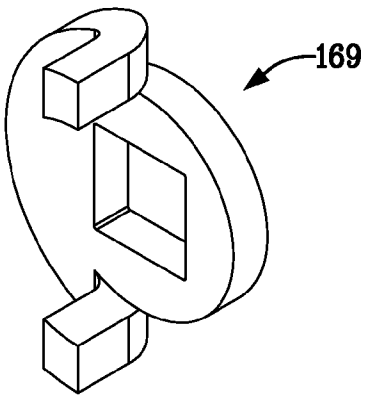
Figure 111:
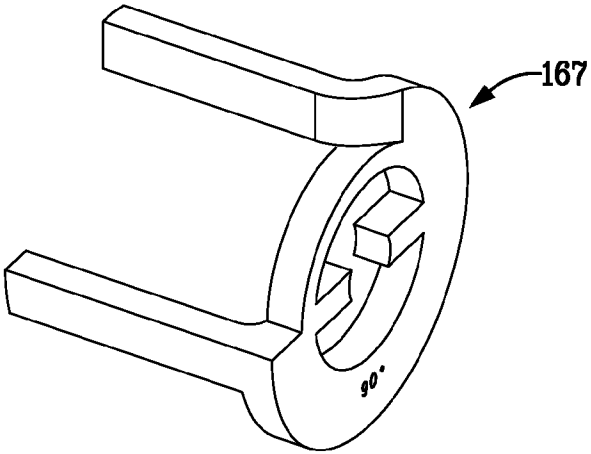
Figure 112:
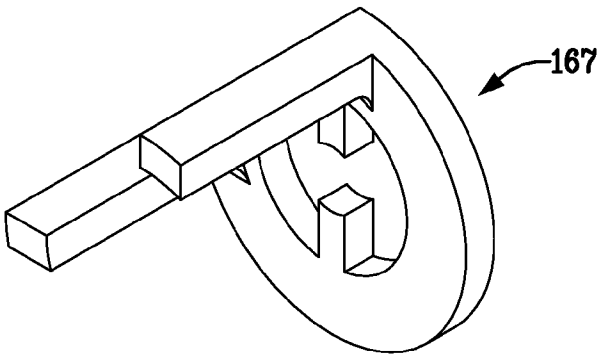
Figure 109:
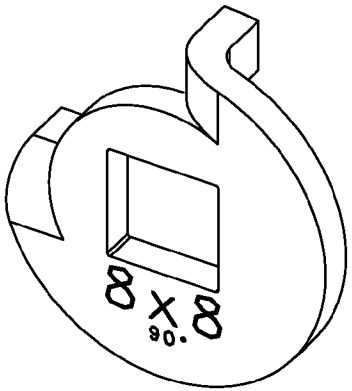
FIG. 109 is a perspective view of the exterior facing side of the second type of adaptor for the latch of the present invention.
Figure 110:
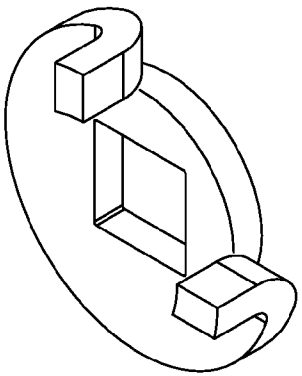
FIG. 110 is a perspective view of the interior facing side of the second type of adaptor for the latch of the present invention.
Figures 113, 114, 115, 116, 117:
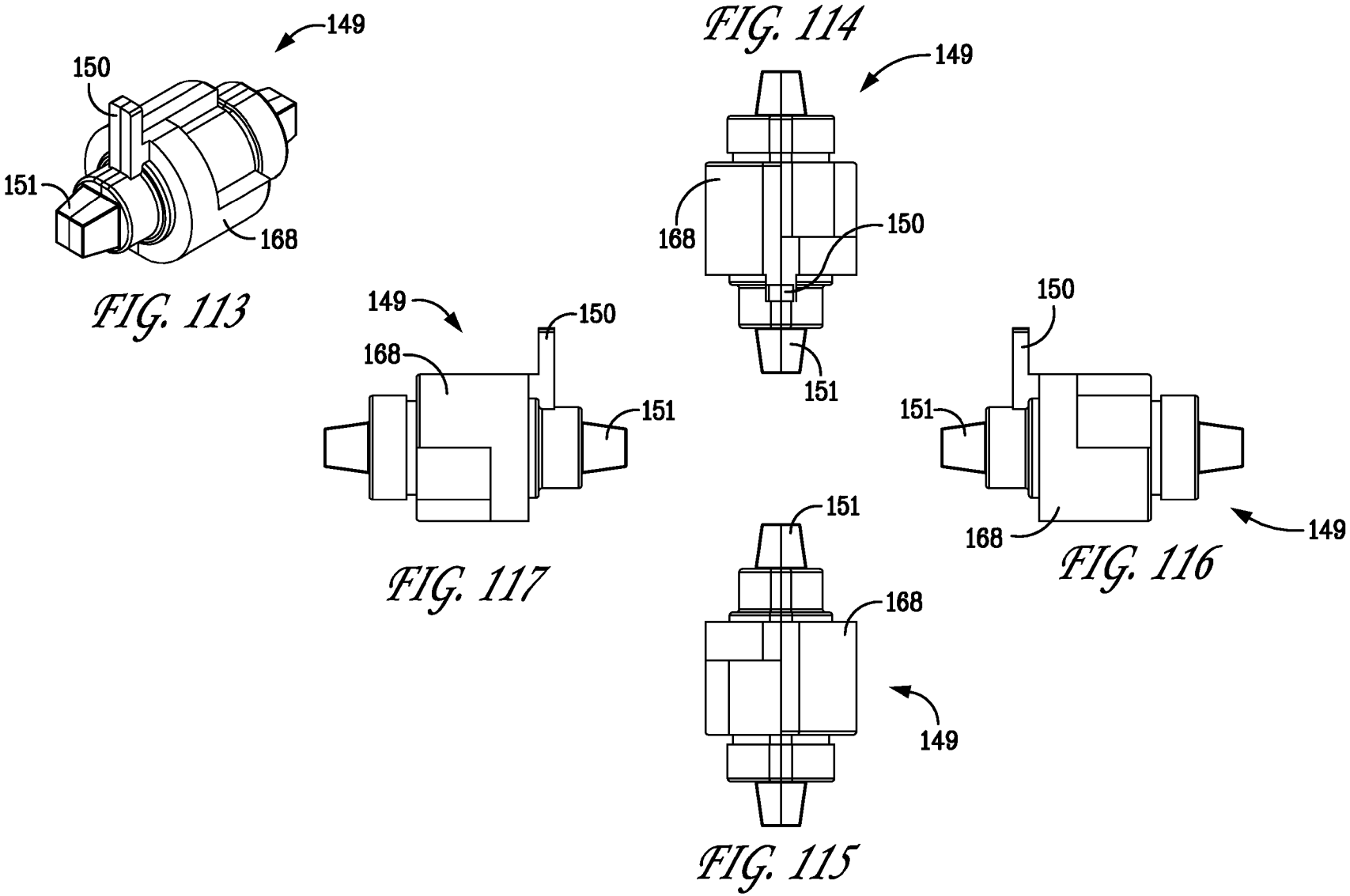

By the above described unlocking or unlatching of the latch 100, the turnhandle 132 which can be fastened by turnhandle screw 172 and cam means 133 cannot be used to lock the latch 100 again as the turnhandle 132 and cam means 133 are provided for emergency opening of the latch 100. After the latch 100 has been unlatched as described above the drive gear 107 and drop gear 108 are engaged and the drive gear 107 are in the same position as when they are normally latched. As the idler gear 110 and drop gear 108 are unengaged as seen in FIG. 44 and are out of engagement by 230 degrees, the idler gear 110 and drop gear 108 need to be reengaged to prepare the latch 100 for normal operation. A cam biasing means, such as torsion spring 147 as seen in FIGS. 105 and 106 has two torsion spring legs 145 and biases the cam means 133 such that the cam means 133 is returned to the rest position shown in FIG. 41 when the turnhandle 132 is released by a user. Torsion spring 147 can be biased against torsion spring biasing abutment 171. Rotation of the drive gear 107 90 degrees counterclockwise rotates the drop gear 108 230 degrees clockwise to align the idler gear 110 and drop gear 108 as seen in FIG. 45 such that the idler gear 110 and drop gear 108 reengage as seen in FIG. 46. The latch 100 can be provided with drop gear biasing means 148 which biases drop gear 108 into the engaged position. Because the drive gear 107 has been rotated 90 degrees as described above and the idler gear 110 and drop gear 108 are engaged, the drive gear 107 is in the normally unlatched position. The drop gear 108 and drive gear 107 remain engaged in the latched and unlatched position even when turnhandle 132 has been rotated to unlatch the latch 100 in an emergency.

Figure 34C:
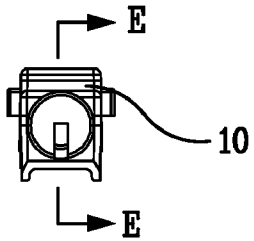
FIG. 34C is a front view of the latching means of the present invention without a rack.
Figure 34D:
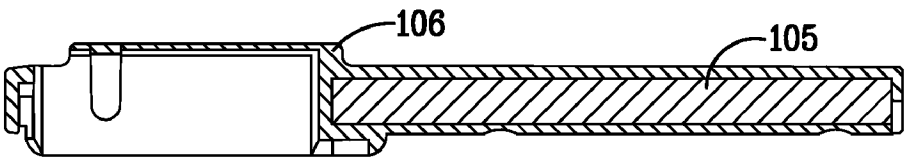
FIG. 34D shows a sectional view along line E-E of FIG. 34C.
Figure 34A:
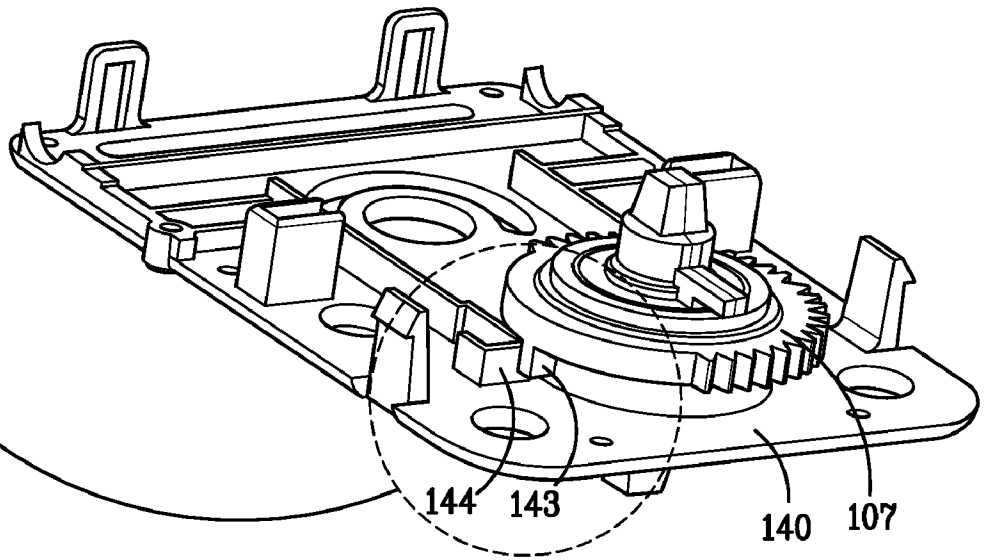
FIG. 34A is a left side perspective view of the cover plate and drive gear having an abutment of the second embodiment of the invention.
Figure 34B:
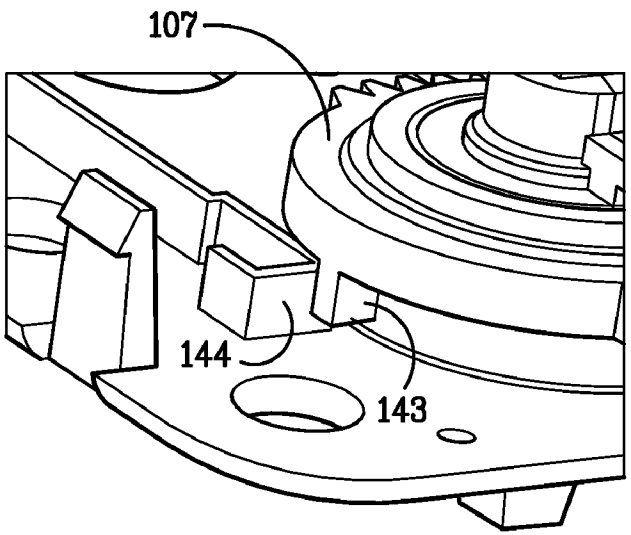
FIG. 34B is a partial view of the cover plate and drive gear of FIG. 34A.

In normal operation, the latch 100 is latched and unlatched by rotation of the drive gear 107 by a lock plug which can be keyed or simply driven by a handtool as seen in FIGS. 22, 23, 23A and 23B. About 90 degree counterclockwise rotation of drive gear 107 when viewed from the interior of the vehicle is transferred through the drop gear 108 and in turn the top gear 111 to achieve movement of the latching means 104 and unlatching of the latch 100. The latch 100 can be provided with a drive gear abutment 143 which contacts cover gear abutment 144 as seen in FIGS. 34A and 34B. During normal operation of the latch 100, cam means 133 and turnhandle 132 remain stationary.

To move the latch to the latched position from the unlatched position during normal operation the drive gear 107 is rotated about 90 degrees clockwise when viewed from the interior of the vehicle. This rotates the idler gear 110 and drop gear 108 about 230 degrees in the counterclockwise direction thereby rotating the top gear 111 about 115 degrees in the clockwise direction when viewed from the interior of a vehicle in which the latch 100 is installed. The bolt 106 and rack 112 can move about 30 mm at which point the bolt 106 contacts the housing wall 130. The rack 112 moves about another 6 mm as rack pin 124 is forced down rack surface 126 or ramp and into notch 125 in housing 102. If the latch 100 is provided with a microswitch 129, the microswitch opens as rack 112 is removed from contact with microswitch 129. Cam means 133 and turnhandle 132 remain stationary during movement of the latch 100 from the unlatched to latched position.

Figure 23:
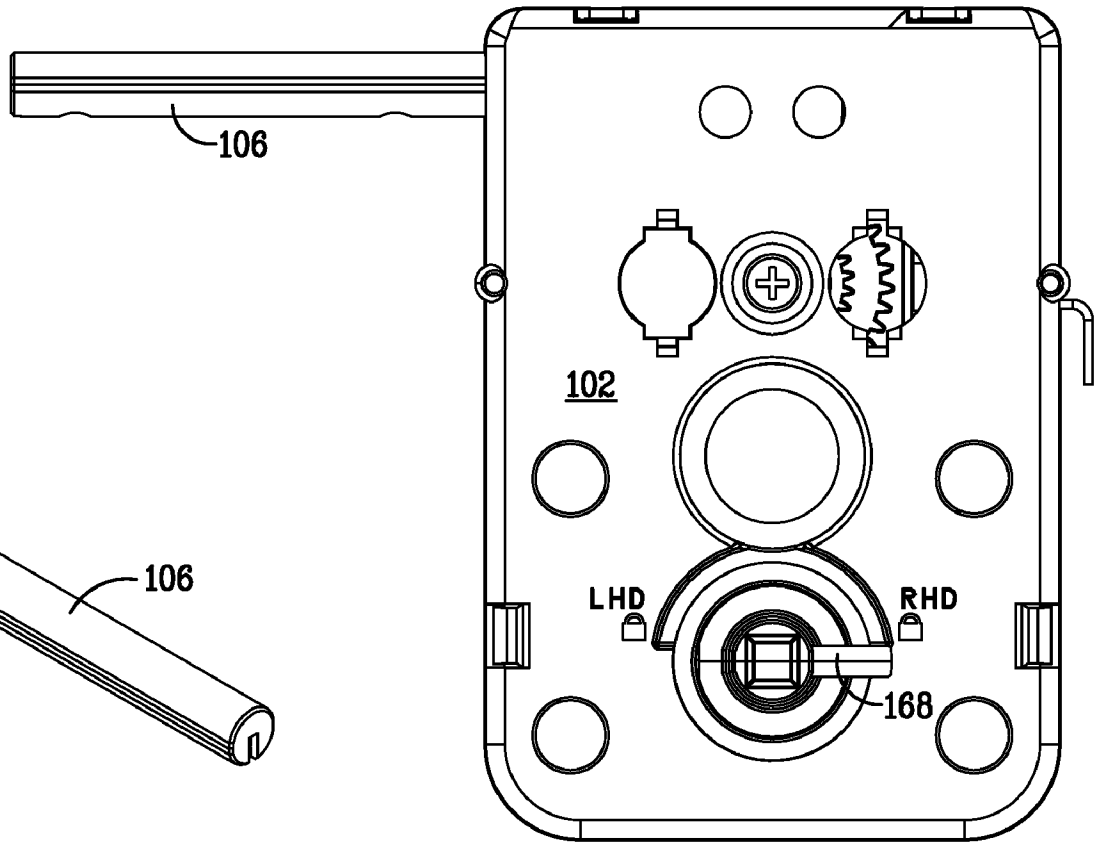
FIG. 23 shows the exterior facing side of the first embodiment of the latch according to the present invention and a fourth type of adaptor and a lock plug and the latching means in the latched position.
Figure 22:
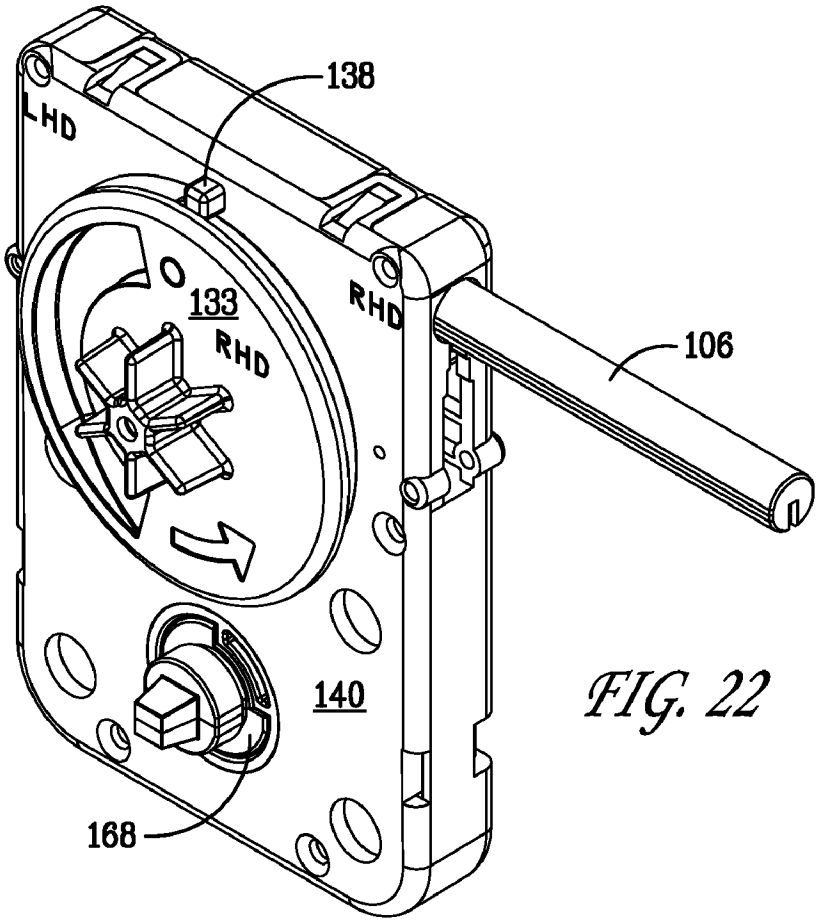
FIG. 22 shows a perspective view of the interior facing side of the first embodiment of the latch according to the present invention and a fourth type of adaptor and a lock plug and the latching means in the latched position.
Figure 23B:
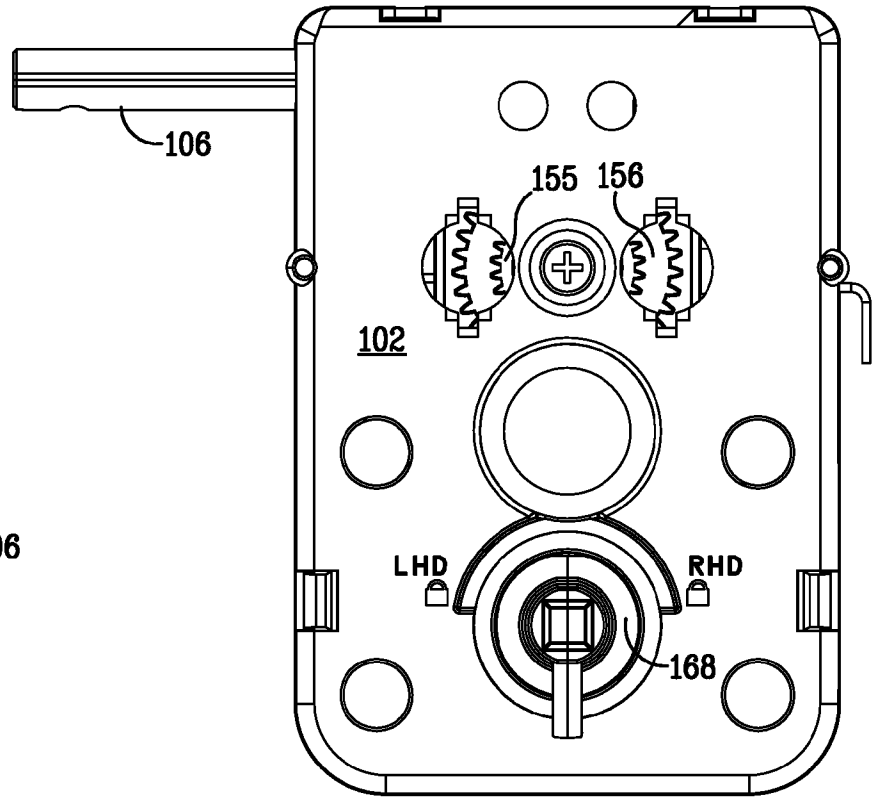
FIG. 23B shows the exterior facing side of the first embodiment of the latch according to the present invention and a fourth type of adaptor and a lock plug and the latching means in the unlatched position.
Figure 23A:
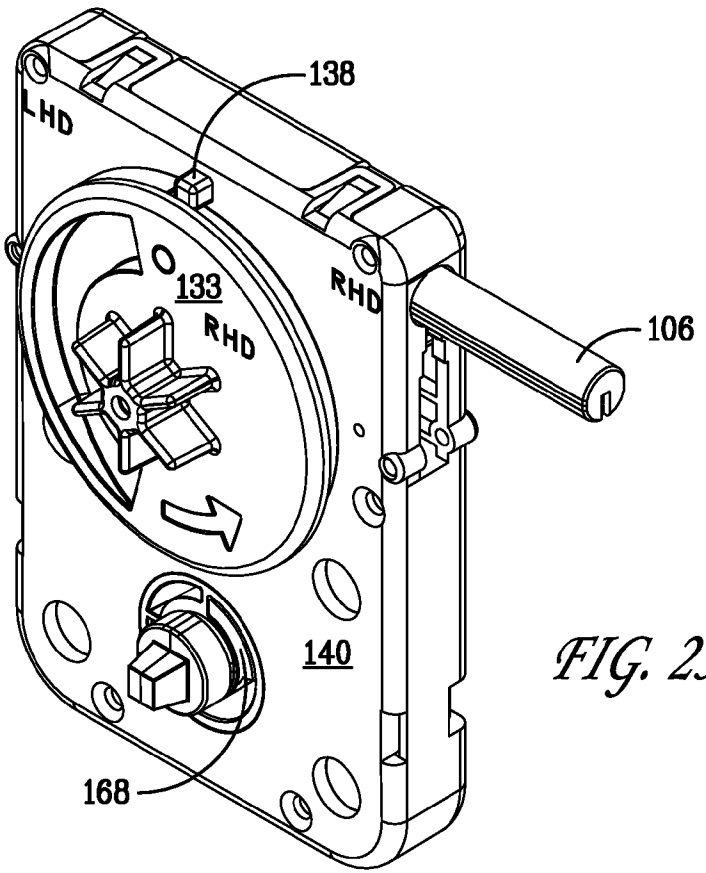
FIG. 23A shows a perspective view of the interior facing side of the first embodiment of the latch according to the present invention and a fourth type of adaptor and a lock plug and the latching means in the unlatched position.
Figure 25:
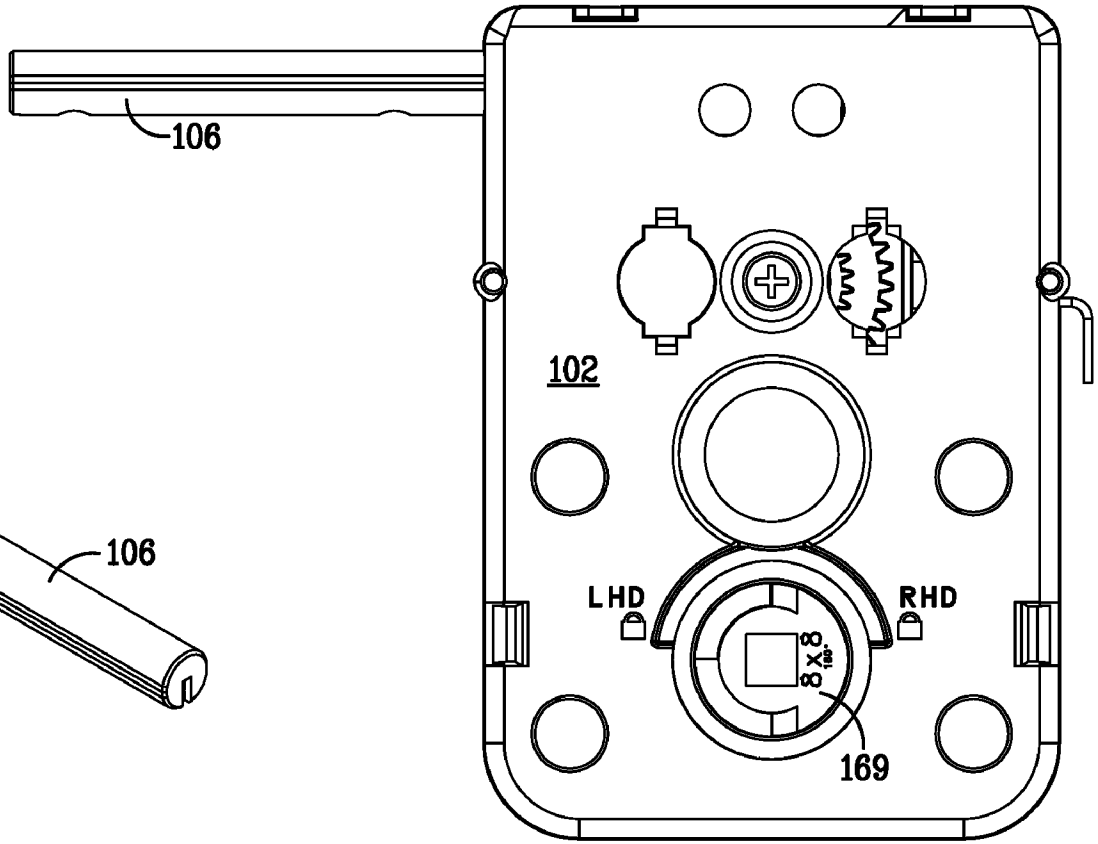
FIG. 25 shows the exterior facing side of the first embodiment of the latch according to the present invention and a fifth type of adaptor for a lock plug and the latching means in the latched position.
Figure 24:
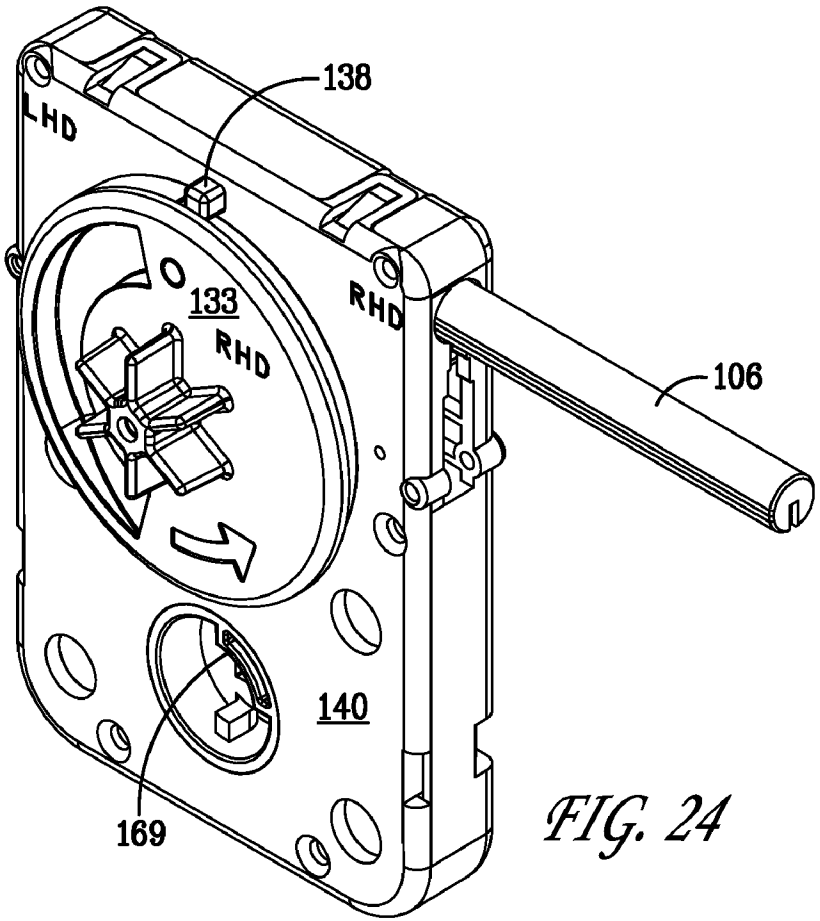
FIG. 24 shows a perspective view of the interior facing side of the first embodiment of the latch according to the present invention and a fifth type of adaptor for a lock plug and the latching means in the latched position.
Figure 73:
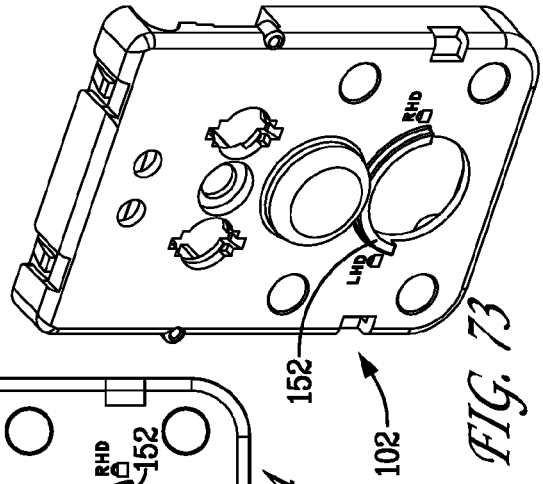
FIG. 73 is a perspective view of the exterior facing side of the housing of the latch of the present invention.
Figure 74:
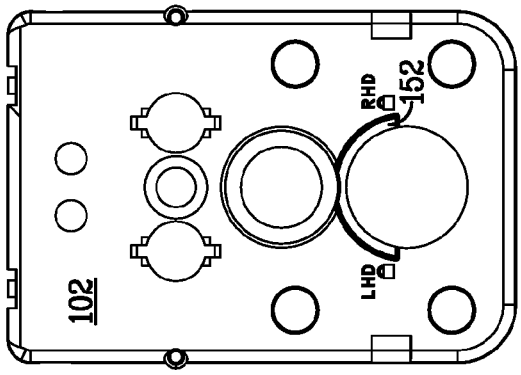
FIG. 74 is a view of the exterior facing side of the housing of the latch of the present invention.
Figure 76:
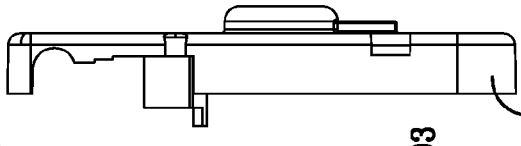
FIG. 76 is a right side view of the housing of the latch of the present invention.
Figure 78:
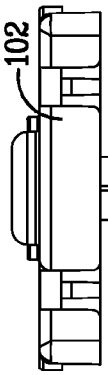
FIG. 78 is a top view of the housing of the latch of the present invention.

The lock plug shown in FIGS. 22, 23, 23A and 23B is fitted with a fourth type of adaptor 168 as seen in FIGS. 113-117. The lock plug 149 has tool face 151 for engagement with a tool for rotation of the lock plug in the drive gear. A pointer tab 150 is shown which indicates to a person assembling the latch whether the latch is configured for a right hand door as explained above in the description of the first embodiment of the present invention or configured for a left hand door as explained below in the description of the second embodiment of the present invention. When the first embodiment of the latch 100 is in the latched position, pointer tab 150 abuts housing rib 152 as seen in FIGS. 23 and 73 which prevents overrotation of the drive gear 107. Pointer tab 150 also indicates to a user who assembles the latch 100 whether the pointer tab 150 and latch are configured for a left hand door or a right hand door after the fourth type of adaptor 149 and lock plug are placed in the housing 102.

Idler gear 110 has idler gear plate 153 which rotates against top gear rib 154.

Suitable mounting means are provided to retain the latch 100 on a panel or mounting surface. For example, installation of the latch assembly 100 to a panel may be accomplished with nuts and bolts or screws which pass through the housing bosses 103 and the first member. After installation and in use, latch 100 in latched position engages a surface of a keeper thus securing the second member in the closed position.

If there is a strong load tending to force the second member from the first member panel, insert 105 as seen in FIG. 34 D which can be steel in the bolt 106 reinforces the bolt.

As seen in FIGS. 23B, 39-41 and 95, top gear 11 has a top gear second profile 155 which has a different modulus than the top gear first profile 156 which engages damper gears 157 of damper 158 here an oil damper which can fit into housing 102 by means of damper snap legs 159. When provided with a damper 158 the latch 100 is unlikely to self close due to vibration. The damper housing 160 can be oil filled and have set of rotors in the oil to inhibit rotating of the damper 158 and thus inhibit rotation of the top gear 111. The microswitch 129 of the latch 100 can be fitted into the latch 100 without the requirement of disassembly of the latch 100.

Figure 100:
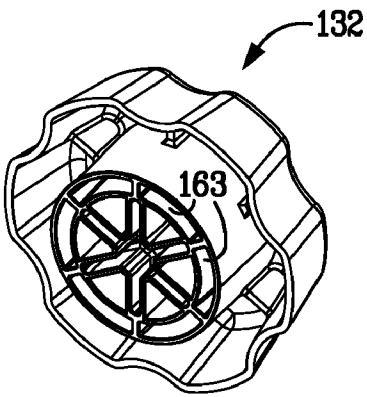
FIG. 100 is a perspective view of the exterior facing side of the turnhandle of the latch of the present invention.
Figure 99:
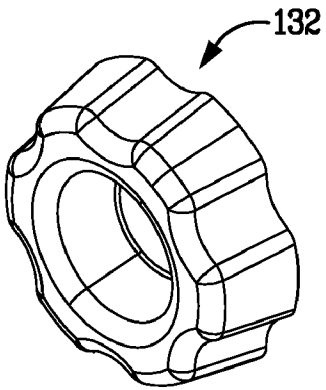
FIG. 99 is a perspective view of the interior facing side of the turnhandle of the latch of the present invention.
Figure 98:
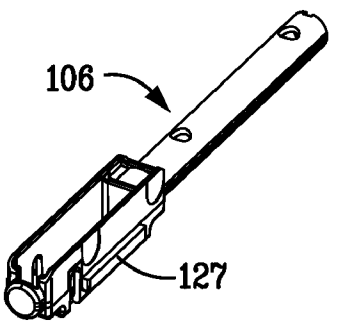
FIG. 98 is a perspective view of the bottom side of the bolt of the latch of the present invention.
Figure 104:
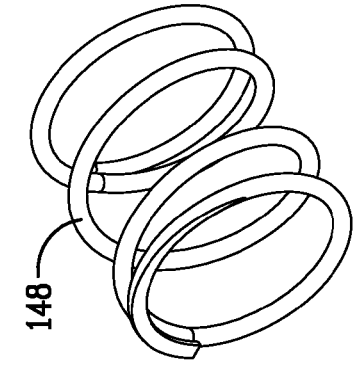
FIG. 104 is a perspective view of the compression spring of the latch of the present invention.
Figure 108:
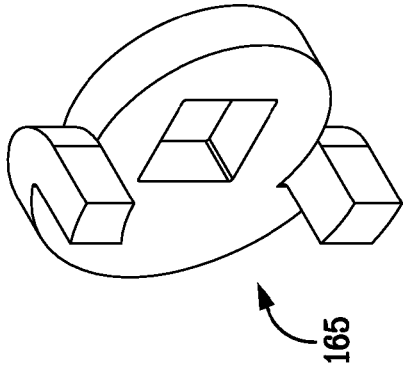
FIG. 108 is a perspective view of the interior facing side of the first type of adaptor for the latch of the present invention.
Figure 103:
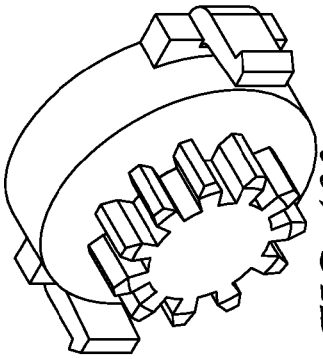
FIG. 103 is a perspective view of the oil damper of the latch of the present invention.

As seen in FIG. 3 cover 140 has fastening means here cover snap legs 161 which snap fit into snap leg apertures 162 in the housing. As seen in FIGS. 5 and 100, turnhandle 132 has turnhandle fastening means 163 which fit up to cam fastening means 164.

A variety of different adaptors, i.e. first type of adaptor 165, second type of adaptor 166, third type of adaptor 167, fourth type of adaptor 168, and fifth type of adaptor 169 are shown in FIGS. 16 to 25. The drop gear 107 shown is configured to rotate only 90 degrees and only rotates relative to the first type of adaptor 165 and the fifth type of adaptor 169 both of which first rotate 90 degrees prior to either of the two adaptors engaging drive gear engaging means 170. Due to fixed engagement of the other adaptors with drive gear engaging means 170, no relative movement takes place upon rotation of the other adaptors. This can be seen in FIG. 20, for example, where drive gear engaging means 170 prevents movement of third type of adaptor 167 relative to the drive gear 107.

Due to the symmetry of the latch 100 the latch can be provided for a right hand or left hand door. In the second embodiment of the present invention as seen in FIGS. 47-70 the only handed piece is the left cam means 233 which is shown in FIGS. 125-129. Left hand cam means 233 has similar features to cam means 133 except that left cam means 233 is configured and dimensioned such that when the left cam means 233 is used in the latch then the latch is configured for a left hand door rather than a right hand door as seen in the above description of the first embodiment of the present invention.

In the second embodiment, the bolt 106 emerges from the left hand side of the latch 100 when viewed from the interior of the vehicle in which the latch 100 is installed. In the latched position seen in FIGS. 57 and 58, rack pin 124 is forced down the ramp profile or rack surface 126 of rack 112 and into notch 125 in housing 102, thus preventing the bolt 106 from being forced back to the unlatched position without movement of rack 112 relative to bolt 106.

Figure 56:
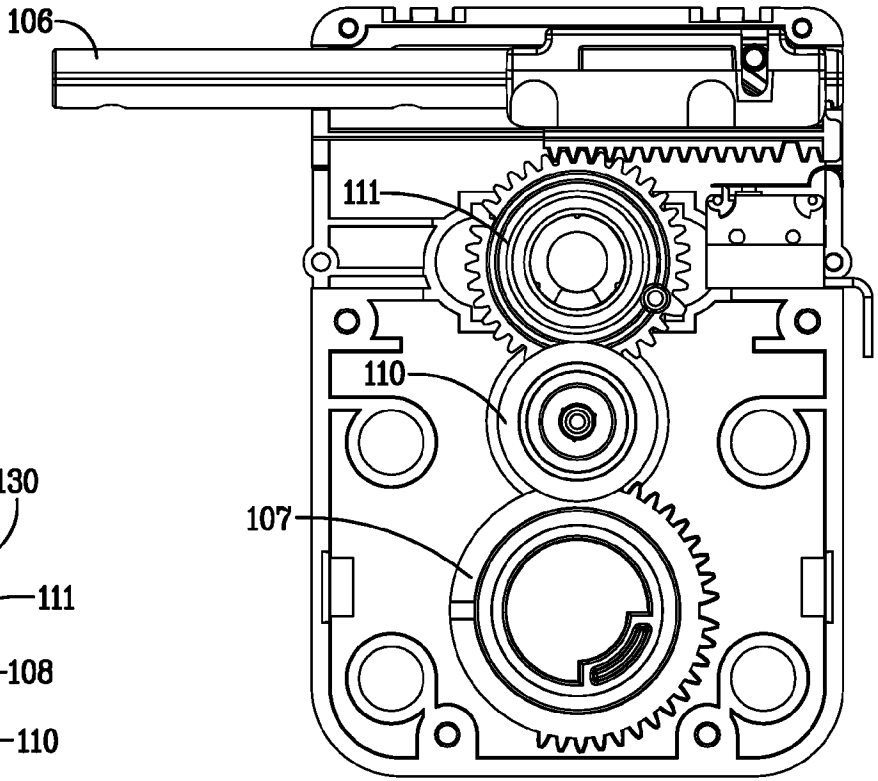
FIG. 56 shows a view of the interior facing side of the second embodiment of the latch according to the present invention with a microswitch wherein the idler gear engages the drop gear and the latch is in the unlatched position by rotation of the drive gear.
Figure 55:
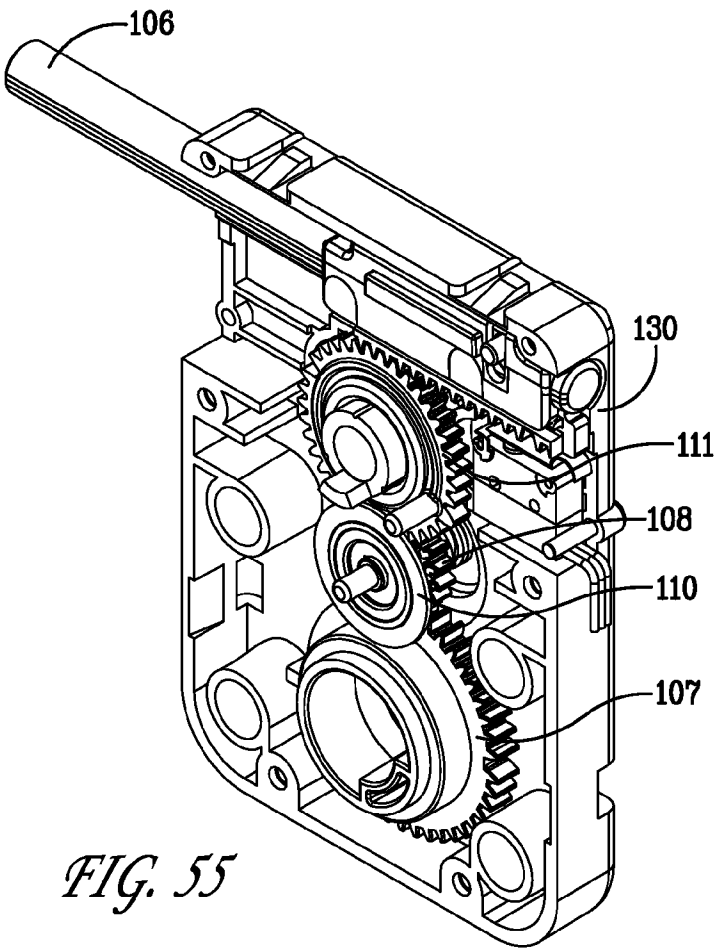
FIG. 55 shows a perspective view of the interior facing side of the second embodiment of the latch according to the present invention with a microswitch wherein the idler gear engages the drop gear and the latch is in the unlatched position by rotation of the drive gear.

In the unlatched position seen in FIGS. 55 and 56, drive gear 107 has been rotated about 90 degrees clockwise when viewed from the interior of a vehicle in which the latch is mounted. The idler gear 110 and drop gear 108 have been rotated about 230 degrees counterclockwise and top gear 111 has rotated about 115 degrees clockwise. In a way similar to that seen in the first embodiment, rack 112 retracts about 6 mm relative to the bolt 106 when the rack pin 124 rides up the ramp profile or rack surface 126 of the rack 112 and then rack 112 retracts about 30 more mm until rack 112 engages housing wall 130 such that rack 112 is prevented from being further retracted.

Figure 51:
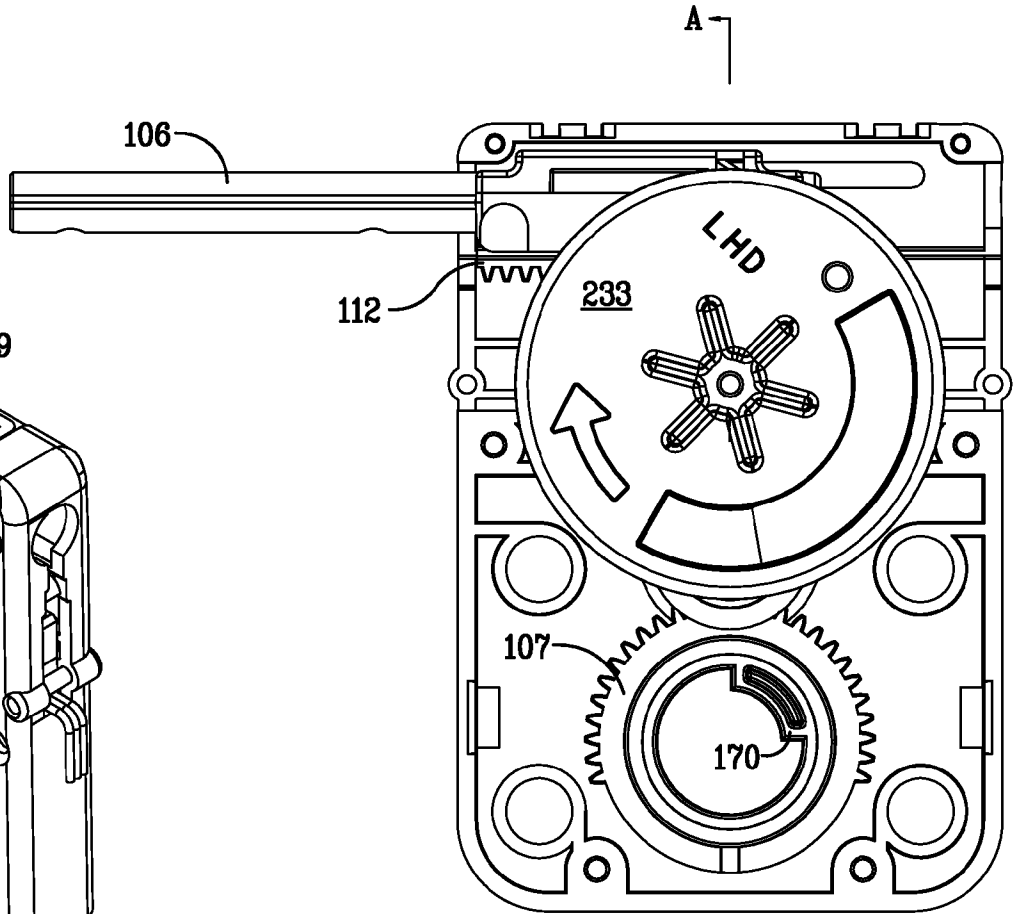
FIG. 51 shows the interior facing side of the second embodiment of the latch according to the present invention with a cam means having a surface which has moved the drop gear such that the idler gear does not engage the drop gear when the latch is in the latched position.
Figure 50:
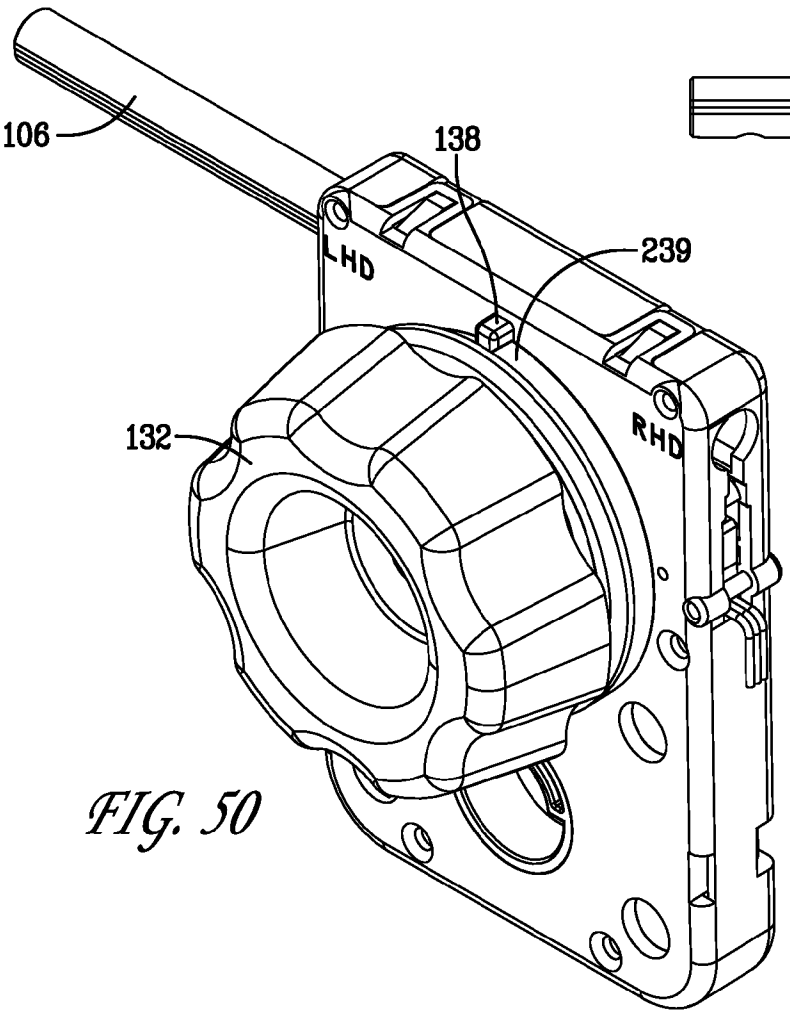
FIG. 50 shows a perspective view of the interior side of the second embodiment of the latch with a microswitch according to the present invention.
Figure 52:
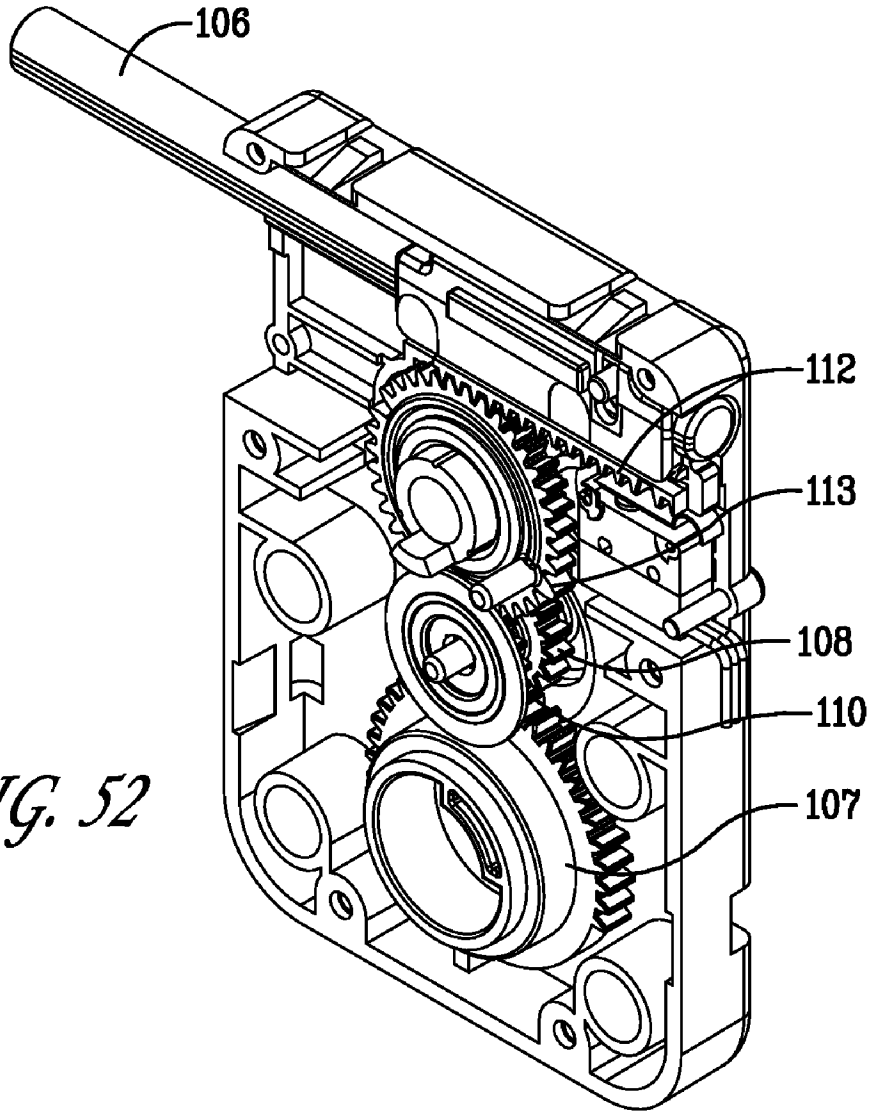
FIG. 52 shows a perspective view of the interior facing side of the second embodiment of the latch according to the present invention with a microswitch wherein the idler gear does not engage the drop gear and the cam means has rotated such that the latch is in the latched position.
Figure 54:
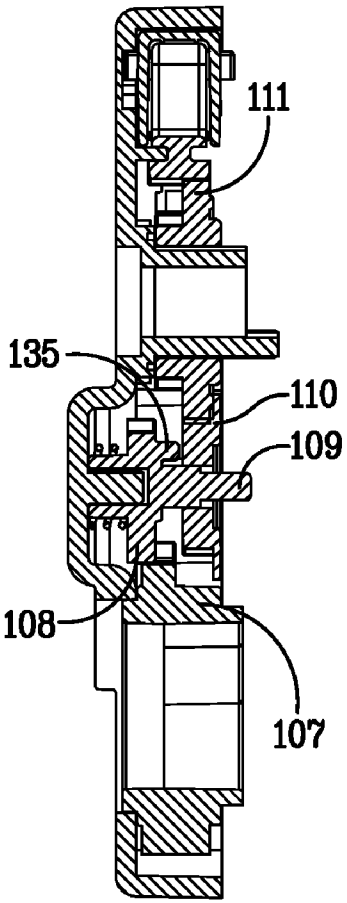
FIG. 54 shows a sectional view along line F-F of FIG. 53.
Figure 53:
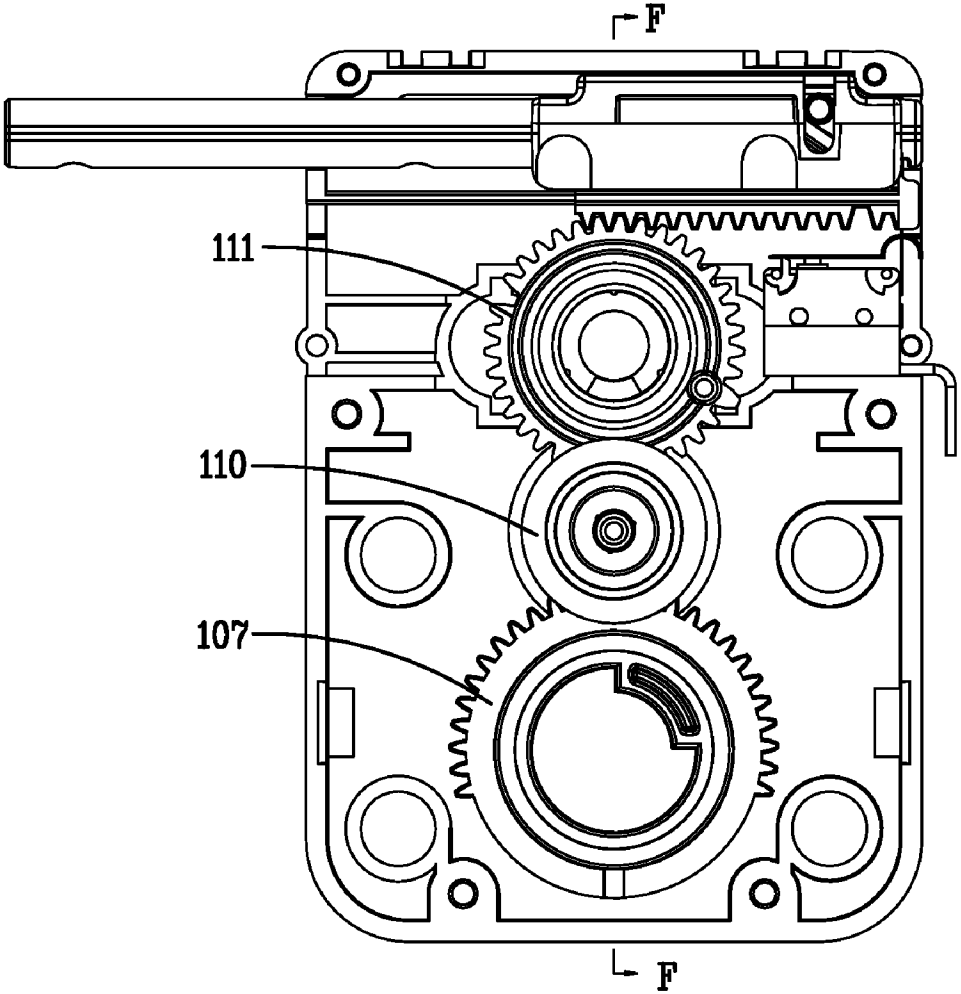
FIG. 53 shows the interior facing side of the second embodiment of the latch according to the present invention with a microswitch wherein the idler gear does not engage the drop gear and the cam means has rotated such that the latch is in the latched position.
Figure 58:
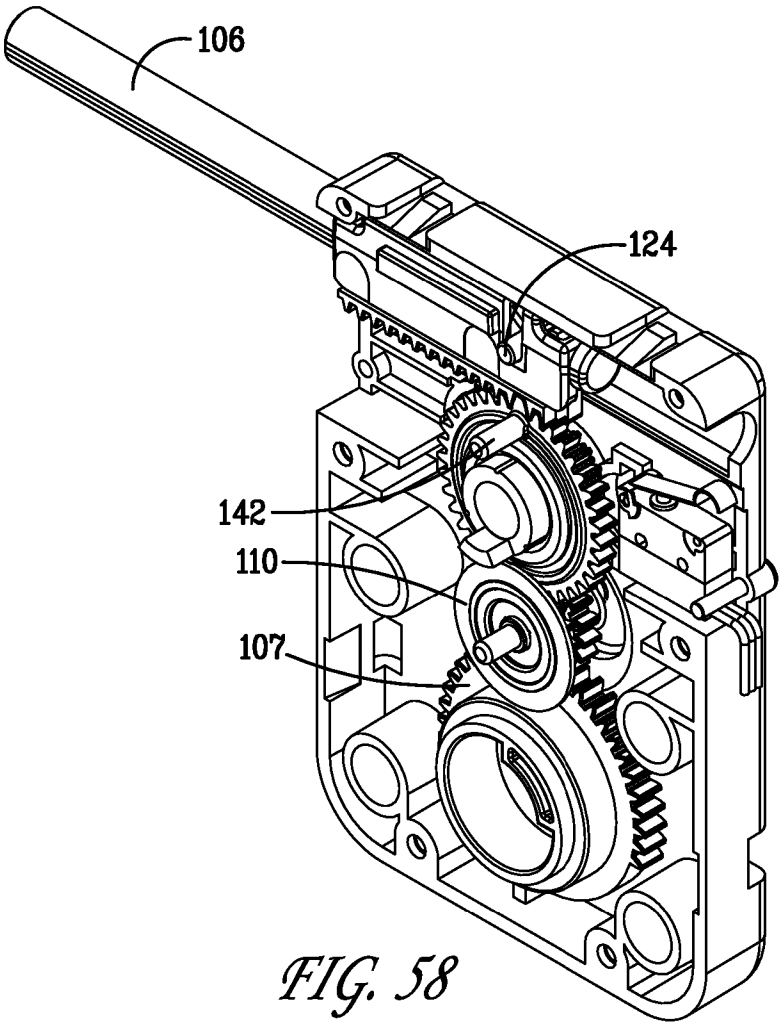
FIG. 58 shows a perspective view of the interior facing side of the second embodiment of the latch according to the present invention with a microswitch wherein the idler gear engages the drop gear and the latch is in the latched position.
Figure 57:
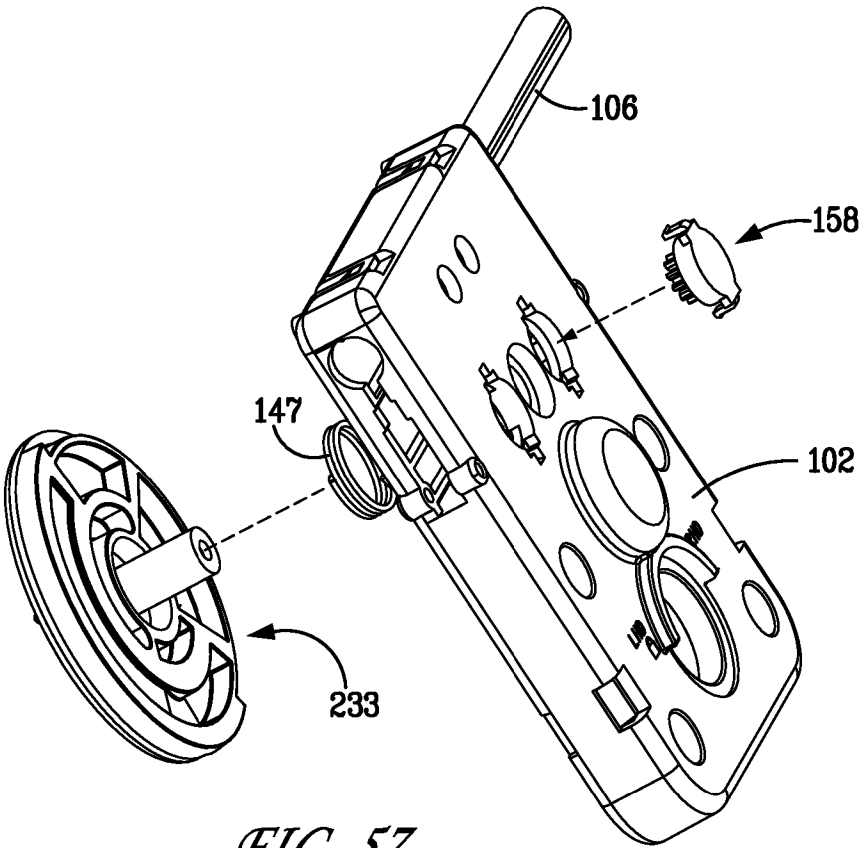
FIG. 57 is an exploded view of the second embodiment of the latch according to the present invention having an oil damper, cam means and cam biasing means.
Figure 59:
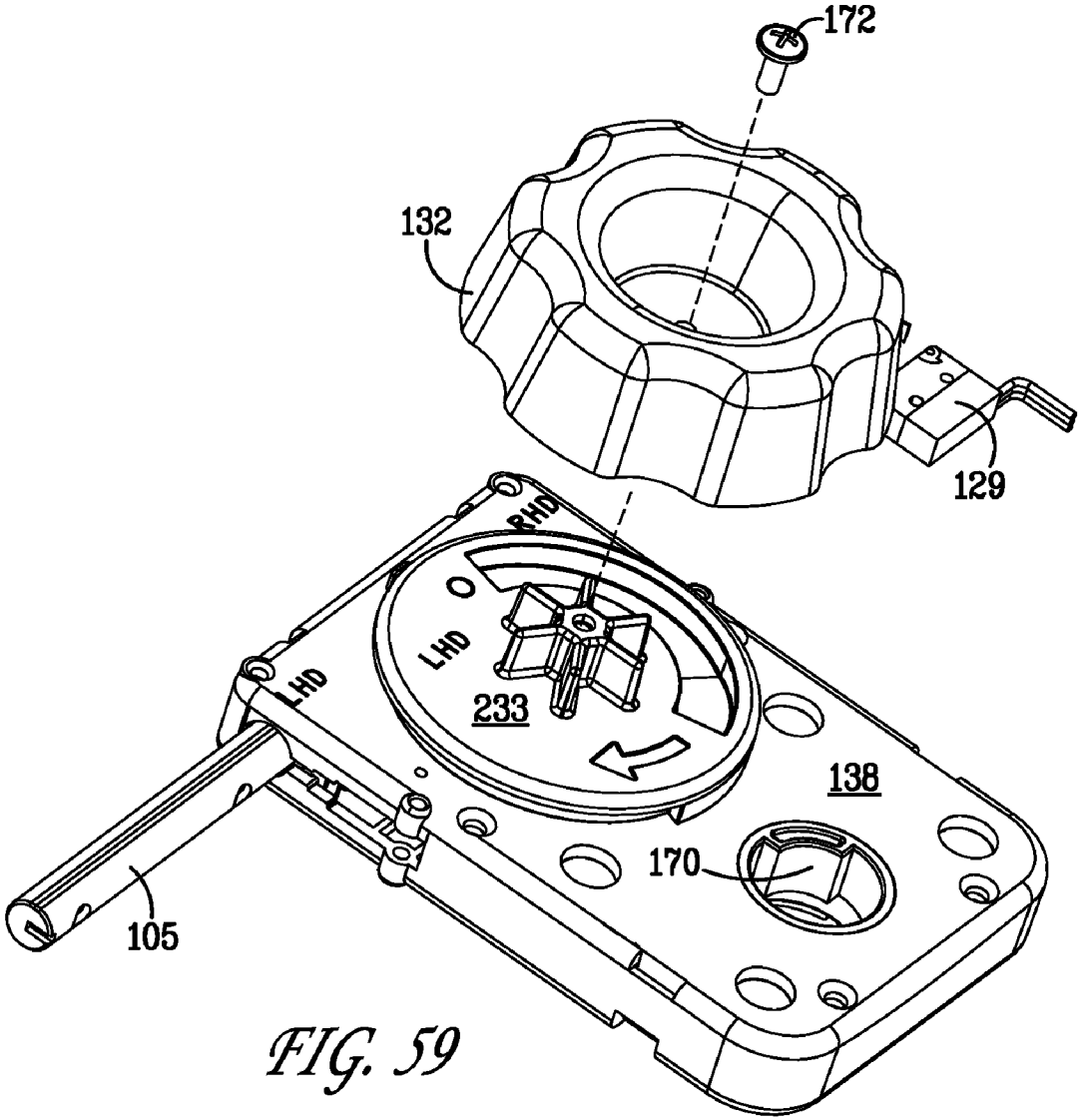
FIG. 59 shows an exploded view of the interior facing side of the second embodiment of the latch according to the present invention with a microswitch in the latched position.
Figure 61:
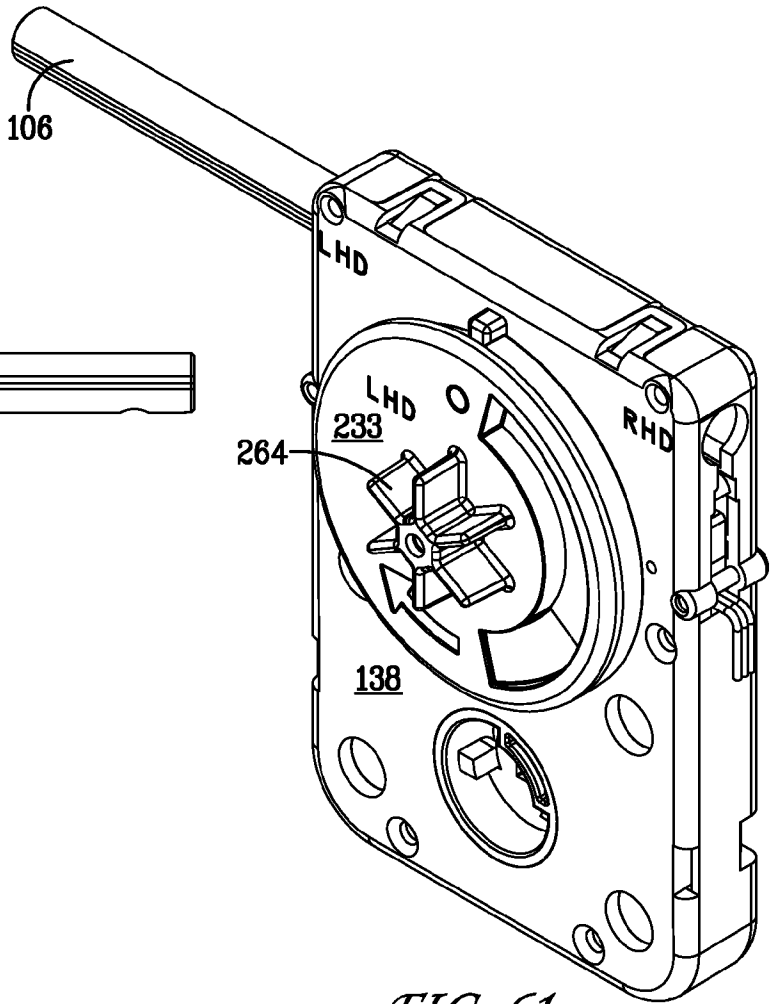
FIG. 61 shows a perspective view of the interior facing side of the second embodiment of the latch according to the present invention and the first type of adaptor for a lock plug and the latching means in the latched position.
Figure 60:
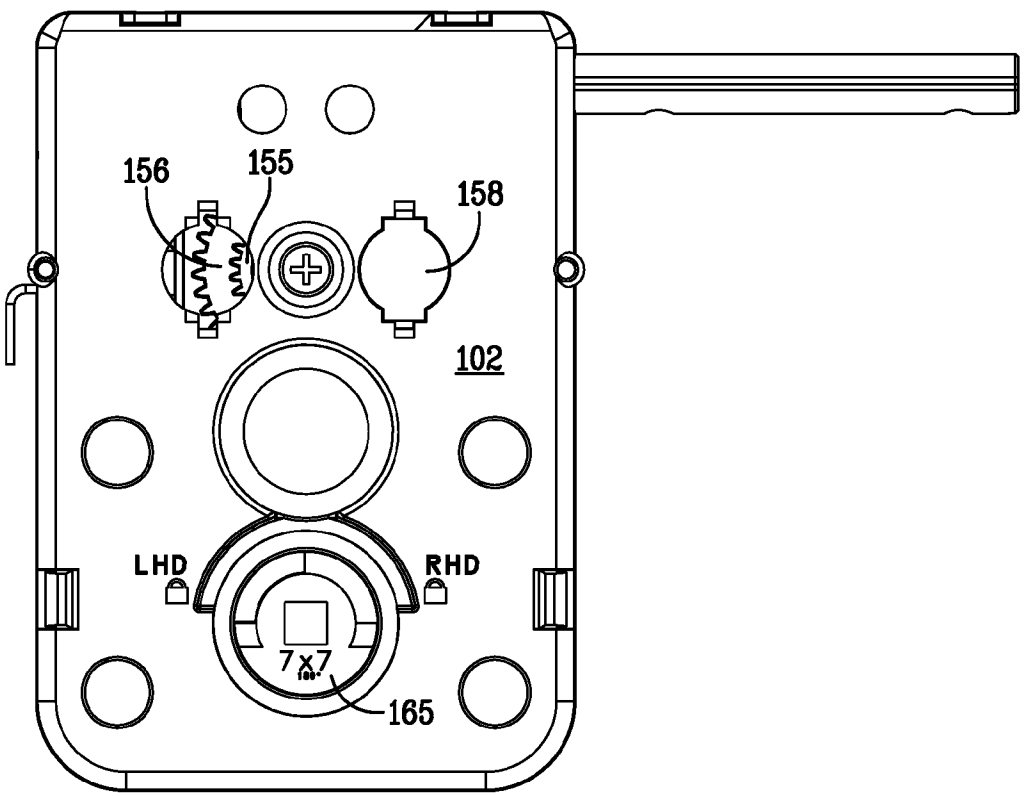
FIG. 60 shows a view of the interior facing side of the second embodiment of the latch according to the present invention and the first type of adaptor for a lock plug and the latching means in the latched position.
Figure 63:
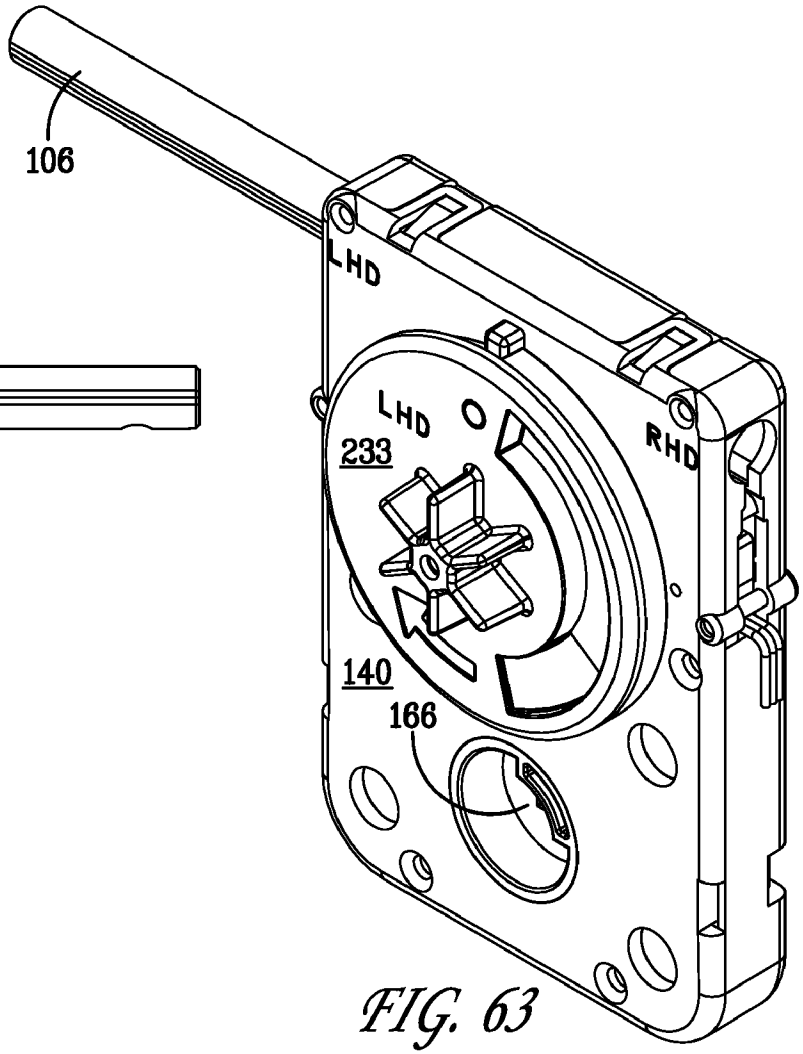
FIG. 63 shows a perspective view of the interior facing side of the second embodiment of the latch according to the present invention and the second type of adaptor for a lock plug and the latching means in the latched position.
Figure 62:
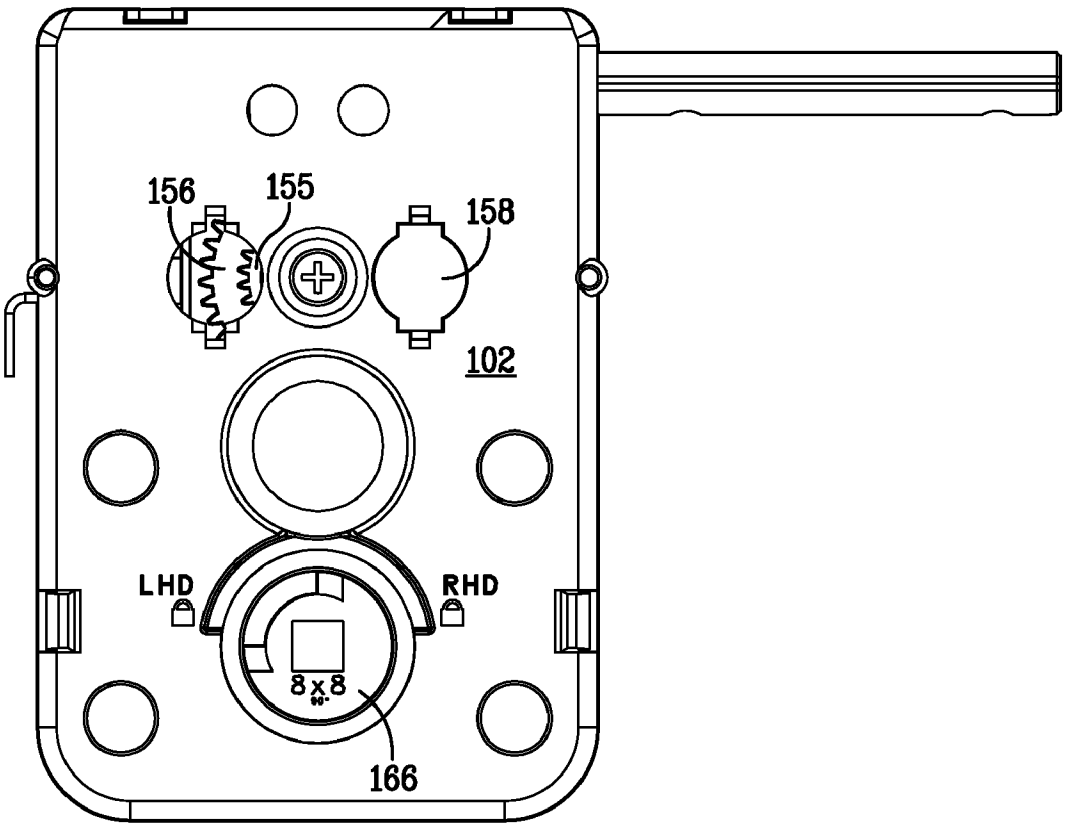
FIG. 62 shows a view of the interior facing side of the second embodiment of the latch according to the present invention and the second type of adaptor for a lock plug and the latching means in the latched position.
Figure 65:
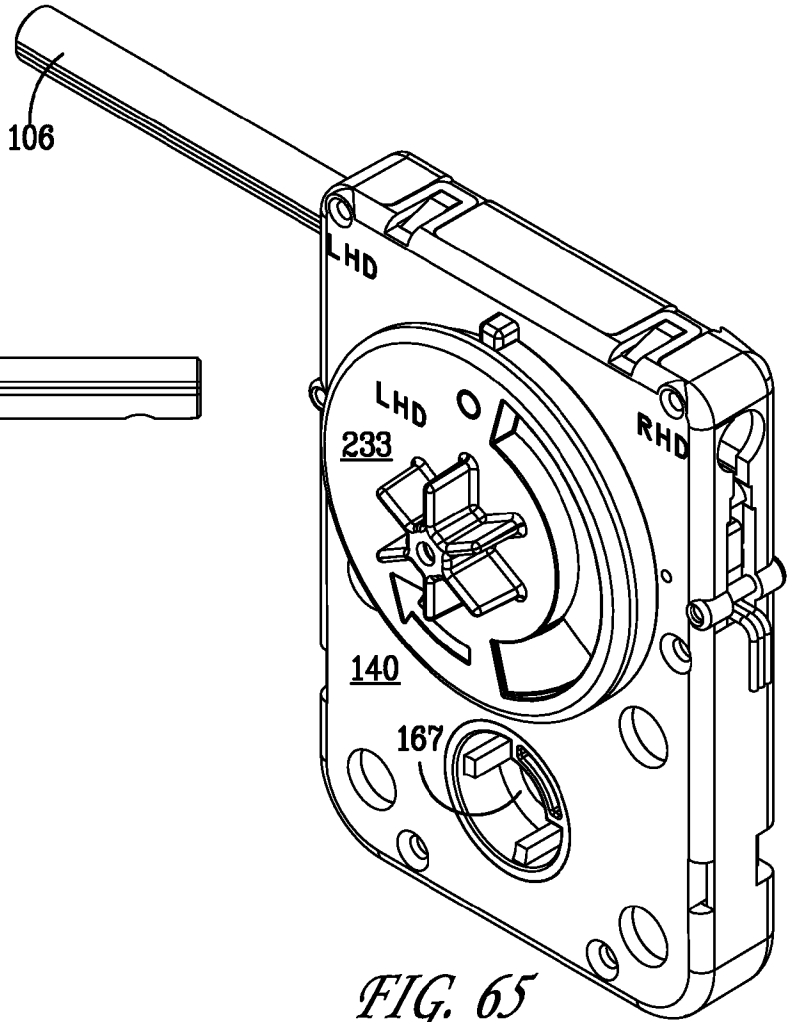
FIG. 65 shows a perspective view of the interior facing side of the second embodiment of the latch according to the present invention and the third type of adaptor for a lock plug and the latching means in the latched position.
Figure 64:
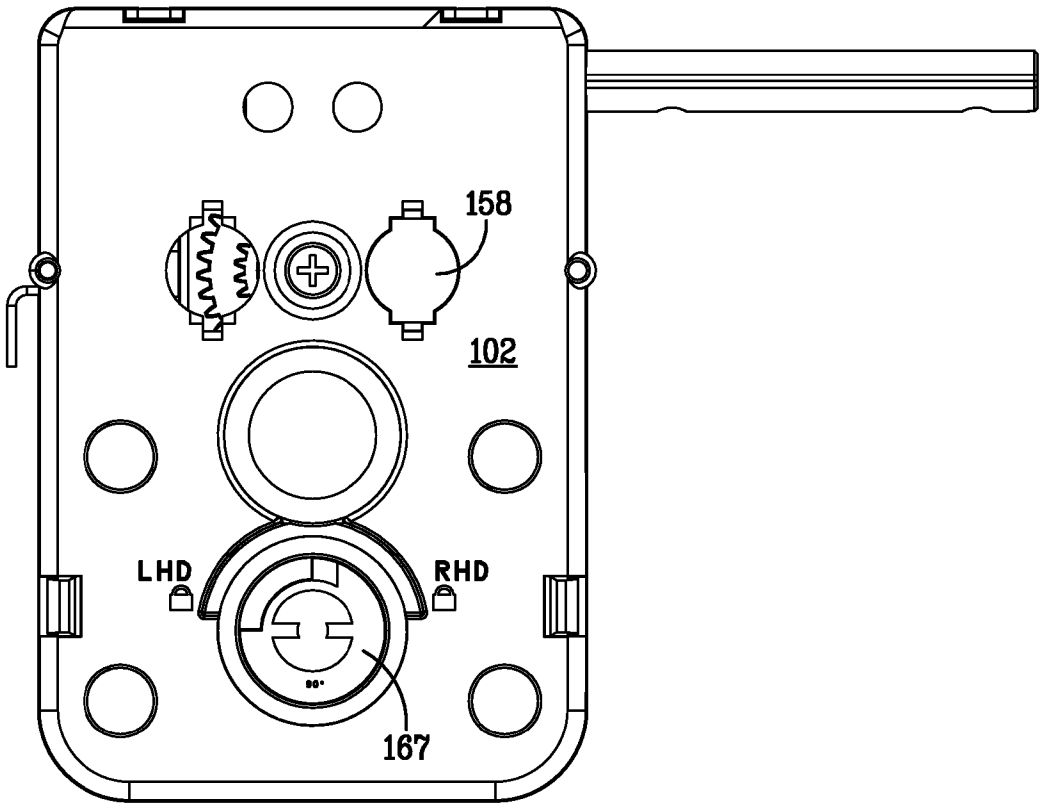
FIG. 64 shows a view of the interior facing side of the second embodiment of the latch according to the present invention and the third type of adaptor for a lock plug and the latching means in the latched position.
Figure 67:
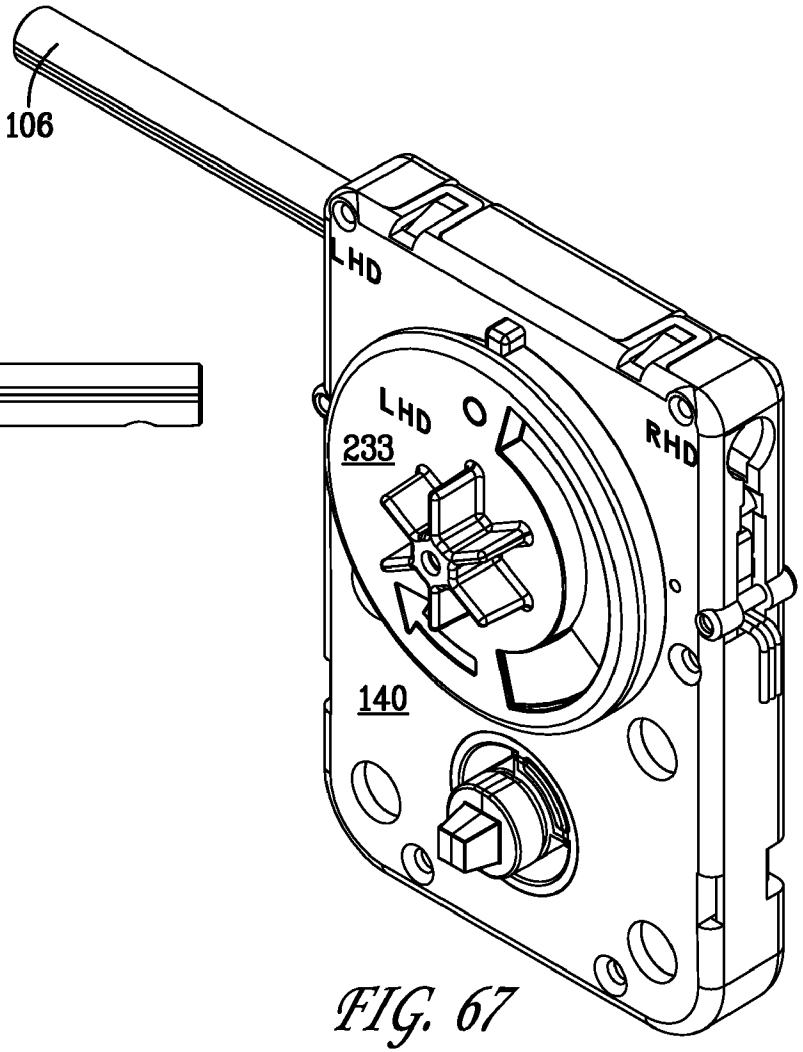
FIG. 67 shows a perspective view of the interior facing side of the second embodiment of the latch according to the present invention and the fourth type of adaptor for a lock plug and the latching means in the latched position.
Figure 66:
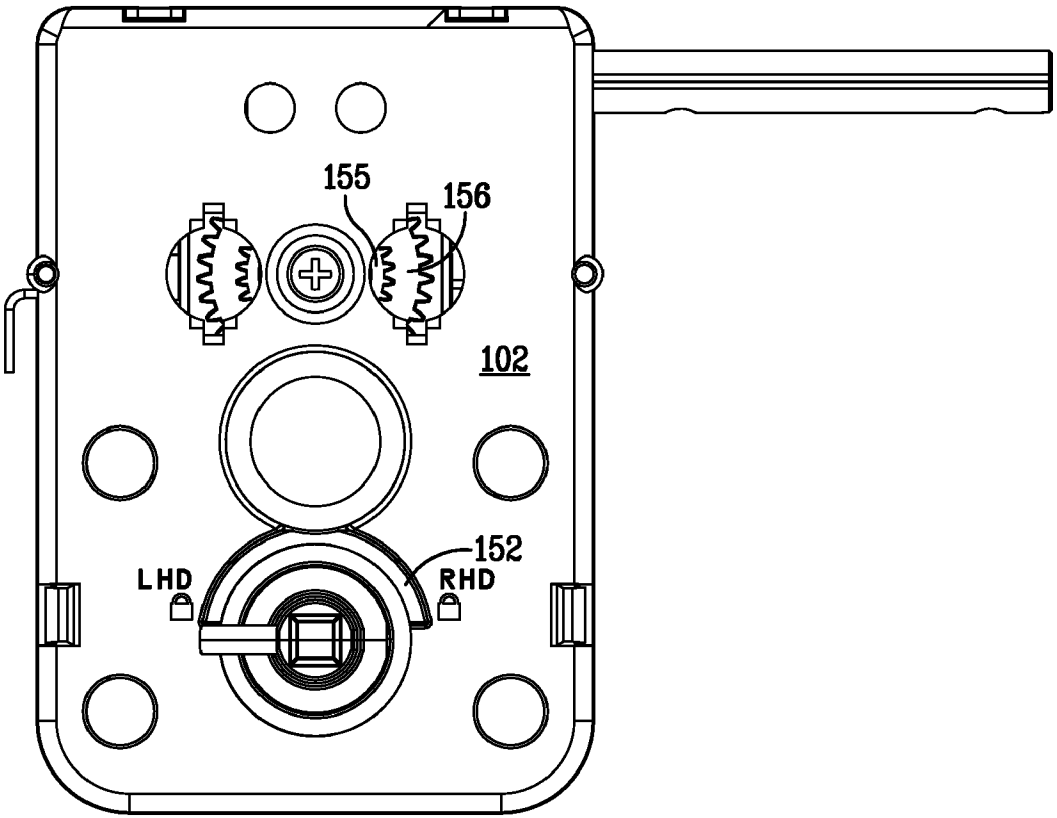
FIG. 66 shows a view of the interior facing side of the second embodiment of the latch according to the present invention and the fourth type of adaptor for a lock plug and the latching means in the latched position.
Figure 67B:
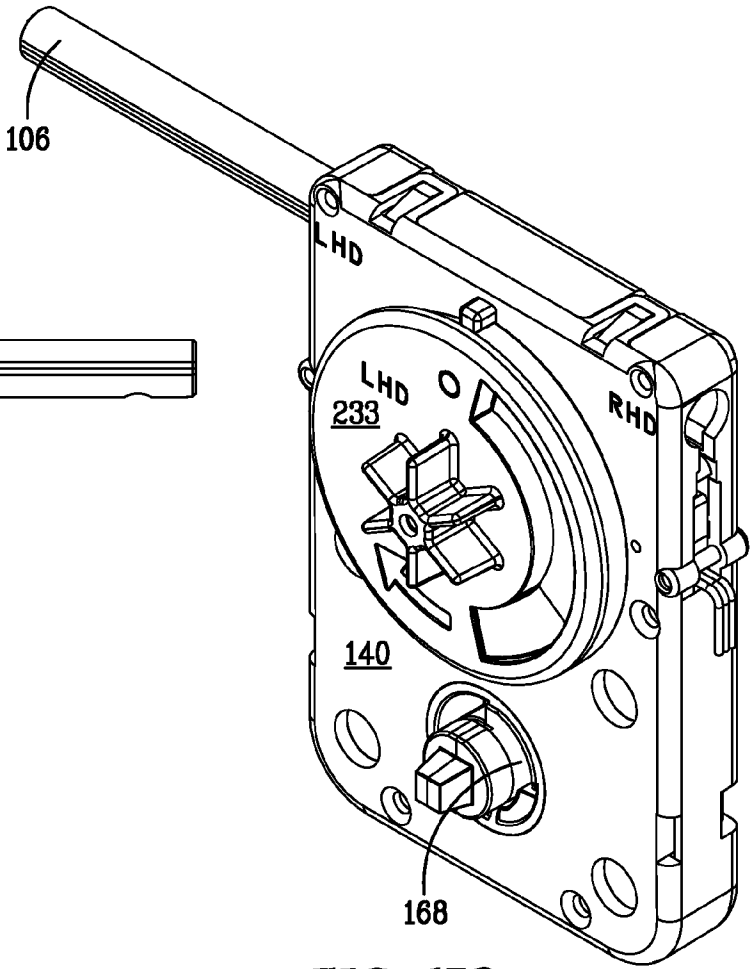
FIG. 67B shows a perspective view of the interior facing side of the second embodiment of the latch according to the present invention and the fourth type of adaptor for a lock plug and the latching means in the unlatched position.
Figure 67A:
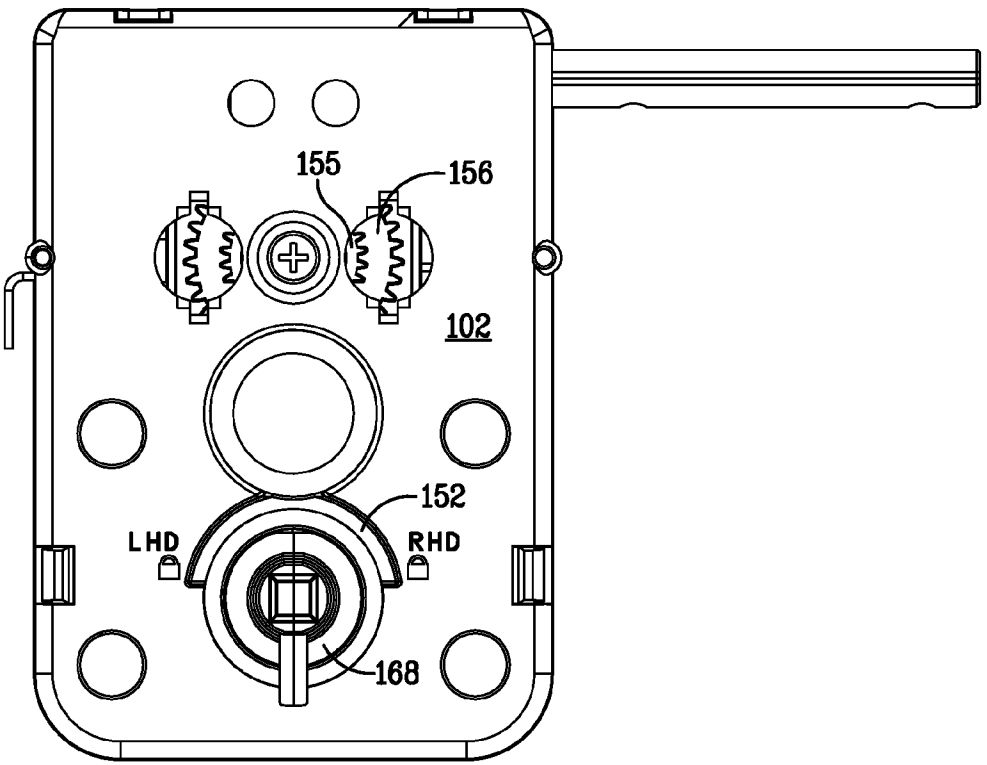
FIG. 67A shows a view of the interior facing side of the second embodiment of the latch according to the present invention and the fourth type of adaptor for a lock plug and the latching means in the unlatched position.
Figure 69:
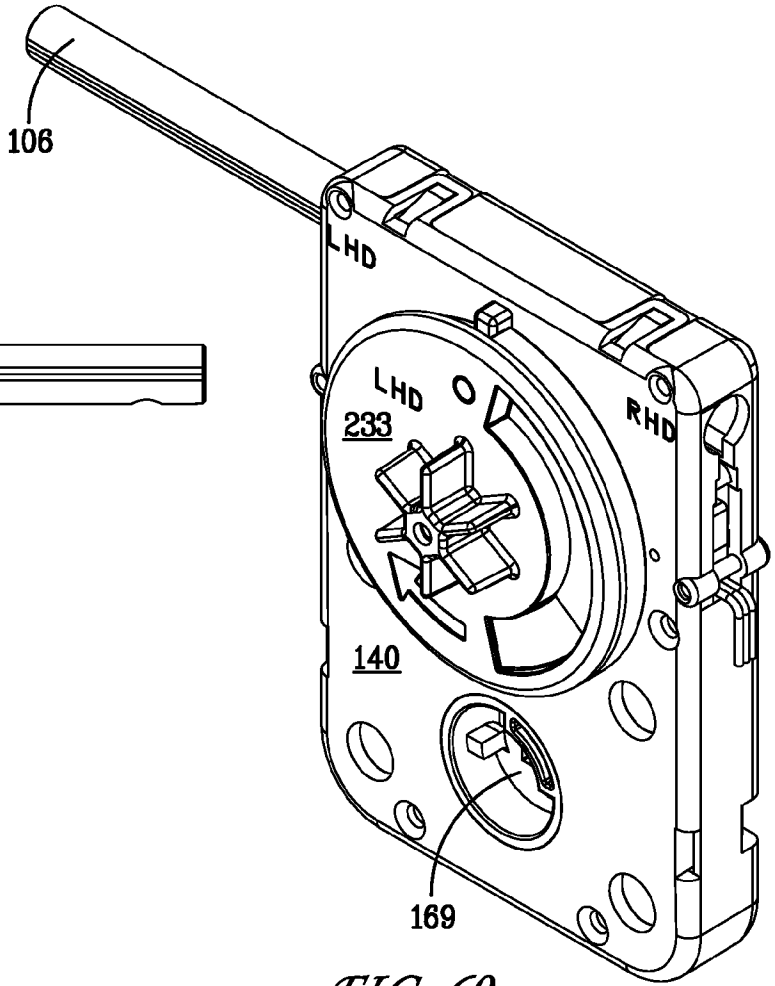
FIG. 69 shows a perspective view of the interior facing side of the second embodiment of the latch according to the present invention and the fifth type of adaptor for a lock plug and the latching means in the latched position.
Figure 68:
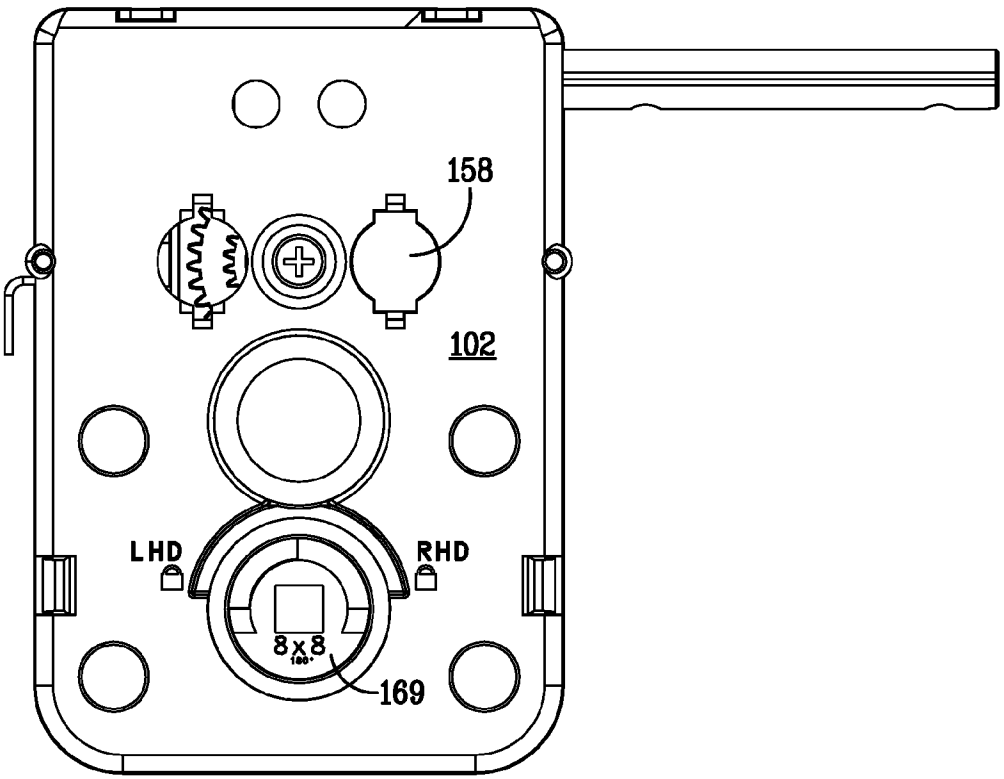
FIG. 68 shows a view of the interior facing side of the second embodiment of the latch according to the present invention and the fifth type of adaptor for a lock plug and the latching means in the latched position.
Figure 71:
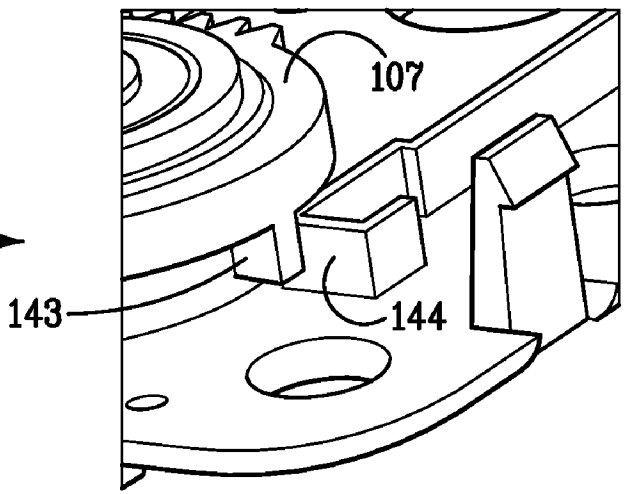
FIG. 71 is a partial view of the cover plate and drive gear of FIG. 70.
Figure 70:
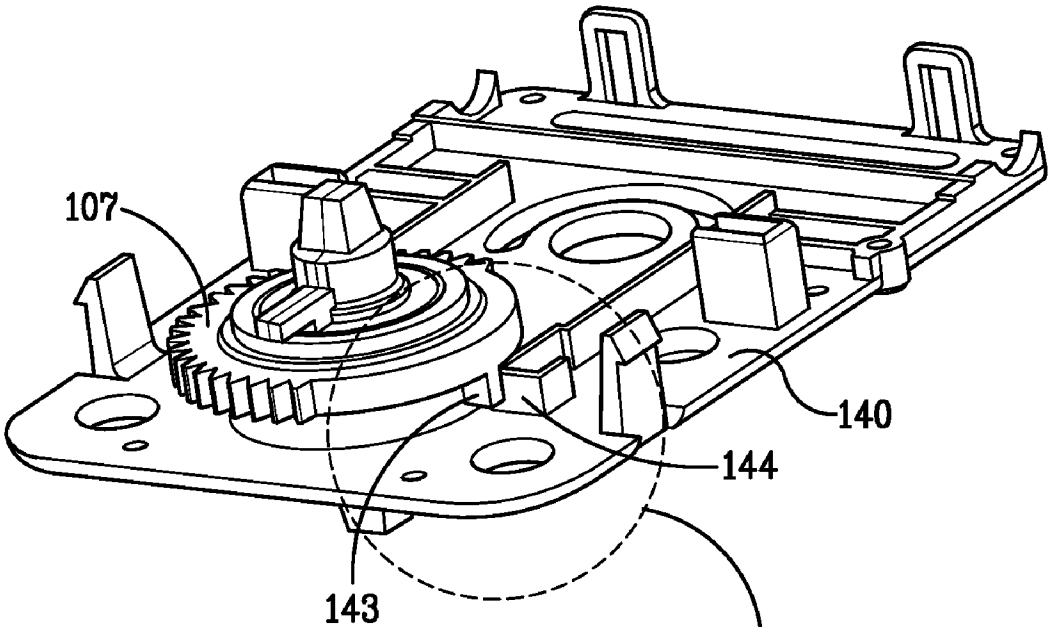
FIG. 70 is a right side perspective view of the cover plate and drive gear having an abutment of the second embodiment of the invention.
Figure 72:
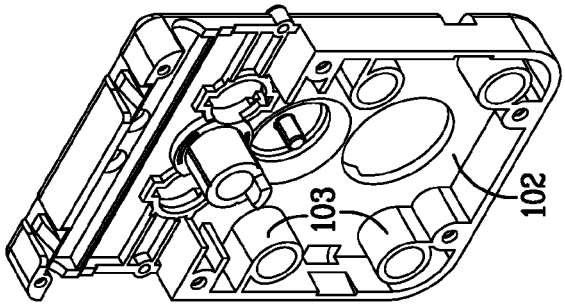
FIG. 72 is a perspective view of the interior facing side of the housing of the latch of the present invention.

In the event that a user such as a passenger in the vehicle intended to open the latch 100 from the latched position as seen in FIGS. 50 and 58, the user can rotate turnhandle 132 45 degrees as shown in FIG. 51 until drop gear engaging means 135 has disengaged from idler gear 110 as shown in FIG. 52 such that left cam means driving abutment 141 rotates top gear 111 about 115 degrees clockwise by engagement of abutment 239 on top gear peg 142. At first rotation of top gear 111 retracts rack 112 about 6 mm such that rack pin 124 is no longer engaged in notch 125 then rack 112 retracts bolt 106 about 30 mm to the unlatched position. Idler gear 110 remains enmeshed with top gear 111 such that top gear 111 rotates counterclockwise and idler gear 110 rotates about 230 degrees counterclockwise. Rotation of left cam means 233 is limited by engagement of second left cam means abutment 237 and first left cam means abutment 239 with cover stop 138. Drop gear 108 has moved about 3 mm away from idler gear by the action of left cam surface 234.

The idler gear 110 and drop gear 108 can be reengaged as described above except that the direction of rotation is reversed with respect to the second embodiment as compared to the first embodiment.

Left cam means 233 has left cam fastening means 264 which engages turnhandle fastening means 163 and left cam biasing abutment which biases against torsion spring 171.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

We claim:

1. A latch for selectively latching and unlatching a first member which is connected to said latch to the surface of a keeper on the second member, said latch comprising:

a latching means for engaging the surface of the keeper on the second member, said latching means being moveable from a latched position in which said latching means engages the surface of the keeper to an unlatched position in which said latching means does not engage the surface of the keeper such that the first member can be unlatched from the second member;

a rotating means for moving the latching means between the latched position and the unlatched position, said rotating means being moveable between a first position in which said latching means is in the latched position to a second position in which said latching means is in the unlatched position;

a driving means for moving the rotating means between the first position and the second position, said driving means being rotatable about a first rotation axis that is parallel to a second rotation axis, said rotating means being rotatable about said second rotation axis;

a disengaging means for disengaging the driving means from the rotating means such that said rotating means can move said latching means between the latched and unlatched position when said driving means is not moving, said disengaging means being moveable from an engaged position in which movement of said driving means moves said rotating means such that said latching means can move between the latched and unlatched position, and a disengaged position in which movement of the driving means does not move said rotating means; and a cam means for moving said disengaging means between the engaged and disengaged position and for moving said rotating means such that said rotating means moves the latching means between the first position in which said latching means is in the latched position to a second position in which said latching means is in the unlatched position.

2. The latch according to claim 1 wherein:

the latching means has a rack having rack teeth;

said rotating means is a gear, said gear being rotatable, said gear having teeth for engaging said rack teeth such that said latching means is moved between the latched and unlatched position.

3. The latch according to claim 1, further comprising a biasing means, wherein said biasing means biases said disengaging means towards the engaged position.

4. The latch according to claim 3 further comprising a mounting means for supporting the latching means, said mounting means having a blocking means for maintaining the latching means in a blocking position such that said latching means is not capable of movement from the latched position to the unlatched position, and a releasing means for releasing said latching means from said blocking position when said cam means is moved.

5. The latch according to claim 4 wherein the cam means is a disc having a cam surface and said disengaging means is a gear which is axially displaceable by said cam means between the engaged position and the disengaged position upon rotation of said cam means.

6. The latch according to claim 5 wherein said cam means is rotatable about 45 degrees to move the disengaging means from the engaged position to the disengaged position.

7. The latch according to claim 5 wherein said blocking means comprises a pin and a notch in said mounting means in which said pin is located when said latching means is in the blocked position, and said releasing means comprises a surface which moves said pin out of the notch when said cam means is rotated.

8. The latch according to claim 5 wherein the mounting means is provided with a guide means for guiding movement of the latching means between the latched and unlatched position and said latching means is provided with a sliding means for engaging said guide means during movement of said latching means between the latch and unlatched position.

9. The latch according to claim 5 further comprising a second biasing means for biasing said cam means to a position such that said cam means permits said disengaging means to be in the engaged position.

10. The latch according to claim 4 in which said cam means first moves said releasing means to the blocked position and then moves the releasing means to a position in which said releasing means permits movement of the latching means to the unlatched position.

11. A latch for selectively latching and unlatching a first member which is connected to said latch to the surface of a keeper on the second member, said latch comprising:

a latching means for engaging the surface of the keeper on the second member, said latching means being moveable from a latched position in which said latching means engages the surface of the keeper to an unlatched position in which said latching means does not engage the surface of the keeper such that the first member can be unlatched from the second member;

a rotating means for moving the latching means between the latched position and the unlatched position, said rotating means being moveable between a first position in which said latching means is in the latched position to a second position in which said latching means is in the unlatched position;

a driving means for moving the rotating means between the first position and the second position;

a disengaging means for disengaging the driving means from the rotating means such that said rotating means can move said latching means between the latched and unlatched position when said driving means is not moving, said disengaging means being moveable from an engaged position in which movement of said driving means moves said rotating means such that said latching means can move between the latched and unlatched position, and a disengaged position in which movement of the driving means does not move said rotating means;

a cam means for moving said disengaging means between the engaged and disengaged position and for moving said rotating means such that said rotating means moves the latching means between the first position in which said latching means is in the latched position to a second position in which said latching means is in the unlatched position; and a mounting means for supporting the latching means, said mounting means having a blocking means for maintaining the latching means in a blocking position such that said latching means is not capable of movement from the latched position to the unlatched position, and a releasing means for releasing said latching means from said blocking position when said cam means is moved.

* * * * *